US009193163B2

(12) United States Patent
Ochi et al.

(10) Patent No.: US 9,193,163 B2
(45) Date of Patent: Nov. 24, 2015

(54) LIQUID DISCHARGE APPARATUS AND MANUFACTURING METHOD THEREOF

(71) Applicant: CANON KABUSHIKI KAISHA, Tokyo (JP)

(72) Inventors: Norihiko Ochi, Kawasaki (JP); Hidehiko Fujimura, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 23 days.

(21) Appl. No.: 14/165,865

(22) Filed: Jan. 28, 2014

(65) Prior Publication Data

US 2014/0217198 A1 Aug. 7, 2014

(30) Foreign Application Priority Data

Feb. 1, 2013 (JP) ..... 2013-018079
Feb. 1, 2013 (JP) ..... 2013-018080

(51) Int. Cl.

| | |
|---|---|
| ***B05B 1/08*** | (2006.01) |
| ***B05B 5/00*** | (2006.01) |
| ***B41J 2/16*** | (2006.01) |
| ***B41J 2/14*** | (2006.01) |

(52) U.S. Cl.

CPC ..... *B41J 2/1623* (2013.01); *B41J 2/14209* (2013.01); *B41J 2/1609* (2013.01); *B41J 2/1632* (2013.01); *B41J 2/1643* (2013.01); *B41J 2002/14491* (2013.01); *B41J 2202/11* (2013.01); *Y10T 156/1064* (2015.01)

(58) Field of Classification Search

CPC ..... B05B 17/0646; B05B 17/0684; B05B 17/0615

USPC ..... 239/102.1, 102.2, 706

See application file for complete search history.

(56) References Cited

U.S. PATENT DOCUMENTS

| | | | | |
|---|---|---|---|---|
| RE36,667 | E | 4/2000 | Michaelis et al. | |
| 6,533,197 | B1 * | 3/2003 | Takeuchi et al. | 239/596 |
| 8,196,843 | B2 * | 6/2012 | Sakamoto et al. | 239/4 |
| 8,235,309 | B2 * | 8/2012 | Xu et al. | 239/102.2 |
| 2012/0305665 | A1 * | 12/2012 | Ohashi | 239/102.2 |

FOREIGN PATENT DOCUMENTS

| | | |
|---|---|---|
| JP | 06-006375 B2 | 1/1994 |

* cited by examiner

*Primary Examiner* — Davis Hwu

(74) *Attorney, Agent, or Firm* — Fitzpatrick, Cella, Harper & Scinto

(57) ABSTRACT

A liquid discharge apparatus in which controllability of liquid discharge speed is improved is provided. A pair of electrodes is arranged so as to divide a partition into a movable region to which an electric field for shear-deforming the partition at a portion on a nozzle side is applied and an immovable region to which the electric field is not applied at a portion on a common liquid chamber side. It is assumed that a cross-section area of a cross section along a face perpendicular to a longitudinal direction at a second end of an individual liquid chamber is S2, and a cross-section area along a face perpendicular to the longitudinal direction at a first boundary point closest to a first end on a boundary between the movable region and the immovable region is S1. The cross-section area S2 is made wider than the cross-section area S1.

16 Claims, 31 Drawing Sheets

LIQUID DISCHARGE APPARATUS AND MANUFACTURING METHOD THEREOF

BACKGROUND OF THE INVENTION

1. Field of the Invention

The present invention relates to a liquid discharge apparatus in which individual liquid chambers partitioned by partitions made by a piezoelectric material are formed, and a manufacturing method of the liquid discharge apparatus.

2. Description of the Related Art

Conventionally, as a liquid discharge apparatus, a liquid discharge head which emits droplets by changing pressure of ink in an individual liquid chamber to generate a flow of the ink, and thus discharging the ink from a nozzle has been popularized. In particular, a drop-on-demand head has been most popularized. Here, there are roughly two methods of applying the pressure to the ink, that is, one is the method of changing the pressure to the ink by changing the pressure in the individual liquid chamber in response to a driving signal supplied to a piezoelectric element, and the other is the method of applying the pressure to the ink by generating bubbles in the individual liquid chamber in response to a driving signal supplied to a resistor.

The liquid discharge head in which the piezoelectric element is used can be manufactured with comparative ease by machine-processing a bulk piezoelectric material. Moreover, the liquid discharge head of this type has an advantage that restriction of ink is comparatively small and thus inks of wide-range materials can be selectively applied to a recording medium. Based on this point of view, in recent years, an attempt to utilize the liquid discharge head for industrial applications such as manufacture of color filters, formation of wirings and the like is often made.

In this context, in the piezoelectrically-actuated liquid discharge heads to be industrially utilized, a shear mode method is often adopted. In the shear mode method, a phenomenon that a polarized piezoelectric material is shear-deformed when an electric field is applied thereto in its orthogonal direction is utilized. Here, the piezoelectric material to be deformed corresponds to a partition which is formed by processing and making an ink groove or the like on the polarized bulk piezoelectric material with use of a dicing blade. A pair of electrodes is formed on both the side faces of the partition to drive the piezoelectric material, and the liquid discharge head is finally constituted by forming a nozzle plate having nozzles thereon and an ink supply system (Japanese Patent Publication No. H06-006375).

The liquid discharge head which adopts the shear mode method can be manufactured with comparative ease. However, to obtain desired discharge speed, it is necessary to control the pressure to be applied to the liquid in the individual liquid chamber by shear-deforming the piezoelectric material with voltage (a potential difference) to be applied to both the sides of the partition constituted by the piezoelectric material.

In general, discharge performance of the piezoelectrically-actuated liquid discharge head is indicated by a relation between the voltage and the discharge speed, and it has been known that the discharge speed is proportionate to the voltage. To obtain the liquid discharge head which can achieve low power consumption and superior controllability for discharge speed, it is necessary to enable to discharge a droplet with low voltage and reduce a percentage of a change of the discharge speed to the voltage (hereinafter, called a voltage sensitivity).

Since the discharge speed is proportionate to the pressure to be applied to the liquid in the individual liquid chamber, it is possible to control the discharge speed by adjusting the pressure to be applied to the liquid based on kinds of piezoelectric material, and widths and heights of the partition and the individual liquid chamber. For example, to increase the pressure to be applied to the liquid, it is effective to enlarge a displacement volume of the individual liquid chamber by narrowing the width of the individual liquid chamber and/or heightening the height of the individual liquid chamber.

Incidentally, a relation between the displacement volume and the constitutions of the partition and the individual liquid chamber is expressed as follows. That is, if it is assumed that the displacement volume is $\Delta Vol$, a piezoelectric constant is $d_{15}$, the height of the individual liquid chamber is H, the width of the partition is T, the voltage is V, and the length of the individual liquid chamber is z, then a relational expression $\Delta Vol=(d_{15}\times H\times z\times V)\div(4\times T)$ is given.

However, if it intends to enlarge the displacement volume over the entire longitudinal direction by changing the width of the partition and the height of the individual liquid chamber, a percentage of a change of the displacement volume to the voltage becomes large according to the above relational expression. Since the displacement volume and the pressure to be applied to the liquid are in a proportional relation, a percentage of a change of the voltage to the pressure to be applied to the liquid becomes large resultingly. That is, if it intends to increase the pressure to be applied to the liquid in the individual liquid chamber by simply adjusting the width and the height of the individual liquid chamber in order to discharge the droplet with low voltage, the voltage sensitivity of the discharge speed increases, and controllability of the discharge speed of the droplet deteriorates.

In particular, if the diameter of the nozzle is made small up to, e.g., 5 μm to 15 μm to discharge minute droplets, since the distance between the wall face of the nozzle and the center of the nozzle becomes close to each other, influences of viscosity resistance and surface tension become large, and flow speed of the liquid tends to concentrate on the center of the nozzle. Thus, it becomes difficult to cut off a liquid column formed from the nozzle to the discharge direction. Therefore, when the liquid column is cut off and thus the droplet is formed, since motion energy stored at the central portion of the nozzle is large, the discharge speed of the droplet is high. That is, by making the diameter of the nozzle small, the pressure to be applied to the liquid in the individual liquid chamber, i.e., the percentage of the change of the discharge speed of the droplet to the voltage to be applied to the pair of electrodes (the voltage sensitivity), becomes steep much more, and thus the controllability of the discharge speed of the droplets further deteriorates.

In line with this, the present invention aims to provide a liquid discharge apparatus which has improved controllability of the liquid discharge speed of the droplets.

SUMMARY OF THE INVENTION

The present invention is characterized by a liquid discharge apparatus comprising: a first substrate and a second substrate; a plurality of partitions, constituted by a piezoelectric material, which form a plurality of individual liquid chambers extending in a longitudinal direction; a nozzle member which is arranged on a side of a first end of the each individual liquid chamber, and on which a nozzle connected to the each individual liquid chamber is formed; a common liquid chamber forming member which is arranged on a side of a second end opposite to the first end of the each individual liquid chamber, and forms a common liquid chamber connected to the plurality of individual liquid chambers; and a plurality of pairs of electrodes each of which is arranged on both side faces of the each partition, such that the each partition is divided into a movable region to which an electric field for shear-deforming the each partition at a portion on the side of the nozzle is applied and an immovable region to which the electric field is not applied at a portion on the side of the common liquid chamber, wherein the each individual liquid chamber is formed such that a cross-section area of a cross section along a face perpendicular to the longitudinal direction at the second end is wider than a cross-section area of a cross section along the face perpendicular to the longitudinal direction at a first boundary point closest to the first end on a boundary between the movable region and the immovable region.

Moreover, the present invention is characterized by a liquid discharge apparatus comprising: a first substrate and a second substrate; a plurality of partitions, constituted by a piezoelectric material, which form a plurality of individual liquid chambers extending in a longitudinal direction; a plurality of pairs of electrodes each of which is arranged on both side faces of the each partition so as to shear-deform the each partition; a nozzle member which is arranged on a side of a first end of the each individual liquid chamber, and on which a nozzle connected to the each individual liquid chamber is formed; and a common liquid chamber forming member which is arranged on a side of a second end opposite to the first end of the each individual liquid chamber, and forms a common liquid chamber by surrounding together with the first substrate and the second substrate, wherein the each individual liquid chamber is connected to the common liquid chamber through a first opening opened to the longitudinal direction at the second end and a second opening opened to a height direction.

Moreover, the present invention is characterized by a manufacturing method of a liquid discharge apparatus in which a plurality of individual liquid chambers are formed by bonding a piezoelectric substrate on which partition grooves and front grooves have been processed and a second substrate to each other, and the plurality of individual liquid chambers are communicated with a common liquid chamber for supplying ink, the method comprising: forming the partition groove by forming a flat portion and a curved face portion deeper than the flat portion on the piezoelectric substrate, wherein the curved face portion is communicated with the common liquid chamber.

Moreover, the present invention is characterized by a manufacturing method of a liquid discharge apparatus in which a plurality of individual liquid chambers are formed by bonding a piezoelectric substrate on which partition grooves and front grooves have been processed and a second substrate to each other, and the plurality of individual liquid chambers are communicated with a common liquid chamber for supplying ink, the method comprising: preparing the second substrate in which a counterbore portion has been formed, wherein the counterbore portion is arranged such that the counterbore portion constitutes a part of the common liquid chamber and the counterbore portion and the plurality of individual liquid chambers are communicated.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

First Embodiment

Figure 1:
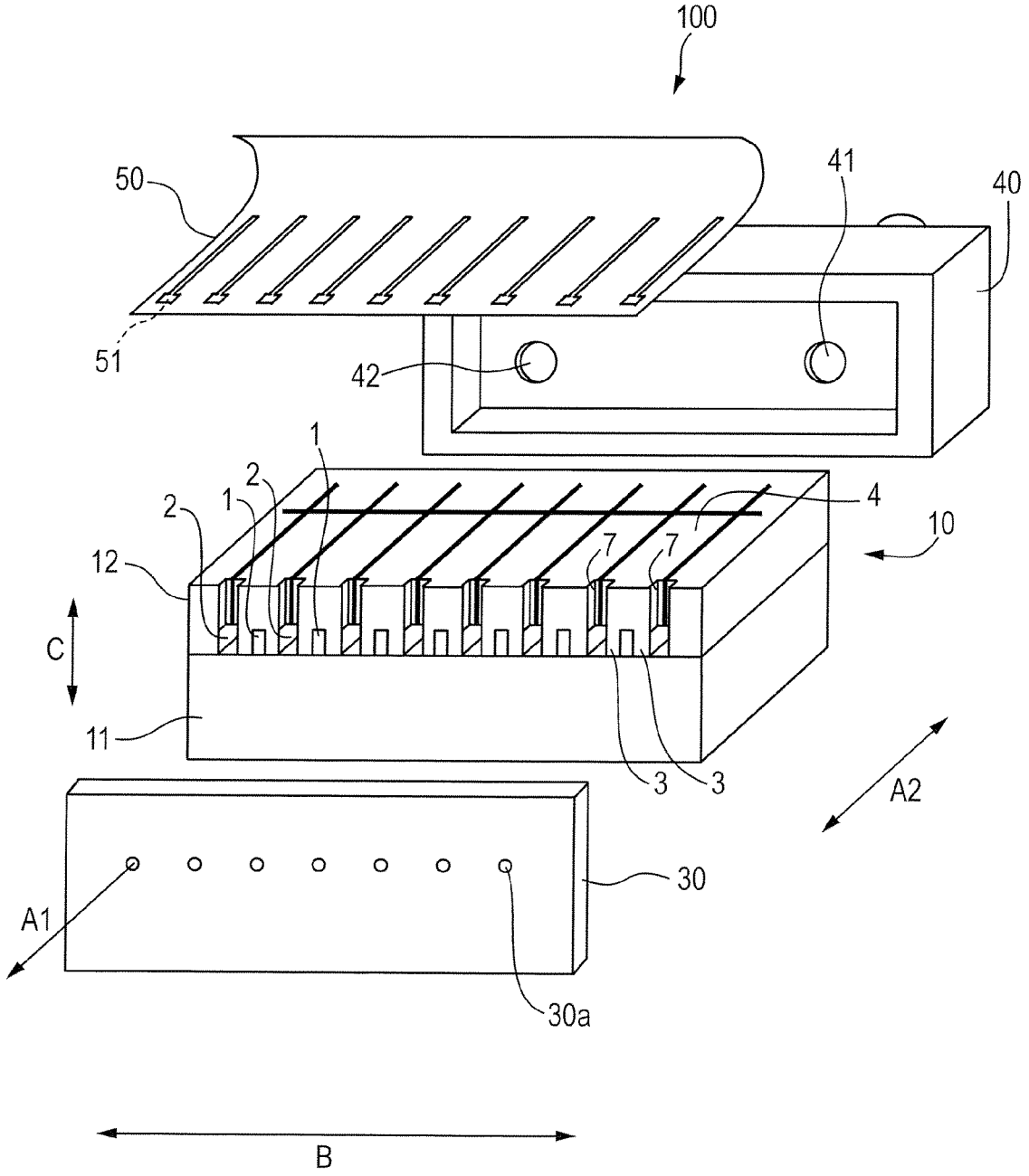
FIG. 1 is an exploded schematic diagram illustrating an inkjet head as an example of a liquid discharge head serving as a liquid discharge apparatus according to a first embodiment of the present invention.

FIG. 1 is an exploded schematic diagram illustrating an inkjet head as an example of a liquid discharge head serving as a liquid discharge apparatus according to the first embodiment of the present invention. In FIG. 1, an inkjet head 100 is equipped with a discharge unit 10 on which a plurality of individual liquid chambers 1 and a plurality of dummy chambers 2 which are provided in parallel in a width direction B orthogonal to a longitudinal direction A2 parallel to a liquid discharge direction A1 are formed. On the face on the liquid discharge side (i.e., the front face) of the discharge unit 10, a nozzle plate 30 which serves as a nozzle member and on which a nozzle 30*a* corresponding to each individual liquid chamber 1 is formed is arranged. The discharge unit 10 and the nozzle plate 30 are aligned and bonded to each other such that the positions of the individual liquid chamber 1 and the nozzle 30*a* coincide with each other (that is, the individual liquid chamber 1 and the nozzle 30*a* are communicated with each other). Thus, each nozzle 30*a* is connected to each individual liquid chamber 1. The individual liquid chamber 1 goes through the discharge unit from the front face toward a liquid supply face (i.e., the back face). The dummy chamber 2 is an air chamber which goes through the discharge chamber toward the front face side but does not go through the discharge chamber toward the liquid supply face (i.e., the back face).

A manifold 40 which serves as a common liquid chamber forming member, and on which an ink supply port 41 and an ink recovery port 42 both communicated with an ink tank (not illustrated) are provided is connected to the back face side of the discharge unit 10. Moreover, a plurality of front face grooves 7 each of which is communicated with each dummy chamber 2 are formed on the front face side of the discharge unit 10. A flexible substrate 50 is bonded to the upper face of the discharge unit 10.

Figure 2A:
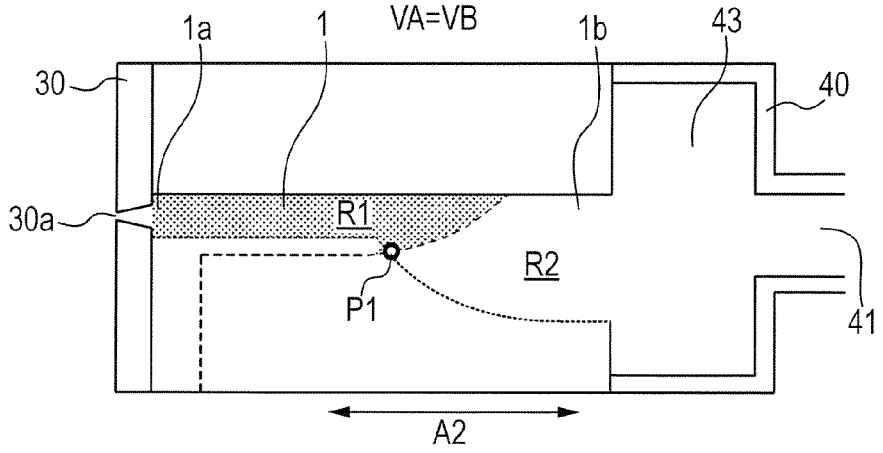
FIGS. 2A, 2B and 2C are diagrams for describing an operation of the inkjet head at a time when an ink is discharged.
Figure 2B:
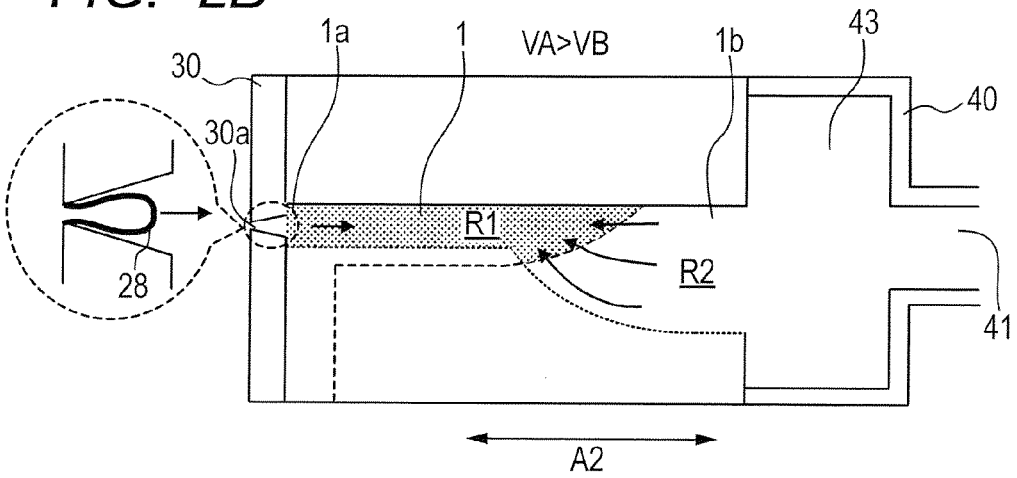
Figure 2C:
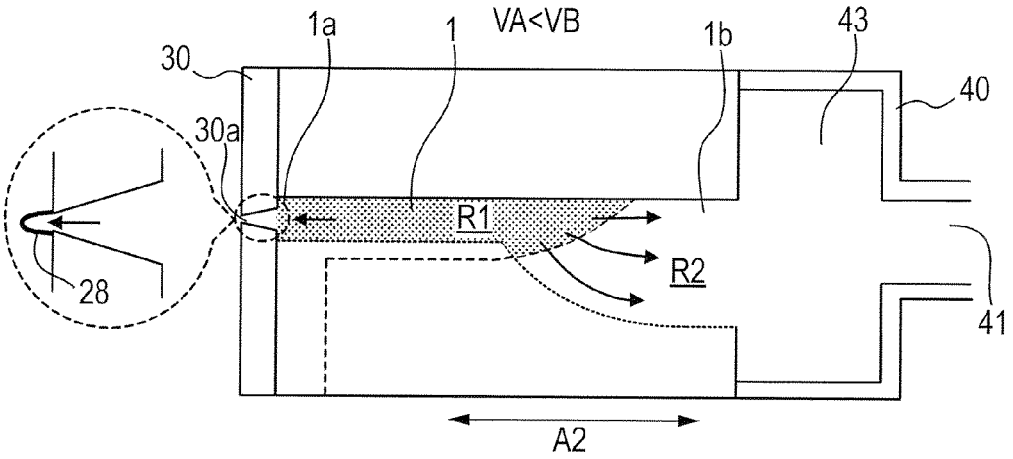
Figure 3:
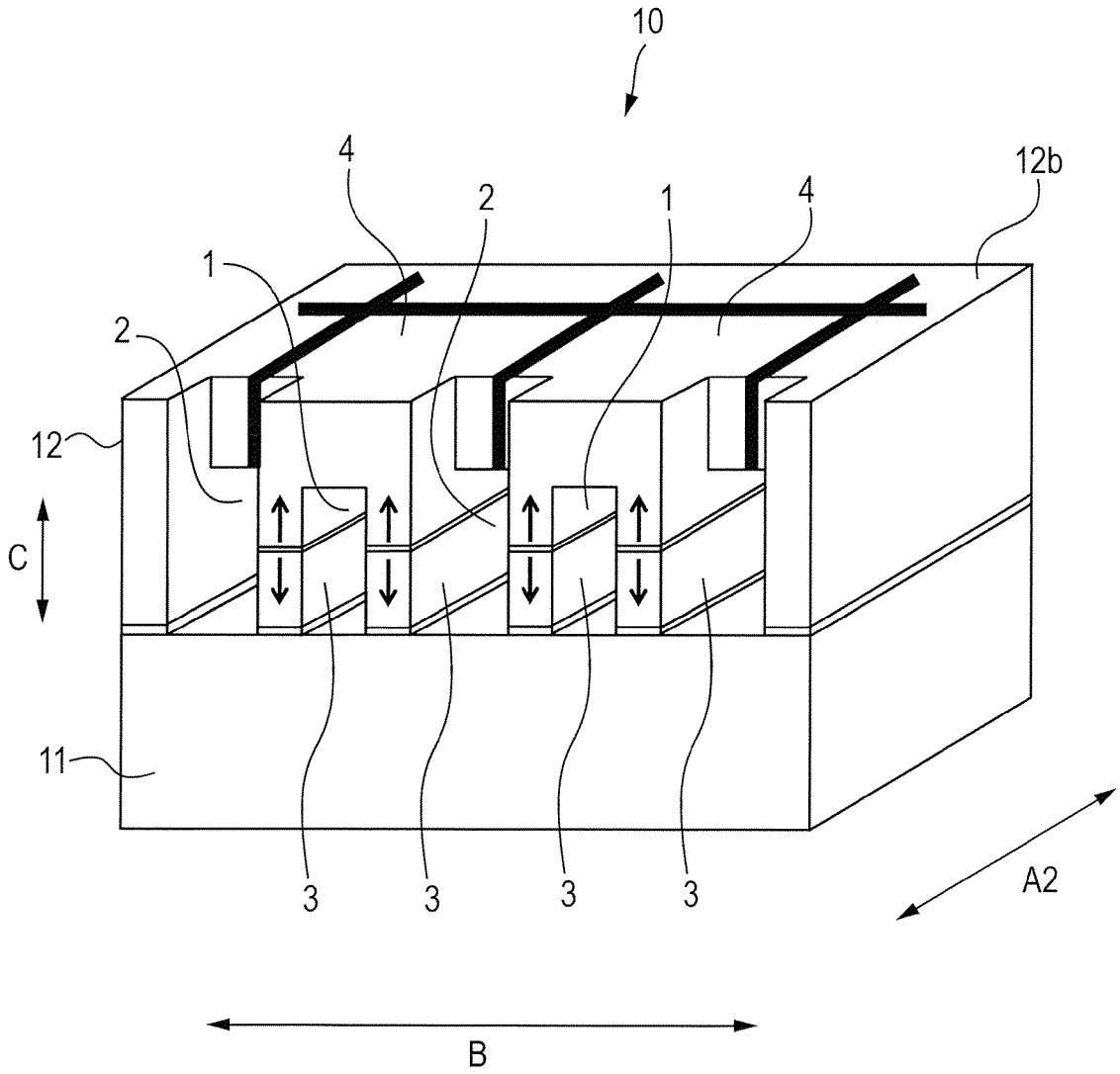
FIG. 3 is a partial perspective diagram illustrating a discharge unit.
Figure 4:
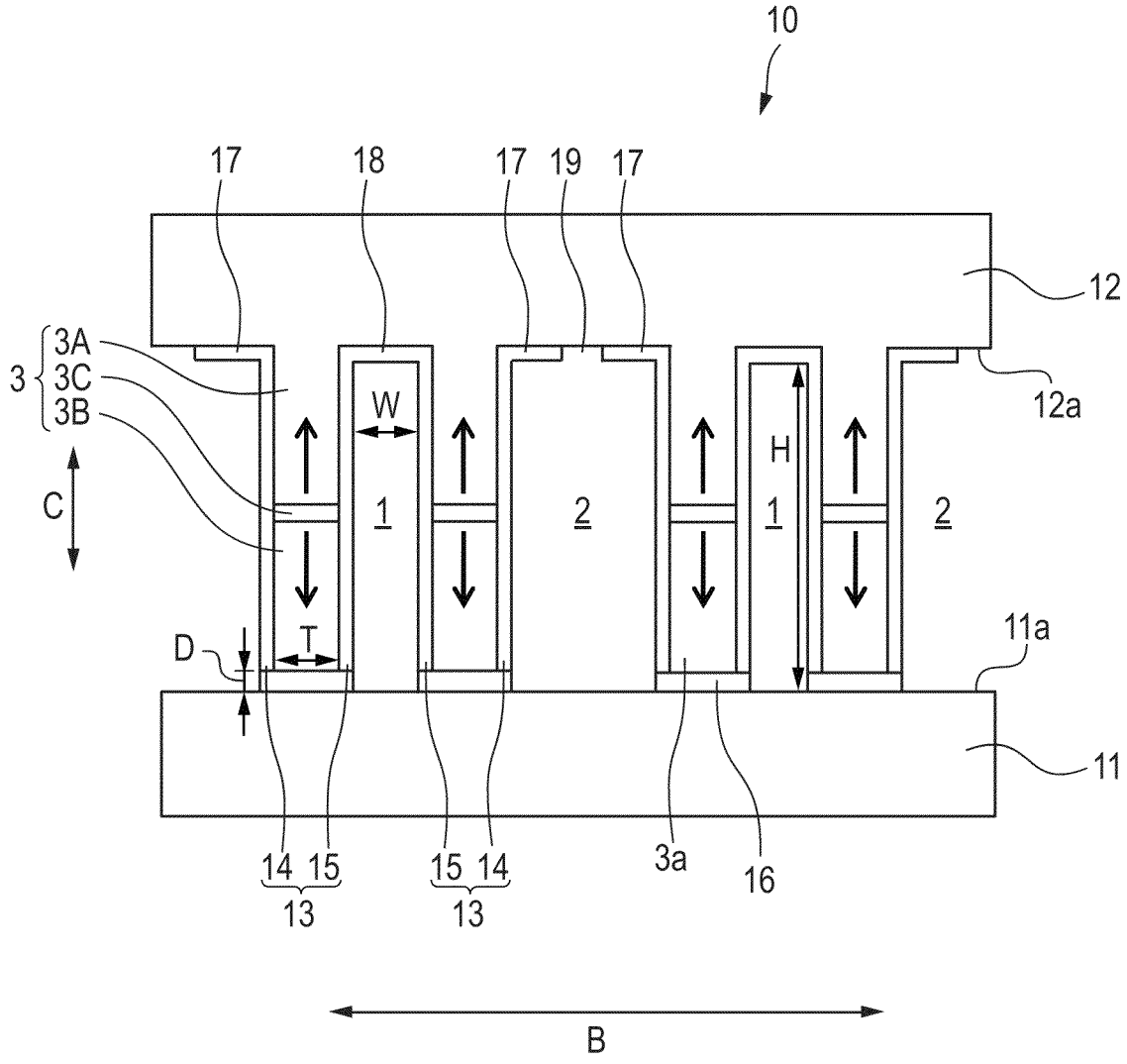
FIG. 4 is a partial cross-section diagram illustrating the discharge unit.

FIGS. 2A to 2C are cross-section perspective diagrams of an ink flow path for describing a flow of ink in the inkjet head 100, FIG. 3 is a partial perspective diagram illustrating the discharge unit 10, and FIG. 4 is a partial cross-section diagram illustrating the discharge unit 10.

As illustrated in FIG. 3, the discharge unit 10 has two substrates 11 and 12 (the first substrate 11 and the second substrate 12) which face each other, and a plurality of partitions 3 which are provided in parallel with space between the first substrate 11 and the second substrate 12 in the width direction B orthogonal to a height direction C.

Each partition 3 is formed longwise, and the plurality of individual liquid chambers 1 and the plurality of dummy chambers 2 extending in the longitudinal direction A2 are formed by the plurality of partitions 3. Each partition 3 is constituted by a piezoelectric material which is polarized in the height direction C.

Moreover, as illustrated in FIG. 4, the discharge unit 10 has a plurality of pairs of electrodes 13 each of which will be also called an electrode pair, is arranged on both the side faces of the partition 3 in the width direction B, and shear-deforms the partition 3. In other words, the electrode pair 13 is provided for each partition 3. More specifically, the electrode pair 13 which consists of a signal electrode 14 and a signal electrode 15 is provided on both the side faces of each partition 3 in the direction orthogonal to the liquid discharge direction A1 (the longitudinal direction A2), i.e., in the width direction B. The signal electrode 14 is arranged on the side of the dummy chamber, and the signal electrode 15 is arranged on the side of the individual liquid chamber.

A bottom face electrode 17 which is continuously connected to the signal electrode 14 and thus electrically conducted to the signal electrode 14 and a bottom face electrode 18 which is continuously connected to the signal electrode 15 and thus electrically conducted to the signal electrode 15 are formed on one face 12*a* of the second substrate 12. The bottom face electrodes 17 and 17 which are formed respectively on the facing sides in the dummy chamber 2 are separated from each other by a groove 19 and thus electrically insulated.

The signal electrode 14 is electrically connected to an extraction electrode 4 through the front face electrode formed in the front face groove 7 illustrated in FIG. 1, and the signal electrode 15 is grounded. When a voltage is applied to the electrode pairs 13, an electric field is applied to the partitions 3 in the direction (the width direction B) orthogonal to the polarization direction, and thus the partitions 3 serve as a piezoelectric element for shear-deforming the partitions in the width direction B. More specifically, the ground potential is set to the signal electrode 15, whereas the voltage is applied to the signal electrode 14. Since the potential of the electrode 15 in the individual liquid chamber 1 is equivalent to the ground potential, a liquid having conductivity can be used.

As illustrated in FIGS. 2A to 2C, the nozzle plate 30 is arranged on the side of a first end 1*a* in the longitudinal direction A2 being the liquid discharge side of the individual liquid chamber 1. On the other hand, the manifold 40 is arranged on the side of a second end 1*b* in the longitudinal direction A2 opposite to the first end 1*a*, and thus the common liquid chamber 43 is formed. The common liquid chamber 43 is connected to each individual liquid chamber 1. An ink I (not illustrated) is supplied from a not-illustrated ink tank to the common liquid chamber 43 through the ink supply port 41. The ink I supplied to the common liquid chamber 43 is filled in each individual liquid chamber 1. Then, when the electric field is applied by the electrode pair in the direction orthogonal to the polarization direction, the partition is shear-deformed, and thus the volume of the individual liquid chamber 1 is changed. Thus, the ink (i.e., an ink droplet) I which is the liquid (a liquid droplet) is discharged from the nozzle 30*a*.

In the present embodiment, as illustrated in FIG. 4, the plurality of partitions 3 are formed with space in the width direction B so as to protrude from the one face 12*a* of the second substrate 12. That is, on the one face 12*a*, the plurality of partitions 3 are protrusively provided with space in the direction B. Further, a tip 3*a* of each partition 3 and one face 11*a* of the first substrate 11 are bonded to each other by an adhesive (bond) 16, and the individual liquid chamber 1 and the dummy chamber 2 are partitioned by the partition 3 and they are alternately formed in the width direction B. That is, the dummy chamber 2 partitioned by each partition 3 is formed between the adjacent two individual liquid chambers 1 and 1 among the plurality of individual liquid chambers 1. The dummy chamber 2 is the air chamber which is not connected to the common liquid chamber 43. In other words, each of the individual liquid chamber 1 and the dummy chamber 2 constitutes the space partitioned by the partitions 3, that is, the space surrounded by the partitions 3, the second substrate 12 and the first substrate 11.

If it is assumed that the individual liquid chamber 1 has a height H and the individual liquid chamber 1 has a width W, as illustrated in FIG. 4, the cross-section area of the cross section along the face perpendicular to the longitudinal direction A2 of the individual liquid chamber 1 is given by H×W. Here, the height H of the individual liquid chamber 1 is equivalent to the sum of the overall height of the partition 3 in the height direction C and a thickness D of the adhesive 16. Moreover, the width W of the individual liquid chamber 1 is equivalent to the width of the bottom face electrode 18, and a width T of the partition 3 is equivalent to the width between the signal electrode 14 and the signal electrode 15.

As illustrated in FIG. 3, the extraction electrode 4 is individually formed on the other face 12*b* of the second substrate 12 so as to correspond to each individual liquid chamber 1. As illustrated in FIG. 1, a signal wiring 51 of the flexible substrate 50 is bonded to the extraction electrode 4 formed on the second substrate 12. In this case, the extraction electrode 4 and the signal wiring 51 are respectively aligned and bonded to each other.

As indicated by the arrows illustrated in FIG. 4, each partition 3, which protrudes from the one face 12*a* of the second substrate 12, has a chevron structure in which a base-side piezoelectric material 3A polarized in parallel with the height direction C and a tip-side piezoelectric material 3B polarized in the opposite direction are bonded to each other by an adhesive 3C.

Figure 5A:
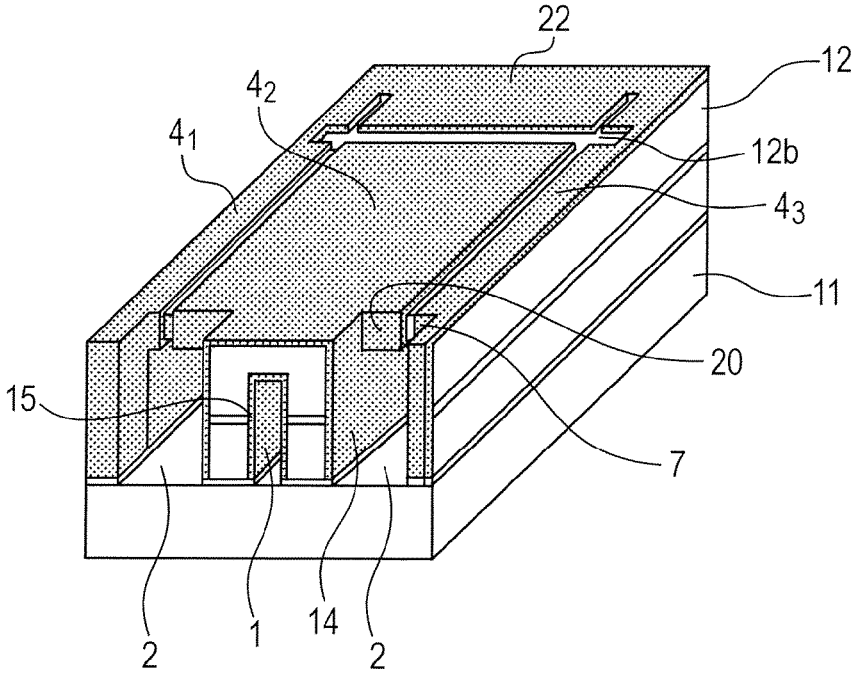
FIGS. 5A and 5B are partial perspective diagrams illustrating a part of the discharge unit.
Figure 5B:
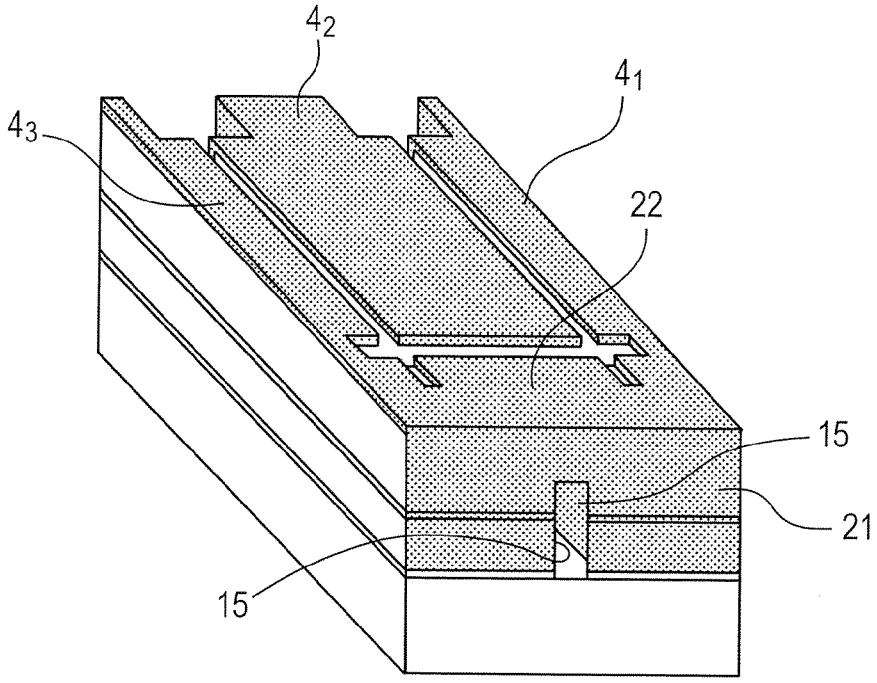

Subsequently, a method of applying the voltage to each of the electrodes 14 and 15 will be described. FIGS. 5A and 5B are partial perspective diagrams illustrating a part of the discharge unit 10. More specifically, FIG. 5A is the perspective diagram obtained by viewing the discharge unit 10 from the front face side, and FIG. 5B is the perspective diagram obtained by viewing the discharge unit 10 from the back face side. In FIGS. 5A and 5B, it is assumed that the one individual liquid chamber 1 and the two dummy chambers 2 are formed in the discharge unit 10.

As illustrated in FIG. 5A, a plurality of extraction electrodes $\mathbf{4}_1$, $\mathbf{4}_2$ and $\mathbf{4}_3$ and a common electrode 22 are formed on the other face 12*b* of the second substrate 12, and they are electrically connected to the signal wiring 51 of the flexible substrate 50 (FIG. 1).

As illustrated in FIG. 5A, a front face electrode 20, which is continuously connected to the signal electrode 14 and thus electrically conducted to the signal electrode 14, is formed inside the front face groove 7. The front face electrode 20 is connected so as to be electrically conducted to the extraction electrode $\mathbf{4}_2$. Moreover, as illustrated in FIG. 5B, a back face electrode 21, which is continuously connected to the signal electrode 15 and thus electrically conducted to the signal electrode 15, is formed. The back face electrode 21 is connected so as to be electrically conducted to the extraction electrodes $\mathbf{4}_1$ and $\mathbf{4}_3$ through the common electrode 22.

In the above electrode constitution, when a voltage VA is applied from the flexible substrate 50 (FIG. 1) to the extraction electrode $\mathbf{4}_2$, the voltage VA is applied to the signal electrode 14 through the front face electrode 20. Likewise, as illustrated in FIG. 5B, when a voltage VB is applied from the flexible substrate 50 (FIG. 1) to either the extraction electrode $\mathbf{4}_1$ or $\mathbf{4}_3$, the voltage VB is applied to the signal electrode 15 through the back face electrode 21. Incidentally, the voltage VB is equivalent to the ground potential in the present embodiment.

Figure 6A:
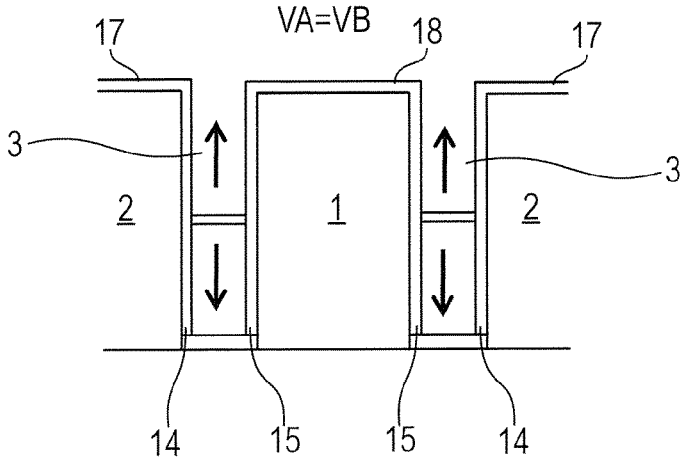
FIGS. 6A, 6B and 6C are schematic diagrams for describing displacement of a partition and deformation of an individual liquid chamber at a time when voltage is applied to each electrode.
Figure 6B:
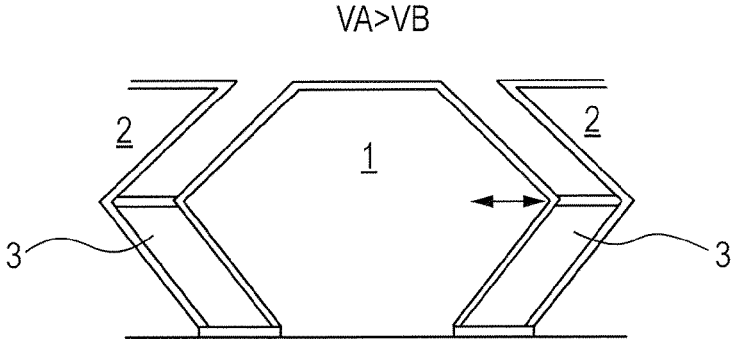
Figure 6C:
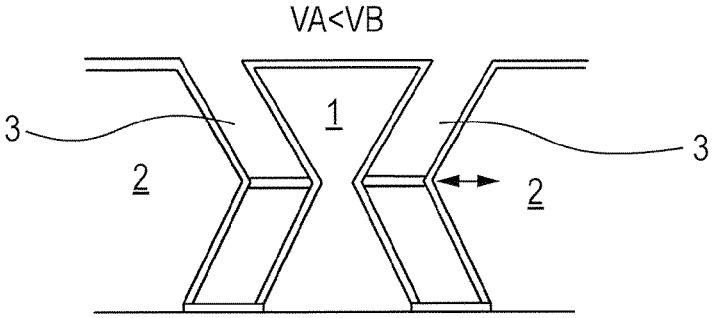

Subsequently, an operation of the inkjet head 100 according to the present embodiment will be described. FIGS. 6A, 6B and 6C are schematic diagrams for describing displacement of the partition 3 and deformation of the individual liquid chamber 1 at a time when the voltage is applied to each electrode. For the purpose of description, it is assumed that the voltage VA is applied to the signal electrode 14 and the voltage VB is applied to the signal electrode 15.

FIG. 6A shows the so-called ground state at a time when the applied voltages are in a relation of VA=VB. The partition 3 is not displaced in this state.

Further, FIG. 6B shows the state of the displacement of the partition 3 and the deformation of the individual liquid chamber 1 at a time when the applied voltages are in a relation of VA>VB. In this state, the voltages VA and VB are applied in the direction orthogonal to the polarization direction, and the partition 3 is shear-deformed. In this case, each partition 3 is deformed to be doglegged toward the direction for enlarging the cross-section area of the individual liquid chamber 1. Thus, it is possible by applying the voltage to each partition 3 like this to fill up the ink in the individual liquid chamber 1.

Furthermore, FIG. 6C shows the state of the displacement of the partition 3 and the deformation of the individual liquid chamber 1 at a time when the applied voltages are in a relation of VA<VB. In this case, each partition 3 is deformed to be doglegged toward the direction for reducing the cross-section area of the individual liquid chamber 1. Thus, it is possible by applying the voltage like this to each partition 3 to pressure the ink in the individual liquid chamber 1 and thus discharge the ink from the nozzle 30*a* (FIG. 1).

Figure 7A:
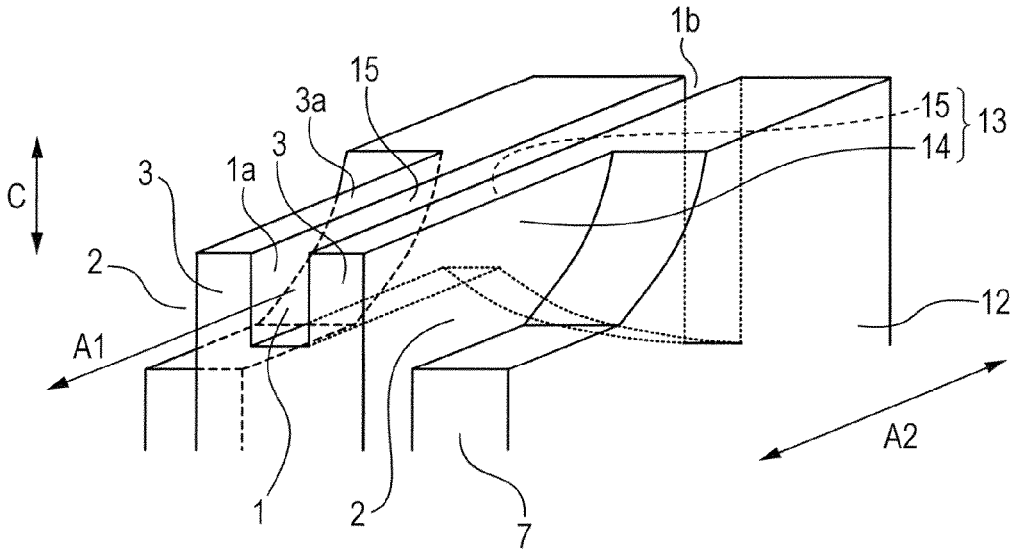
FIGS. 7A, 7B and 7C are schematic diagrams illustrating the discharge unit from which a first substrate has been omitted.
Figure 7B:
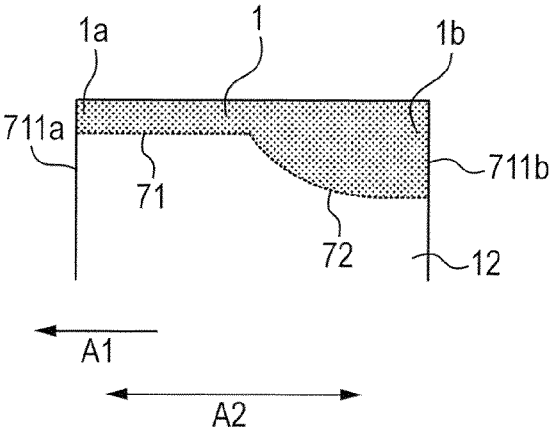
Figure 7C:
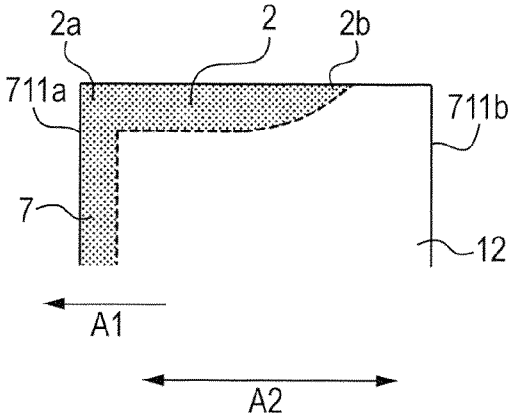

FIGS. 7A to 7C are schematic diagrams illustrating the discharge unit 10 from which the first substrate 11 has been omitted. More specifically, FIG. 7A is the perspective diagram illustrating the portion of the discharge unit 10 from which the first substrate 11 has been omitted, FIG. 7B is the cross-section diagram showing the cross section along the face parallel to the longitudinal direction A2 of the individual liquid chamber 1 of FIG. 7A, and FIG. 7C is the cross-section diagram showing the cross section along the face parallel to the longitudinal direction A2 of the dummy chamber 2 of FIG. 7A. Here, the height of each individual liquid chamber 1 becomes high as it approaches, from the first end 1*a* on the side of the nozzle, the second end 1*b* on the side of the common liquid chamber in the longitudinal direction A2. On the other hand, the height of the dummy chamber 2 becomes low as it approaches, from an end 2*a* on the side of the nozzle, an end 2*b* on the side of the common liquid chamber in the longitudinal direction A2, and the dummy chamber is not communicated with the common chamber 43 (FIGS. 2A to 2C).

Figure 8A:
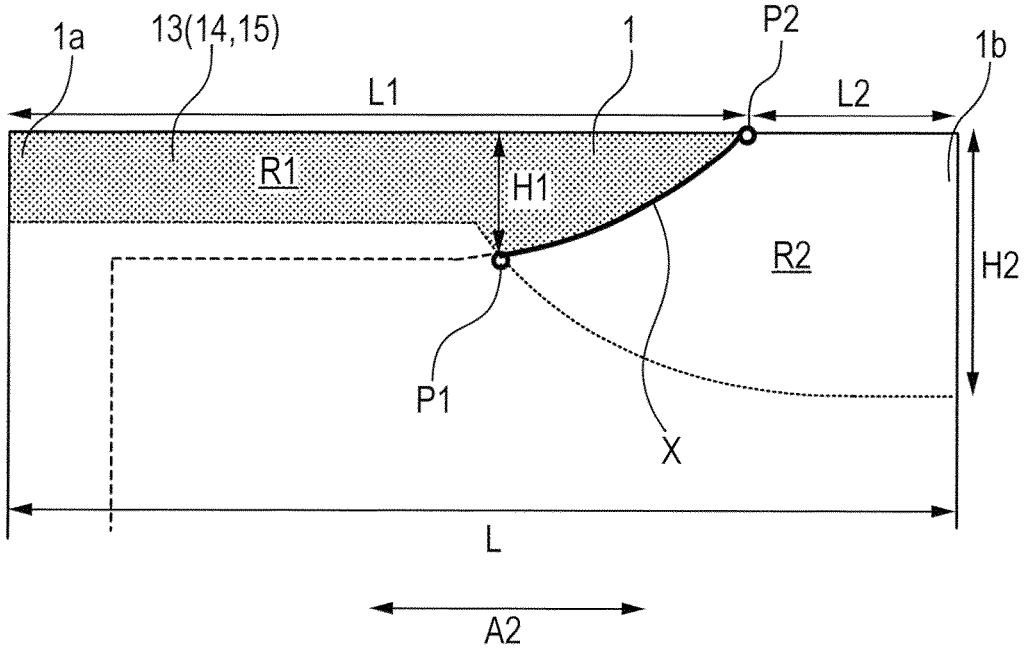
FIGS. 8A and 8B are schematic diagrams illustrating the individual liquid chamber.
Figure 8B:
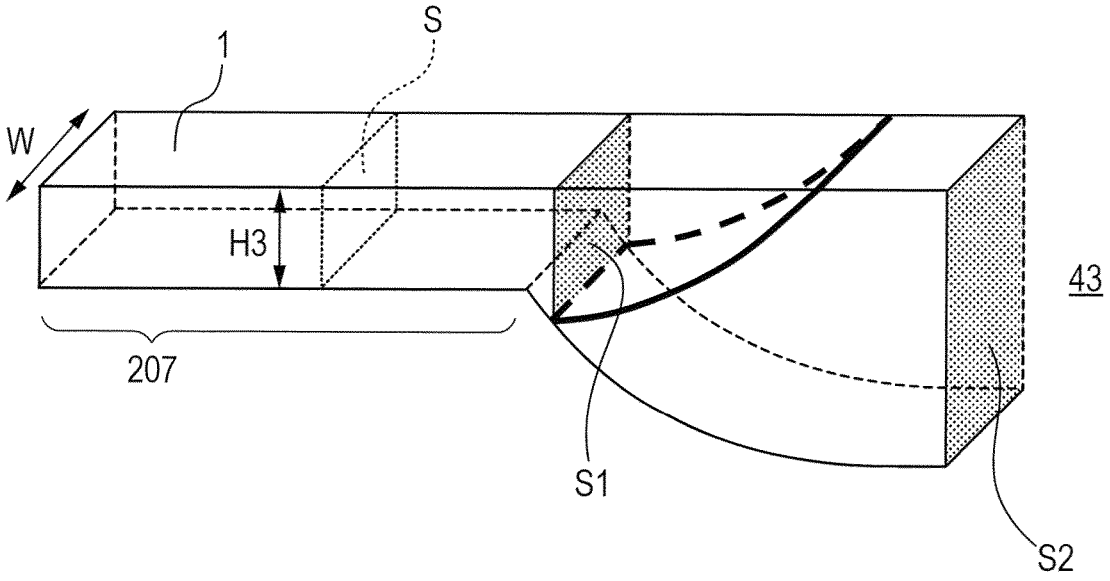

FIGS. 8A and 8B are schematic diagrams illustrating the individual liquid chamber. More specifically, FIG. 8A is the schematic diagram showing the state in which the individual liquid chamber 1 and the dummy chamber 2 are aligned and viewed from the width direction B, and FIG. 8B is the perspective diagram of the individual liquid chamber 1.

On each partition 3, each electrode pair 13 is arranged on both the side faces of each partition 3 so as to divide the partition into a movable region R1 which corresponds to the portion on the side of the nozzle and to which the electric field for shear-deforming the partition is applied and an immovable region R2 which corresponds to the portion on the side of the common liquid chamber and to which the electric field is not applied. Here, the electrodes constituting each electrode pair faces each other with the movable region R1 therebetween.

Incidentally, in the present embodiment, on both the side faces of the partition 3, a conductor is formed on the overall side face on the side of the individual liquid chamber 1 and the overall side face on the side of the dummy chamber 2. However, only the portions mutually overlapping each other in the width direction B constitute the electrodes 14 and 15.

Here, it is assumed that, when viewed from the width direction B, the individual liquid chamber has a first boundary point P1 closest to the first end 1*a* on a boundary X between the movable region R1 and the immovable region R2, and a second boundary point P2 closest to the second end 1*b* on the boundary X. Moreover, it is assumed that the individual liquid chamber 1 has a cross-section area S1 along the face perpendicular to the longitudinal direction A2 on the first boundary point P1 and a cross-section area S2 along the face perpendicular to the longitudinal direction A2 on the second end 1*b*.

Each individual liquid chamber 1 is formed such that the cross-section area S2 is wider than the cross-section area S1. In the present embodiment, the width of the individual liquid chamber 1 is formed to have a certain length from the first end 1*a* to the second end 1*b*. Therefore, in the present embodiment, a height H2 of each individual liquid chamber 1 at the second end 1*b* is higher than a height H1 of each individual liquid chamber 1 at the first end 1*a*.

More specifically, as illustrated in FIG. 8B, the individual liquid chamber 1 has an individual liquid chamber flat portion 207 having a certain height H3 (i.e., a certain cross-section area) from the first end 1*a* on the side of the nozzle to the midway in the longitudinal direction A2. Further, the length of the individual liquid chamber 1 from the first end 1*a* to the first boundary point P1 in the longitudinal direction A2 is longer than the length of the individual liquid chamber flat portion 207 in the longitudinal direction A2. The height H1 of each individual liquid chamber 1 at the first boundary point P1 is higher than the height H3 of the individual liquid chamber flat portion 207.

At this time, if it is assumed that, in the individual liquid chamber 1, the cross section has a cross-section area S along the face perpendicular to the longitudinal direction A2, the cross-section area S becomes large from the first boundary point P1 to the common liquid chamber 43 in the longitudinal direction A2, and the cross-section area S2 of the face being in contact with the common liquid chamber 43 is the maximum area as the cross-section area S.

In the present embodiment, each individual liquid chamber 1 is formed such that the cross-section area S of the cross section along the face perpendicular to the longitudinal direction A2 of each individual liquid chamber 1 becomes continuously wide as the relevant cross section approaches the second end 1*b* from the first boundary point P1. Incidentally, although the cross-section area S continuously changes in the present embodiment, it is possible to form the individual liquid chamber such that the cross-section area S becomes wide gradually.

In the present embodiment, a total length L of the individual liquid chamber 1 in the longitudinal direction A2 is the sum of a length L1 from the first end 1*a* to the second boundary point P2 and a length L2 from the second boundary point P2 to the second end 1*b*, and is within a range of 6 mm to 14 mm.

Besides, the width T of the partition 3 (FIG. 4) is within a range of 30 μm to 100 μm, and the width W of the individual liquid chamber 1 is within a range of 30 μm to 100 μm.

Further, the height H1 of the individual liquid chamber 1 at the first boundary point P1 is within a range of 100 μm to 400 μm, and the height H2 of the individual liquid chamber 1 at the face being in contact with the common liquid chamber 43 is within a range of 400 μm to 1500 μm.

The operation of the inkjet head 100 according to the present embodiment will be described hereinafter. FIGS. 2A to 2C are the schematic diagrams for describing the operation of the inkjet head 100 at a time when discharging the ink according to the first embodiment.

FIG. 2A is the cross-section diagram showing the inkjet head 100 which is in the ground state at a time when the driving voltages are in a relation of VA=VB (FIG. 6A). In the ground state, any flow of the ink is not generated in the individual liquid chamber 1.

FIG. 2B shows the state that the driving voltages are in a relation of VA>VB (FIG. 6B). In this state, in the movable region R1, the partition 3 is shear-deformed in the direction for enlarging the cross-section area of the individual liquid chamber 1. Thus, since the ink in the nozzle 30*a* flows toward the side of the individual liquid chamber 1, a meniscus 28 is drawn into the interior of the nozzle 30*a*, and at the same time the ink flows from the common liquid chamber 43 to the individual liquid chamber 1. Consequently, the ink pressure at the portion near the central part of the individual liquid chamber 1 in the longitudinal direction A increases. At this time, since the cross-section area S2 is wider than the cross-section area S1 and resistance in the ink flow path of the individual liquid chamber 1 is low, the ink is efficiently supplied to the portion corresponding to the movable region R1 of the individual liquid chamber 1.

FIG. 2C shows the state that the driving voltages are in a relation of VA<VB (FIG. 6C). In this case, in the movable region R1, the partition 3 is replaced in the direction for reducing the cross-section area of the individual liquid chamber 1. At this time, since the pressure generated in the ink of the individual liquid chamber 1 is maximum, flows of the ink are generated to the side of the nozzle 30*a* and the side of the common liquid chamber 43 in the longitudinal direction A2.

At this time, since the cross-section area S in the individual liquid chamber 1 becomes large from the boundary point P1 (FIG. 2A) to the common liquid chamber 43 in the longitudinal direction A2, it is possible to enlarge the flow of the ink toward the common liquid chamber 43. That is, since the resistance in the ink flow path at the portion corresponding to the immovable region R2 in the individual liquid chamber 1 is smaller than the resistance in the ink flow path at the portion corresponding to the movable region R1 in the individual liquid chamber 1, the ink easily flows to the side of the second end 1*b* at the time of compression of the individual liquid chamber 1. As a result, the flow of the ink toward the side of the nozzle 30*a* is reduced, and it is thus possible to reduce a percentage of a change of the discharge speed to the pressure applied to the ink in the individual liquid chamber 1, that is, it is possible to reduce a voltage sensitivity. Thus, controllability of the discharge speed of the droplet discharged from the nozzle 30*a* is improved.

Moreover, since the cross-section area S becomes continuously (or gradually) wide as it approaches the second end 1*b* from the first boundary point P1, the ink easily flows more effectively. Therefore, the controllability of the discharge speed of the droplet discharged from the nozzle 30*a* is further improved.

As just described, in order to reduce the voltage sensitivity, it is effective to control the flow of the ink toward the common liquid chamber 43 by reducing a percentage of the portion corresponding to the immovable region R2 to the portion corresponding to the movable region R1 in the individual liquid chamber 1.

On the other hand, in order to discharge the droplet from the nozzle 30*a* by lowering the voltage to be applied to the electrode pair 13, it is effective to increase the pressure applied to the ink by enlarging a displacement volume per unit voltage in the movable region R1.

In consideration of the above, it is suitable in the individual liquid chamber 1 to adjust a cross-section area ratio between the cross-section area of the portion corresponding to the movable region R1 and the cross-section area of the portion corresponding to the immovable region R2 and a ratio between the length of the portion corresponding to the movable region R1 and the length of the portion corresponding to the immovable region R2. Namely, it is possible, by adjusting these ratios, to discharge the droplet from the nozzle 30*a* with a desirable voltage sensitivity.

Figure 9A:
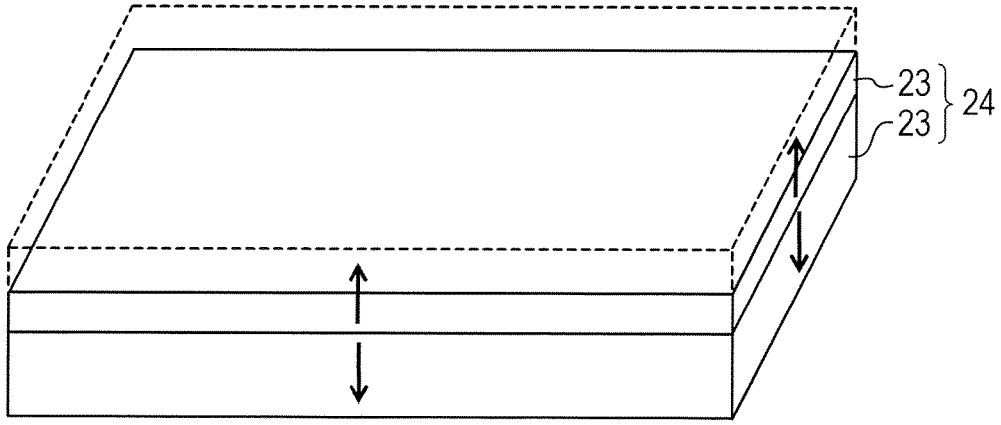
FIGS. 9A, 9B, 9C, 9D and 9E are diagrams for describing a manufacturing method of the inkjet head.

Next, a manufacturing method of the inkjet head 100 according to the present embodiment will be described. Initially, as illustrated in FIG. 9A, two piezoelectric plates 23 and 23 which have been polarized are inverted and then bonded to each other such that the polarized directions of these plates are mutually opposite to each other. After then, the bonded piezoelectric plates are processed to have desired dimensions through a grinding process or the like, thereby obtaining a piezoelectric substrate 24.

Figure 9B:
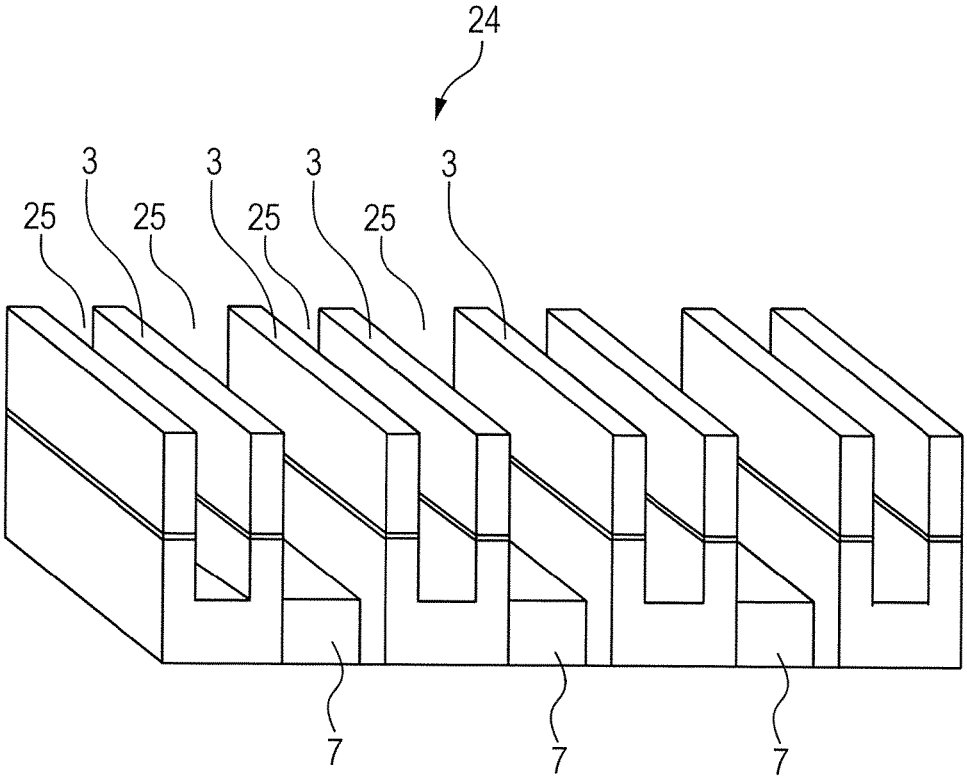

Subsequently, as illustrated in FIG. 9B, the plurality of partitions 3 constituted by the piezoelectric material (an actuator) are formed by processing partition grooves 25 on the piezoelectric substrate 24. Further, the front face grooves 7 are processed on the piezoelectric substrate 24. Here, to process these grooves, it is desirable to use a grinding process or the like using, e.g., a dicing blade, by which the temperature of the piezoelectric substrate 24 does not exceed the Curie temperature in the process. However, since the front face groove 7 is not the region which later serves as the actuator, it is possible for this groove to use, e.g., a laser process or the like which does not consider the Curie temperature of the piezoelectric substrate 24.

An example of how the partition grooves 25 are formed using the dicing blade will be described with reference to FIG. 7B. That is, with use of the dicing blade, each partition groove 25 is formed by processing the flat portion on the side of the nozzle, processing a curved face portion deeper than the flat portion on the side of the common liquid chamber, and then connecting the flat portion and the curved face portion to each other. Here, the thickness of the dicing blade is 40 μm to 80 μm, and the diameter of the dicing blade is about ϕ51 mm to ϕ102 mm in general. To process the piezoelectric material, diamond abrasive grains of about #1000 to #1600 are used. A resin bond is preferably used as an abrasive grain bond. Further, any problem does not occur if at least a device capable of using two-axis control is used as the dicing device. Furthermore, the rotation speed of the dicing blade is about 2000 rpm to 30000 rpm. To reduce a stress to the process member at the time when the processing is performed by the dicing blade, the stage transport speed is set to 0.1 mm/s to 0.5 mm/s. As the depth of the individual liquid chamber 1, the depth of the first end 1*a* on the side of the nozzle may be shallow. The blade is cut into the substrate from a front face 711*a* on the side of the nozzle and moved toward a back face 711*b* on the side of the common liquid chamber, thereby processing a flat portion 71. Alternately, the blade is moved from the back face 711*b* on the side of the common liquid chamber to the front face 711*a* on the side of the nozzle until the blade goes through the front face 711*a*, thereby processing the flat portion 71. Thus, the step of processing the flat portion is performed. Moreover, the blade is cut into the substrate from the back face 711*b* with a cutting amount deeper than the cutting amount of the flat portion 71, and then moved to the flat portion 71, thereby processing a curved face portion 72. Alternately, the blade is cut into the substrate and moved from the flat portion 71 to the back face 711*b* with a cutting amount deeper than the cutting amount of the flat portion 71 until the blade goes through the back face, thereby processing the curved face portion 72. Thus, the step of processing the curved face portion is performed. Namely, the flat portion 71 and the curved face portion 72 deeper than the flat portion 71 are connected to each other by the step of processing the flat portion 71 and the step of processing the curved face portion 72. Thus, it is possible to form the continuous partition grooves, thereby forming the individual liquid chamber 1. Incidentally, it is possible to continuously perform the step of processing the flat portion 71 and the step of processing the curved face portion 72.

Subsequently, the process of the front face groove 7 will be described with reference to FIG. 7C. Here, the thickness of the dicing blade is 60 μm to 150 μm, and the diameter of the dicing blade is about ϕ51 mm to ϕ102 mm in general. To process the piezoelectric material, the diamond abrasive grains of about #1000 to #1600 are used. The resin bond is preferably used as the abrasive grain bond. Further, any problem does not occur if at least the device capable of using the two-axis control is used as the dicing device. Furthermore, the rotation speed of the dicing blade is about 2000 rpm to 30000 rpm. To reduce the stress to the process member at the time when the processing is performed by the dicing blade, the stage transport speed is set to 0.1 mm/s to 0.5 mm/s.

The front face groove 7 is processed at the center between the two individual liquid chambers 1 as illustrated in FIG. 7A. The depth of the dummy chamber 2 in the height direction C is made shallow at the end 2*b* on the ink supply side, and the groove is discontinued on the way at the end 2*b* on the ink supply side so as to be not communicated with the common liquid chamber 43. This is because it is necessary to prevent that the ink flows into the dummy chamber 2. The end 2*a* on the side of the nozzle has a certain depth, and the process depth of the dummy chamber 2 is set to be equal to or within +15% of the depth of the individual liquid chamber 1. It is possible, by processing the dummy chamber 2 between the individual liquid chambers 1, to form the partitions 3 on both the sides of the individual liquid chamber 1. Incidentally, the partition 3 serves as the piezoelectric element which deforms, and the partition 3 is constituted by the oppositely polarized piezoelectric materials. The blade is cut into the substrate from the front face 711*a* with the constant cutting depth, and the process of the groove is terminated before the blade goes through the back face 711*b*, thereby forming the dummy chamber 2.

Figure 9C:
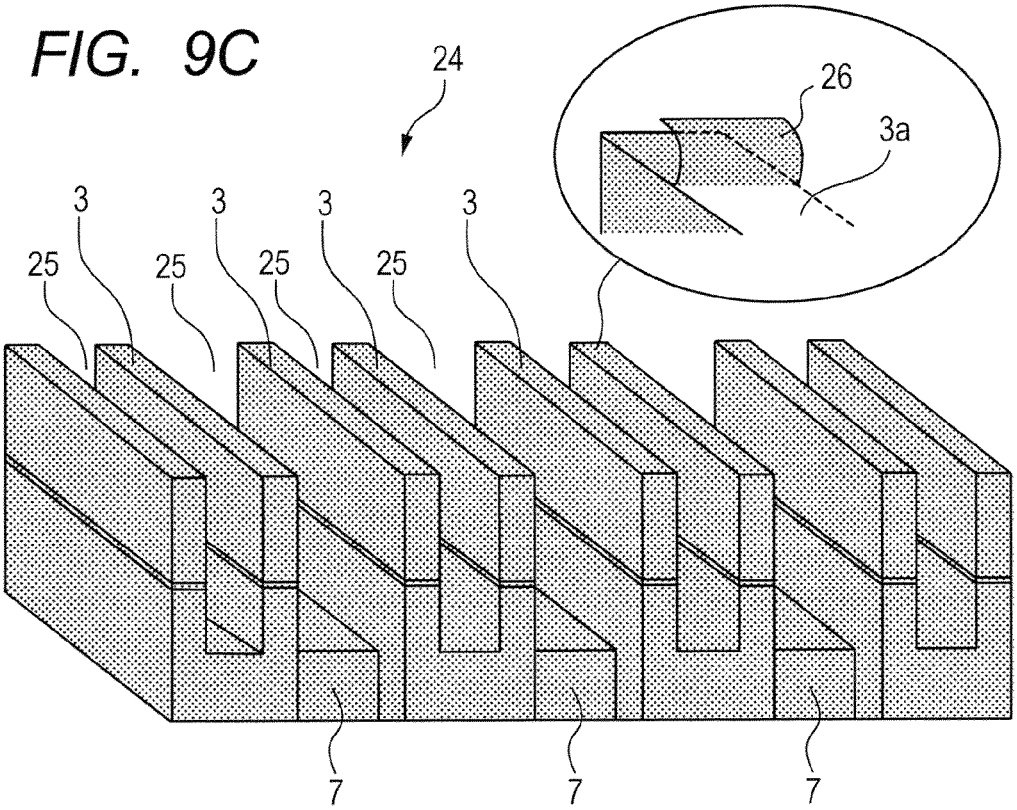

Next, as illustrated in FIG. 9C, a conductive layer 26 is applied to the whole surface of the piezoelectric substrate 24 on which the partition grooves 25 have been processed and which includes the interiors of the partition grooves 25. Here, it should be noted that the conductive layer can be easily applied by electroless plating or the like.

Figure 9D:
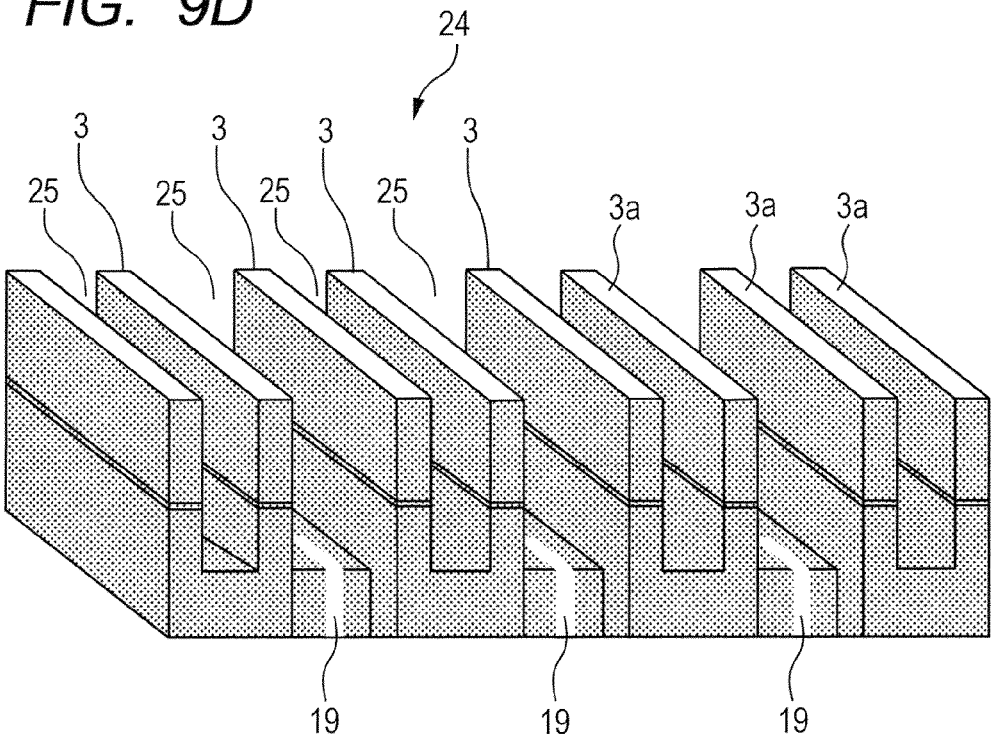

Subsequently, as illustrated in FIG. 9D, the conductive layer 26 on the upper face (the tip) 3*a* of each partition 3 is selectively eliminated by grinding or the like. Further, the groove 19 is processed to divide the conductive layer 26 in each partition groove 25. Incidentally, the groove 19 may be formed here by a laser process or a cutting process using a diamond blade.

Figure 9E:
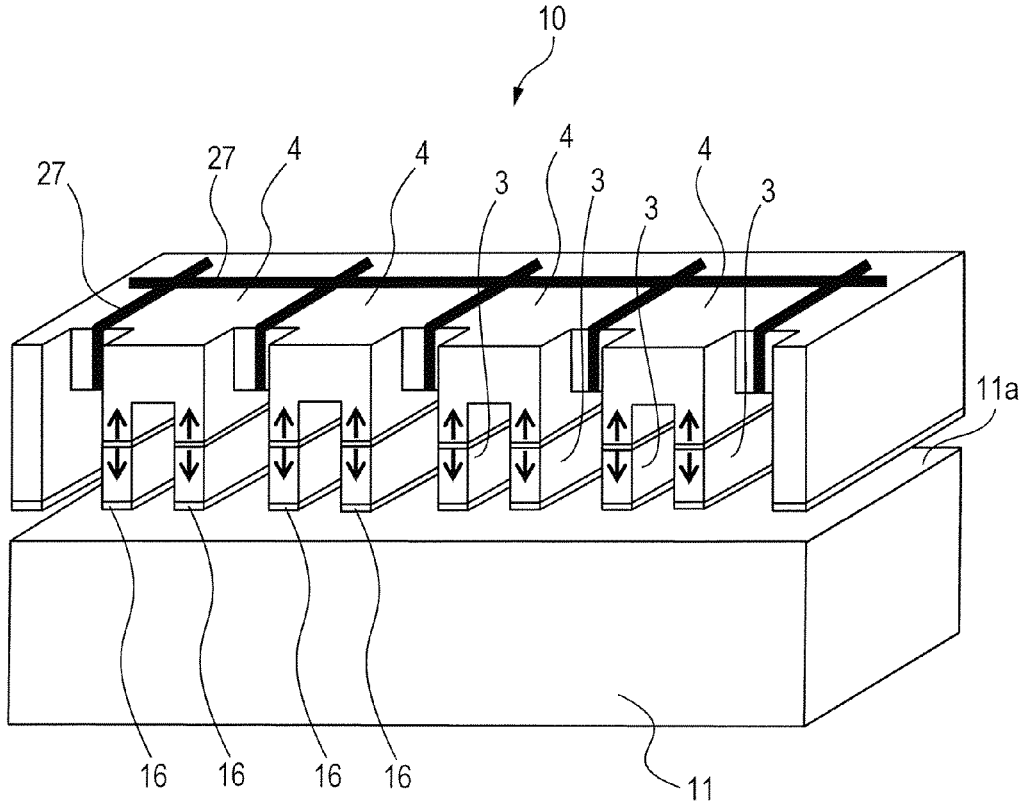

Next, as illustrated in FIG. 9E, the adhesive 16 is applied to the tips 3*a* of the partitions 3, and then they are bonded to the one face 11*a* of the first substrate 11, thereby obtaining the discharge unit 10.

As the method of applying the adhesive 16, it is possible to directly apply the adhesive to the tips 3*a* of the partitions 3 using a method such as a screen printing method or a bar coater method capable of adjusting the thickness of the adhesive. Alternately, it is possible to once apply the adhesive to a film or a glass substrate and then transfer the applied adhesive to the tips. Incidentally, for example, an epoxy adhesive, a phenolic adhesive or a polyimide adhesive can be used as the adhesive 16.

After then, the front face of the discharge unit 10 is grinded and polished to eliminate the conductive layer 26 and have desired dimensions and shapes. Further, an extraction electrode dividing groove 27 is formed on the upper face of the discharge unit 10, thereby obtaining the individual electrodes 4 respectively divided electrically.

By a series of the above processes, the discharge unit 10 is formed, and then the nozzle plate 30, the manifold 40, the flexible substrate 50 and the like are attached as illustrated in FIG. 1, thereby obtaining the inkjet head 100 according to the present embodiment.

Second Embodiment

Figure 10A:
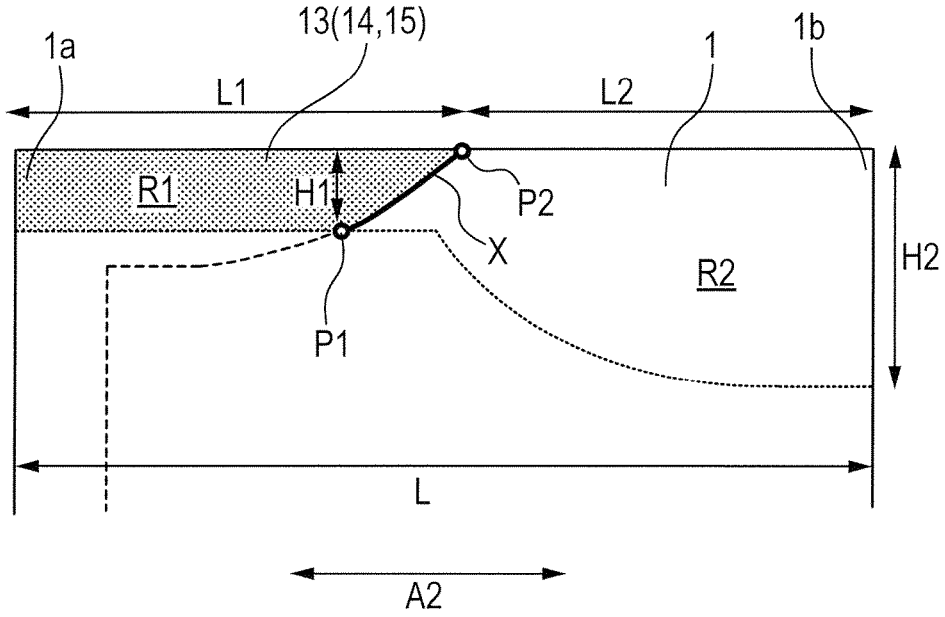
FIGS. 10A and 10B are schematic diagrams illustrating an individual liquid chamber according to a second embodiment of the present invention.
Figure 10B:
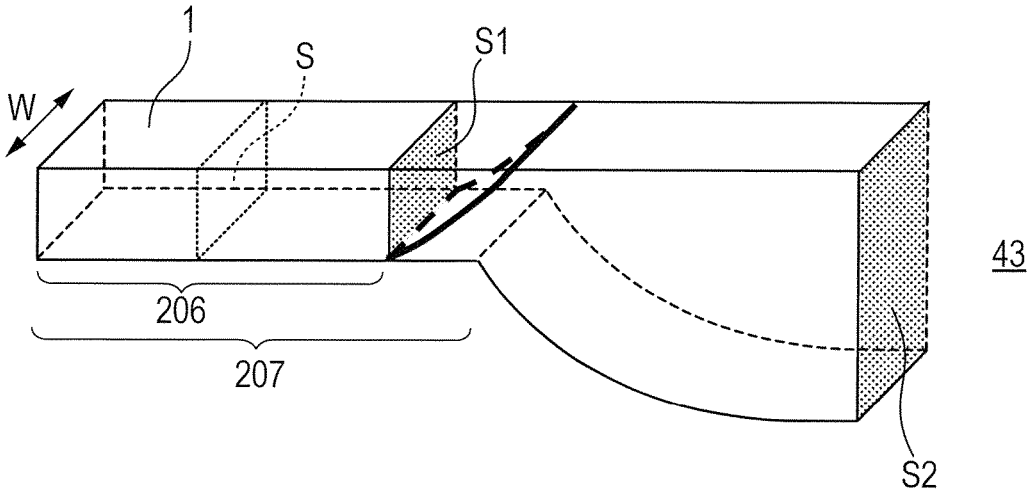

Subsequently, a liquid discharge apparatus according to the second embodiment will be described. Also, in the present embodiment, the liquid discharge apparatus corresponds to an inkjet head. FIGS. 10A and 10B are schematic diagrams illustrating an individual liquid chamber according to the second embodiment of the present invention. More specifically, FIG. 10A is the schematic diagram showing the state in which the individual liquid chamber and a dummy chamber are aligned and viewed from the width direction, and FIG. 10B is the perspective diagram of the individual liquid chamber.

As well as the first embodiment, in the partition 3 which constitutes an individual liquid chamber 1, since the portion sandwiched by an electrode pair 13 is shear-deformed, this portion is a movable region R1 and the portion other than the movable region R1 is an immovable region R2, as illustrated in FIG. 10A. Moreover, as well as the first embodiment, on the boundary between the movable region R1 and the immovable region R2, the end point on the side of the nozzle in a longitudinal direction A2 is a first boundary point P1, and the end point on the side of the common liquid chamber in the longitudinal direction A2 is a second boundary point P2.

As illustrated in FIG. 10B, if it is assumed that the cross section of the individual liquid chamber 1 has a cross-section area S along the face perpendicular to the longitudinal direction A2, the cross-section area S becomes large from the first boundary point P1 to a second end 1*b* on the side of the common liquid chamber in the longitudinal direction A2, and a cross-section area S2 of the individual liquid chamber 1 at the face being in contact with the common liquid chamber is the maximum area as the cross-section area S.

Moreover, in the individual liquid chamber 1, the cross-section area S corresponds to a certain flat portion from a first end 1*a* on the side of the nozzle to the midway toward the second end 1*b* on the side of the common liquid chamber in the longitudinal direction A2, the portion sandwiched by the movable regions R1 is a movable region flat portion 206, and the entire flat portion is an individual liquid chamber flat portion 207. In the longitudinal direction A2, the length of the individual liquid chamber flat portion 207 is longer than the length of the movable region flat portion 206.

In the individual liquid chamber 1, when a cross-section area S1 and the cross-section area S2 are compared with each other, the cross-section area S2 is wider than the cross-section area S1. More specifically, a width W of the individual liquid chamber 1 is constant, and a height H2 of the individual liquid chamber 1 is higher than a height H1.

Further, the cross-section area S of the individual liquid chamber 1 is constant from the first boundary point P1 to the midway toward the second end 1*b*, and then becomes continuously wide as it approaches the second end 1*b* from the midway.

As well as the first embodiment, also by the above constitution, since the cross-section area S in the individual liquid chamber 1 becomes large from the boundary point P1 to a common liquid chamber 43 in the longitudinal direction A2, it is possible to enlarge the flow of the ink toward the common liquid chamber 43. That is, since the resistance in the ink flow path at the portion corresponding to the immovable region R2 in the individual liquid chamber 1 is smaller than the resistance in the ink flow path at the portion corresponding to the movable region R1 in the individual liquid chamber 1, the ink easily flows to the side of the second end 1*b* at the time of compression of the individual liquid chamber 1. As a result, the flow of the ink toward the side of the nozzle 30*a* is reduced at the time of the discharge of a droplet, and it is thus possible to reduce a percentage of a change of the discharge speed to the pressure applied to the ink in the individual liquid chamber 1, that is, it is possible to reduce a voltage sensitivity. Thus, controllability of the discharge speed of the droplet discharged from the nozzle 30*a* is improved.

Third Embodiment

Figure 11A:
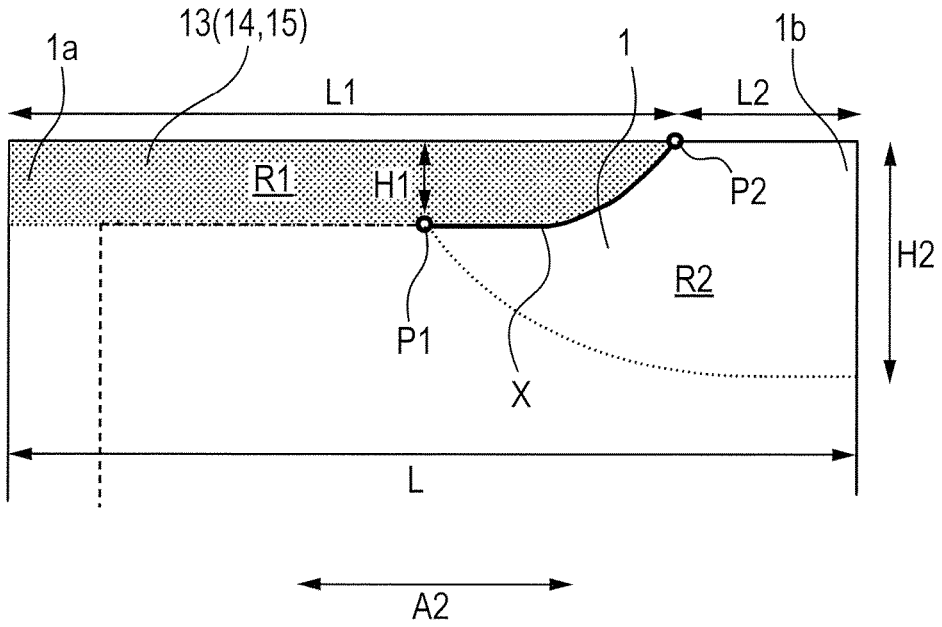
FIGS. 11A and 11B are schematic diagrams illustrating an individual liquid chamber according to a third embodiment of the present invention.
Figure 11B:
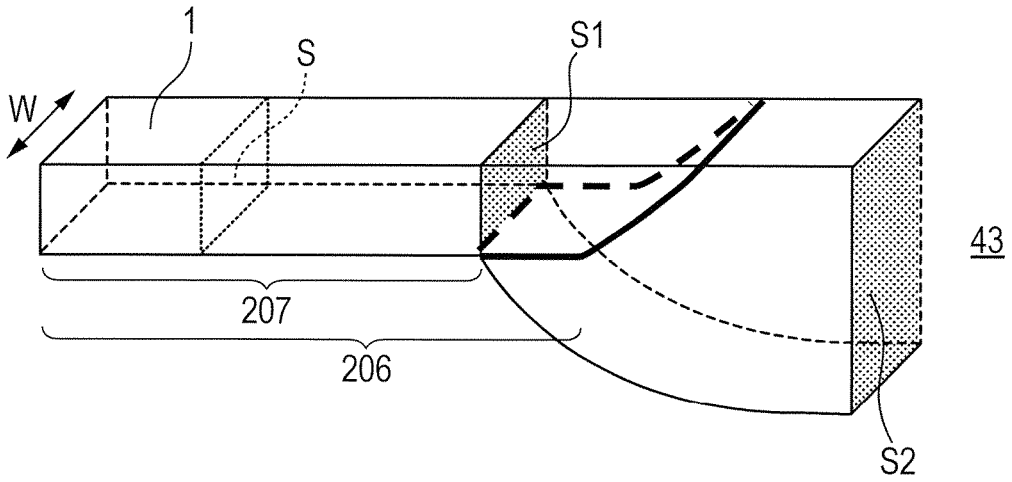

Subsequently, a liquid discharge apparatus according to the third embodiment will be described. Also, in the present embodiment, the liquid discharge apparatus corresponds to an inkjet head. FIGS. 11A and 11B are schematic diagrams illustrating an individual liquid chamber according to the third embodiment of the present invention. More specifically, FIG. 11A is the schematic diagram showing the state in which the individual liquid chamber and a dummy chamber are aligned and viewed from the width direction, and FIG. 11B is the perspective diagram of the individual liquid chamber.

In the third embodiment, a movable region R1 of the partition 3 stretches up to the portion corresponding to the region in which the height of an individual liquid chamber 1 is heightened toward the common liquid chamber in a longitudinal direction A2. More specifically, as illustrated in FIG. 11B, the length of a movable region flat portion 206 is longer than the length of an individual liquid chamber flat portion 207 in the individual liquid chamber 1.

At this time, a cross-section area S of the individual liquid chamber 1 becomes large from a first boundary point P1 toward the common liquid chamber in the longitudinal direction A2, and a cross-section area S2 of the individual liquid chamber 1 at the face being in contact with the common liquid chamber is the maximum area as the cross-section area S.

As well as the first embodiment, also by the above constitution, since the cross-section area S in the individual liquid chamber 1 becomes large from the boundary point P1 to a common liquid chamber 43 in the longitudinal direction A2, it is possible to enlarge the flow of the ink toward the common liquid chamber 43. That is, since the resistance in the ink flow path at the portion corresponding to an immovable region R2 in the individual liquid chamber 1 is smaller than the resistance in the ink flow path at the portion corresponding to the movable region R1 in the individual liquid chamber 1, the ink easily flows to the side of a second end 1*b* at the time of compression of the individual liquid chamber 1. As a result, the flow of the ink toward the side of the nozzle 30*a* is reduced at the time of the discharge of a droplet, and it is thus possible to reduce a percentage of a change of the discharge speed to the pressure applied to the ink in the individual liquid chamber 1, that is, it is possible to reduce a voltage sensitivity. Thus, controllability of the discharge speed of the droplet discharged from the nozzle 30*a* is improved.

Fourth Embodiment

Figure 12A:
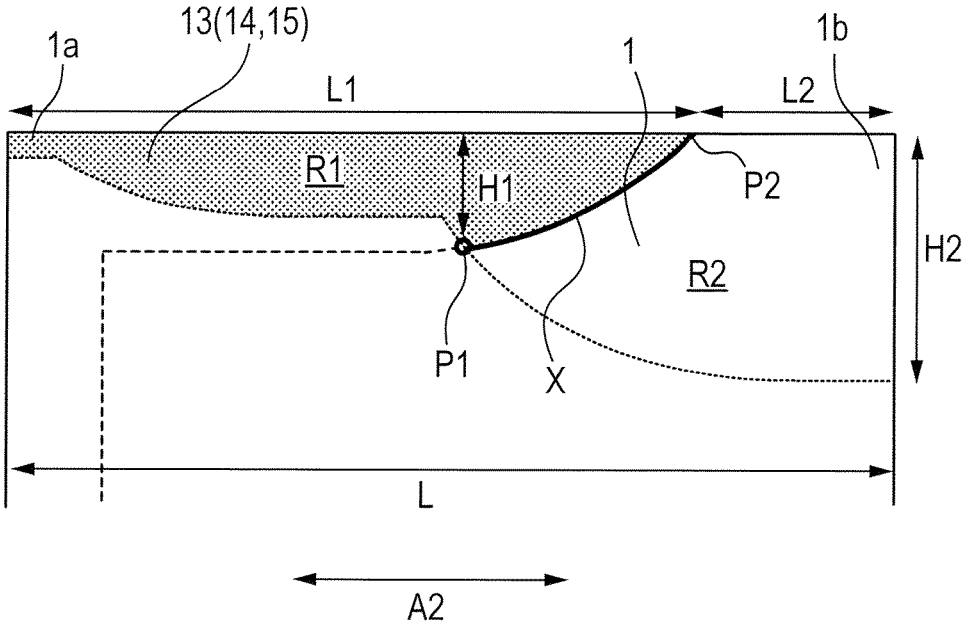
FIGS. 12A and 12B are schematic diagrams illustrating an individual liquid chamber according to a fourth embodiment of the present invention.
Figure 12B:
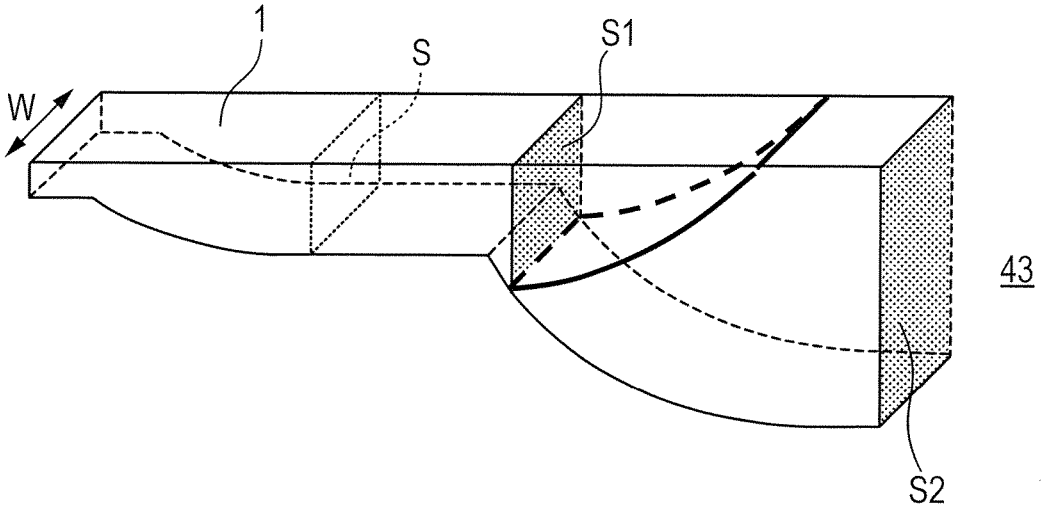

Subsequently, a liquid discharge apparatus according to the fourth embodiment will be described. Also, in the present embodiment, the liquid discharge apparatus corresponds to an inkjet head. FIGS. 12A and 12B are schematic diagrams illustrating an individual liquid chamber according to the fourth embodiment of the present invention. More specifically, FIG. 12A is the schematic diagram showing the state in which the individual liquid chamber and a dummy chamber are aligned and viewed from the width direction, and FIG. 12B is the perspective diagram of the individual liquid chamber.

In the fourth embodiment, the height of an individual liquid chamber 1 is heightened gradually from a first end 1*a* on the side of the nozzle toward a first boundary point P1 in a longitudinal direction A2. Moreover, as illustrated in FIG. 12B, a cross-section area S of the individual liquid chamber 1 becomes large from the first boundary point P1 toward the common liquid chamber in the longitudinal direction A2, and a cross-section area S2 of the individual liquid chamber 1 at the face being in contact with the common liquid chamber is the maximum area as the cross-section area S.

As well as the first embodiment, also by the above constitution, since the cross-section area S in the individual liquid chamber 1 becomes large from the boundary point P1 to a common liquid chamber 43 in the longitudinal direction A2, it is possible to enlarge the flow of the ink toward the common liquid chamber 43. That is, since the resistance in the ink flow path at the portion corresponding to an immovable region R2 in the individual liquid chamber 1 is smaller than the resistance in the ink flow path at the portion corresponding to the movable region R1 in the individual liquid chamber 1, the ink easily flows to the side of a second end 1*b* at the time of compression of the individual liquid chamber 1. As a result, the flow of the ink toward the side of the nozzle 30*a* is reduced at the time of the discharge of a droplet, and it is thus possible to reduce a percentage of a change of the discharge speed to the pressure applied to the ink in the individual liquid chamber 1, that is, it is possible to reduce a voltage sensitivity. Thus, controllability of the discharge speed of the droplet discharged from the nozzle 30*a* is improved.

Fifth Embodiment

In a liquid discharge head to be used for industrial purposes, as well as stable liquid discharge, high-definition liquid discharge is needed. Particularly, in the liquid discharge head of the shear mode method, in a case where the nozzle diameter is set to, e.g., ϕ15 μm or less, minute droplets are separated at high speed before main droplets are discharged if the droplet speed is set to a certain speed or more. In the case where the minute droplet is formed before the main droplet and the droplet speed is high, since the minute droplet reaches a target substrate before the main droplet reaches the target substrate, there is a problem that drawn dots are distorted. In addition, since the droplet separated before the main droplet is extremely minute in size, an influence of deceleration by air resistance is high for the separated minute droplet. Thus, there is a high possibility that the minute droplet is floated due to disturbance before it reaches the target substrate, and thus the minute droplet reaches an unintended location. According to the present embodiment, it is possible to solve such a further problem that high-definition drawing cannot be performed if the minute droplets are formed before the main droplets.

In the present embodiment, the constitutions same as those described in the first embodiment are added with the same corresponding numerals and symbols respectively and descriptions of these constitutions will be omitted.

Figure 13A:
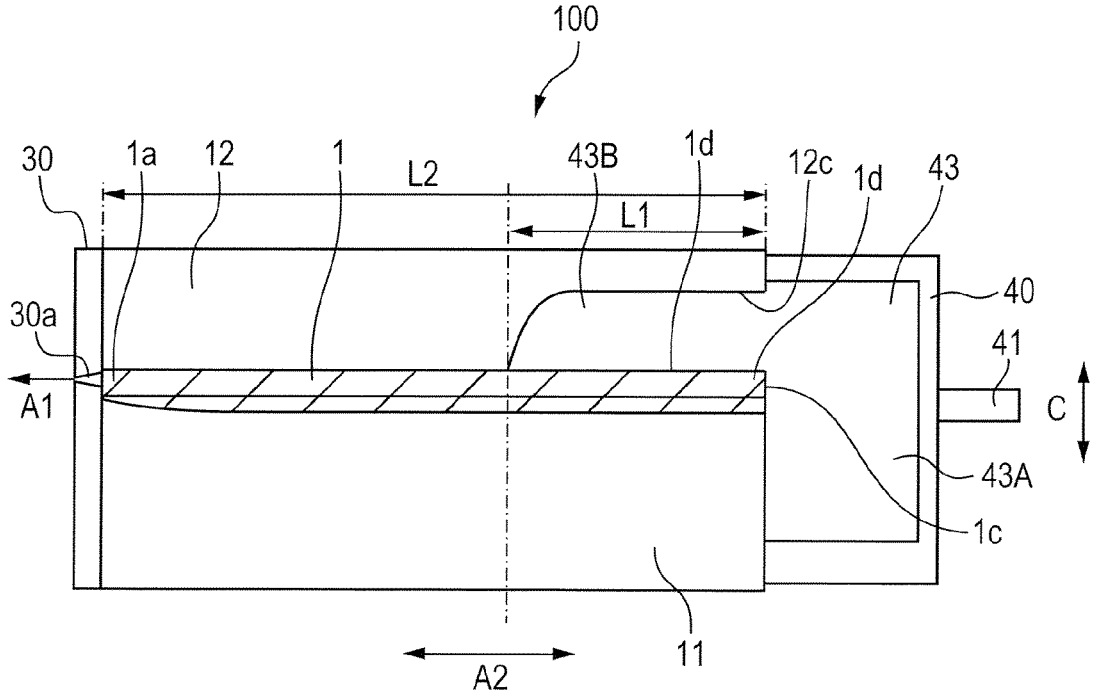
FIGS. 13A and 13B are schematic diagrams illustrating an individual liquid chamber according to a fifth embodiment of the present invention.
Figure 13B:
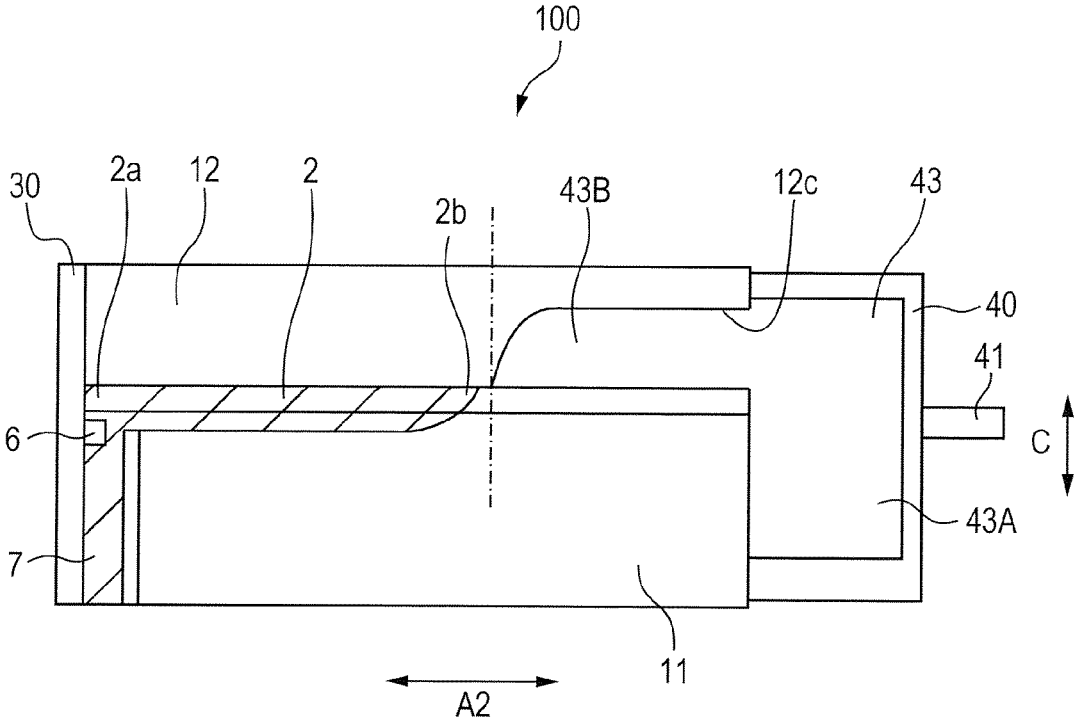

FIGS. 13A and 13B are cross-section diagrams along a face parallel to a longitudinal direction A2 of an inkjet head 100. More specifically, FIG. 13A is the cross-section diagram illustrating an individual liquid chamber 1, and FIG. 13B is the cross-section diagram illustrating a dummy chamber 2.

As illustrated in FIG. 13A, a nozzle plate 30 is arranged on the side of a first end 1*a* in the longitudinal direction A2 being the liquid discharge side of the individual liquid chamber 1. On the other hand, a manifold 40 is arranged on the side of a second end 1*b* in the longitudinal direction A2 opposite to the first end 1*a* and being the liquid supply side of the individual liquid chamber 1. Thus, a common liquid chamber 43 which is surrounded by substrates 11 and 12 and the manifold 40 is formed.

The common liquid chamber 43 is connected to each individual liquid chamber 1. An ink is supplied from a not-illustrated ink tank to the common liquid chamber 43 through an ink supply port 41. The ink supplied to the common liquid chamber 43 is filled in each individual liquid chamber 1. Then, when an electric field is applied by an electrode pair 13 in the direction orthogonal to a polarization direction, a partition 3 is shear-deformed, and thus the volume of the individual liquid chamber 1 is changed. Thus, the ink (i.e., an ink droplet) which is the liquid (a liquid droplet) is discharged from a nozzle 30*a*.

Figure 14A:
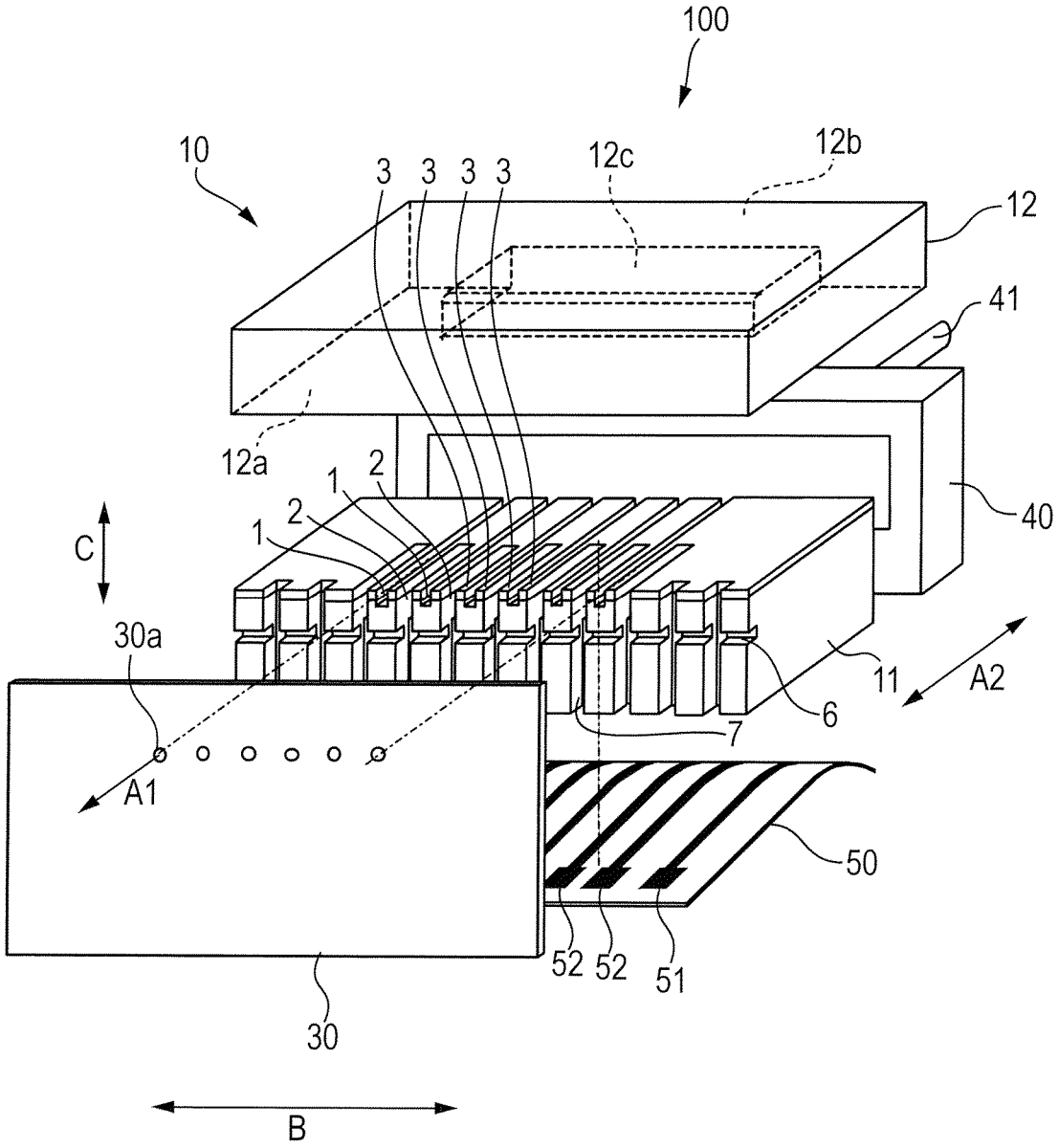
FIGS. 14A and 14B are exploded schematic diagrams illustrating an inkjet head as an example of a liquid discharge head serving as a liquid discharge apparatus according to the fifth embodiment of the present invention.
Figure 14B:
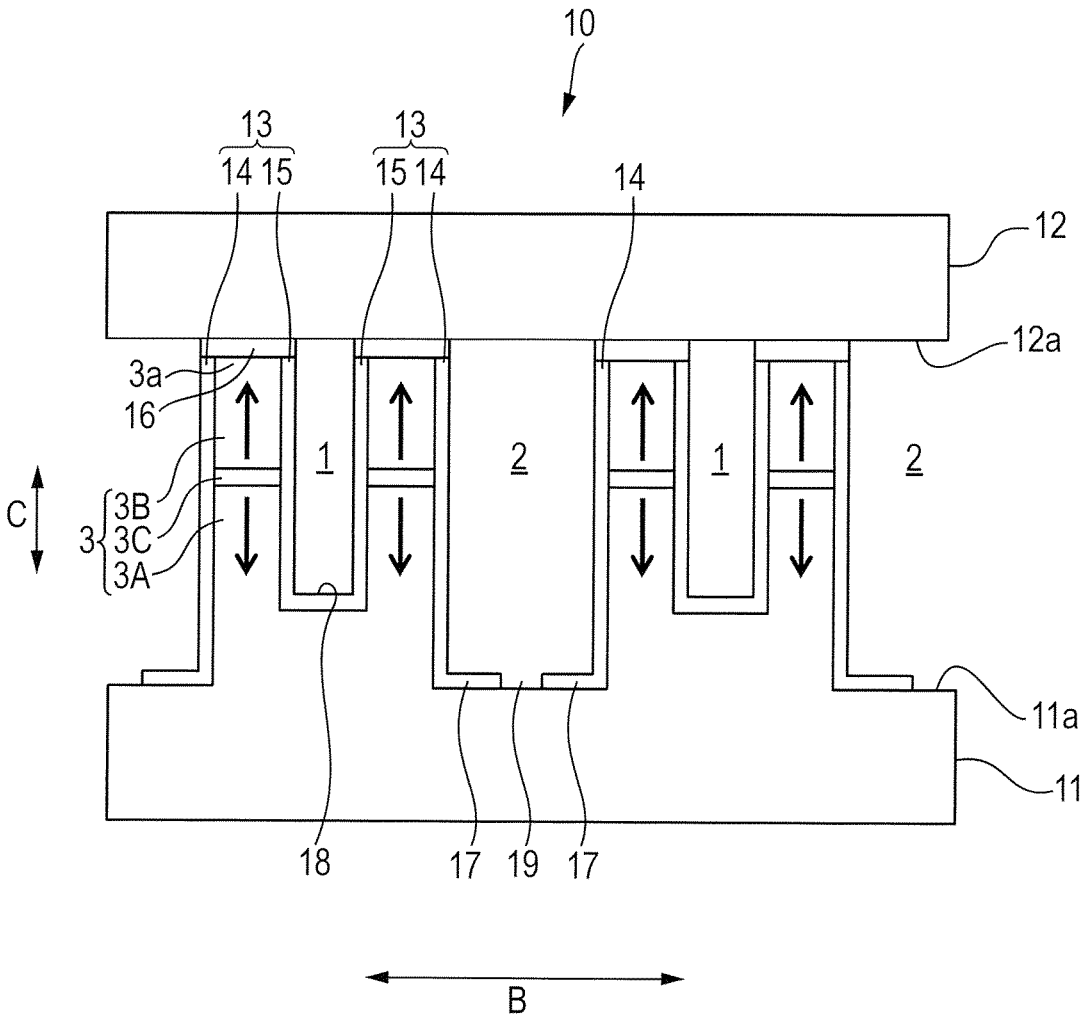

In the present embodiment, as illustrated in FIGS. 14A and 14B, the plurality of partitions 3 are formed mutually with space in a width direction B so as to protrude from one face 11*a* of the first substrate 11. That is, on the one face 11*a*, the plurality of partitions 3 are protrusively provided with space in the direction B. Further, a tip 3*a* of each partition 3 and one face 12*a* of the second substrate 12 are bonded to each other by an adhesive (bond) 16, and the individual liquid chamber 1 and the dummy chamber 2 are partitioned by the partition 3 and they are alternately formed in the width direction B. That is, the dummy chamber 2 partitioned by each partition 3 is formed between the adjacent two individual liquid chambers 1 and 1 among the plurality of individual liquid chambers 1. The dummy chamber 2 is the air chamber which is not connected to the common liquid chamber 43.

As indicated by the arrows illustrated in FIG. 14B, each partition 3, which protrudes from the one face 11*a* of the first substrate 11, has a chevron structure in which a base-side piezoelectric material 3A polarized in parallel with a height direction C and a tip-side piezoelectric material 3B polarized in the opposite direction are bonded to each other by an adhesive 3C.

In the present embodiment, the diameter of the nozzle 30*a* is within a range of 5 μm to 15 μm. That is, the diameter of the nozzle 30*a* is made small to have a minute amount (e.g., 1 pl to 3 pl) of the droplet to be discharged from the nozzle 30*a*.

Figure 15A:
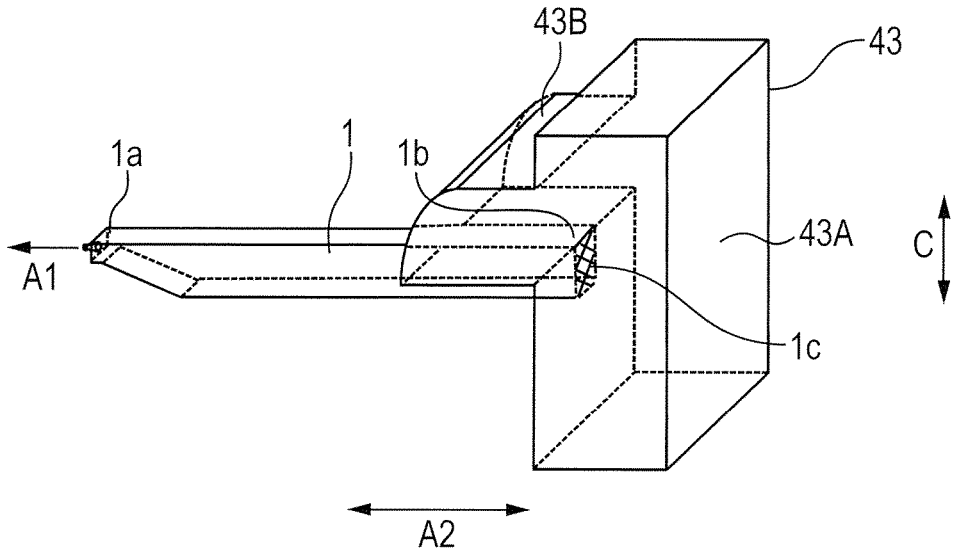
FIGS. 15A and 15B are perspective diagrams illustrating the individual liquid chamber and a common liquid chamber according to the fifth embodiment of the present invention.
Figure 15B:
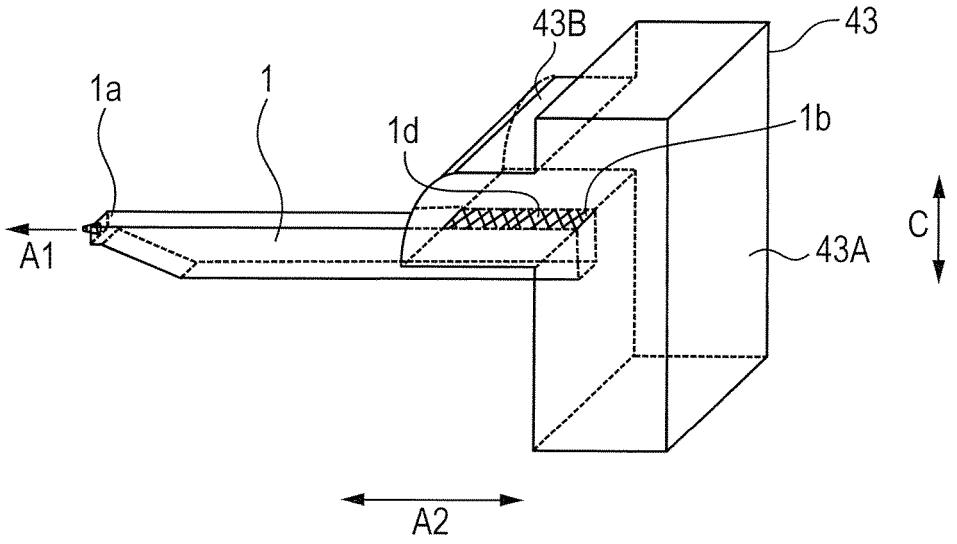

FIGS. 15A and 15B are perspective diagrams illustrating the individual liquid chamber 1 and the common liquid chamber 43. More specifically, FIG. 15A is the perspective diagram illustrating a first opening, and FIG. 15B is the perspective diagram illustrating the individual liquid chamber 1 and the common liquid chamber 43 for describing a second opening.

Each individual liquid chamber 1 is connected to the common liquid chamber 43 through a first opening 1*c* opening at the second end 1*b* toward the longitudinal direction A2 and a second opening 1*d* opening toward the height direction C. That is, the first opening 1*c* faces the face perpendicular to the longitudinal direction A2, and the second opening 1*d* faces the face perpendicular to the height direction C.

As just described, the individual liquid chamber 1 is in contact with the common liquid chamber 43 with the two faces. The second opening 1*d* is arranged on the side of the second end 1*b*, and extends from the second end 1*b* to the first end 1*a* on the side of the nozzle along the longitudinal direction A2. The opening directions of the first opening 1*c* and the second opening 1*d* are orthogonal to each other.

A counterbore portion (or a concave portion) 12*c* is formed in the second substrate 12. The common liquid chamber 43 is constituted by a liquid chamber portion 43A which is the space formed by the manifold 40, and a liquid chamber portion 43B which is communicated with the liquid chamber portion 43A and is the space formed by the counterbore portion (or the concave portion) 12*c* in the second substrate 12. As illustrated in FIG. 14A, the counterbore portion 12*c* is the concave portion which is formed across an end face 12*b* of the second substrate 12 on the side of the common liquid chamber in the longitudinal direction A2 and the one face 12*a* of the second substrate 12. That is, as illustrated in FIGS. 13A and 13B, the liquid chamber portion 43B is formed by the counterbore portion 12*c* so as to extend from the liquid chamber portion 43A to the side of the nozzle along the longitudinal direction A2. The individual liquid chamber 1 is connected to the liquid chamber portion 43A through the first opening 1*c*, and is also connected to the liquid chamber portion 43B through the second opening 1*d*.

The counterbore portion 12*c* is formed by drilling so as to have the depth of 0.2 mm to 1 mm. Further, a length L1 of the counterbore portion 12*c* in the longitudinal direction A2 is 0.2 to 0.7 times of a total length L2 of the individual liquid chamber 1 in the longitudinal direction A2.

Moreover, the dummy chamber 2 is formed so as not to overlap the second opening 1*d* in the width direction B. That is, the length of the dummy chamber 2 in the longitudinal direction A2 is set such that the dummy chamber 2 and the second opening 1*d* do not overlap in the width direction B. In other words, the dummy chamber 2 is formed to be shorter than the individual liquid chamber 1 in the longitudinal direction A2 such that the dummy chamber 2 and the liquid chamber portion 43B of the common liquid chamber 43 are not in contact with each other. Thus, the dummy chamber 2 and the common liquid chamber 43 are not communicated with each other.

In the present embodiment, since the ink is introduced from the two directions in the individual liquid chamber 1, the flow of the ink is disturbed in the individual liquid chamber 1. Thus, in addition to the flow of the ink to the nozzle 30*a* in a liquid discharge direction A1, a flow is locally generated in the direction orthogonal to the liquid discharge direction A1. By such an action, the flow speed for concentrating the flow near the liquid inlet of the nozzle 30*a* on the central portion of the nozzle 30*a* is relieved. As a result, since the phenomenon that the minute droplets are separated from the main droplets can be restrained, it is possible to stably discharge the droplets.

Incidentally, since the first opening 1*c* and the second opening 1*d* are formed to be in contact with each other, the one large opening in which the first opening 1*c* and the second opening 1*d* are communicated with each other is formed. Consequently, since the resistance in the ink flow path in the individual liquid chamber 1 is reduced, the ink easily flows from each of the openings 1*c* and 1*d* into the individual liquid chamber 1. Thus, it is possible to more effectively relieve that the flow speed of the ink is concentrated on the central portion of the nozzle 30*a*. Therefore, it is possible to more effectively restrain the phenomenon that the minute droplets are separated from the main droplets.

Moreover, the first opening 1*c* coincides with the cross section along the face perpendicular to the longitudinal direction A2 at the second end 1*b* of the individual liquid chamber 1, that is, the end face at the second end 1*b* of the individual liquid chamber 1. That is, since the opening area on the rear side of the individual liquid chamber 1 is maximum, any choked portion is not formed. For this reason, since the threshold of the main droplet speed at which the minute droplet is generated further increases, it is possible to more effectively restrain the phenomenon that the minute droplets are separated from the main droplets.

Figure 16A:
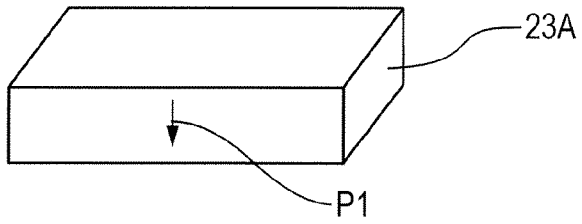
FIGS. 16A, 16B, 16C and 16D are diagrams for describing a manufacturing method of the inkjet head according to the fifth embodiment of the present invention.

Subsequently, a manufacturing method of the inkjet head 100 will be described. Initially, a manufacturing method of the piezoelectric substrate 24 will be described with reference to FIGS. 16A to 16D. Here, a piezoelectric plate 23A illustrated in FIG. 16A is the substrate which is obtained by polarizing a base material for the piezoelectric material in the plate-thickness direction. Here, as the piezoelectric material, a piezoelectrically functioning material such as PZT (lead zirconate titanate: $PbTiZrO_3$), barium titanate, PLZT (lead lanthanum zirconate titanate) or the like is used.

To form the piezoelectric plate 23A, the piezoelectric material is first processed into a desired shape. Then, an HIP (Hot Isostatic Pressing) process is performed. More specifically, a ceramic material once sintered is further baked and hardened in gas pressure of 1000° C. or more and 1000 atmospheric pressures or more. It is possible by this process to reduce voids (bubbles) in the sintered body, and this process is used mainly for microfabrication. Then, Ag paste of about several micrometers (μm) is formed as the electrodes for polarization on the upper and lower faces of the HIP-processed substrate. Next, an electric field of 2 kV/mm to 5 kV/mm is applied to the electrodes for polarization. Finally, the used electrodes for the polarization are ground away, thereby forming the piezoelectric plate 23A. Here, the polarization direction is indicated by an arrow P1 illustrated in FIG. 16A.

Figure 16B:
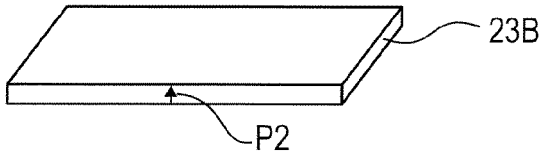

Likewise, a polarized piezoelectric plate 23B illustrated in FIG. 16B is formed from a substrate of which the plate thickness is thinner than that of the piezoelectric plate 23A, by the same procedure as described above. Here, the polarization direction of the piezoelectric plate 23B is indicated by an arrow P2 which is opposite to the polarization direction of the piezoelectric plate 23A.

Figure 16C:
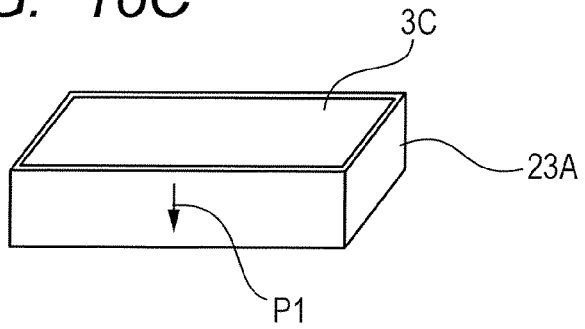
Figure 16D:
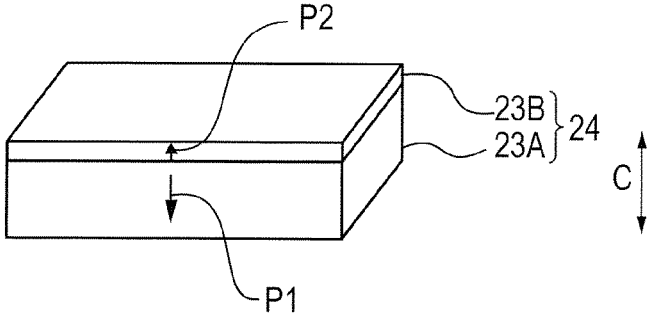

Subsequently, as illustrated in FIG. 16C, the adhesive 3C such as an epoxy adhesive or the like having the thickness of about several micrometers (μm) to ten-odd micrometers (μm) is applied to the piezoelectric plate 23A by a screen printing method or the like. After then, the piezoelectric plate 23B is bonded, heated and pressed to the face on which the adhesive 3C has been applied, such that the polarization direction thereof faces upward. Namely, the piezoelectric plate 23A and the piezoelectric plate 23B are bonded to each other by the adhesive 3C, thereby obtaining a piezoelectric substrate 24 illustrated in FIG. 16D.

Figure 17A:
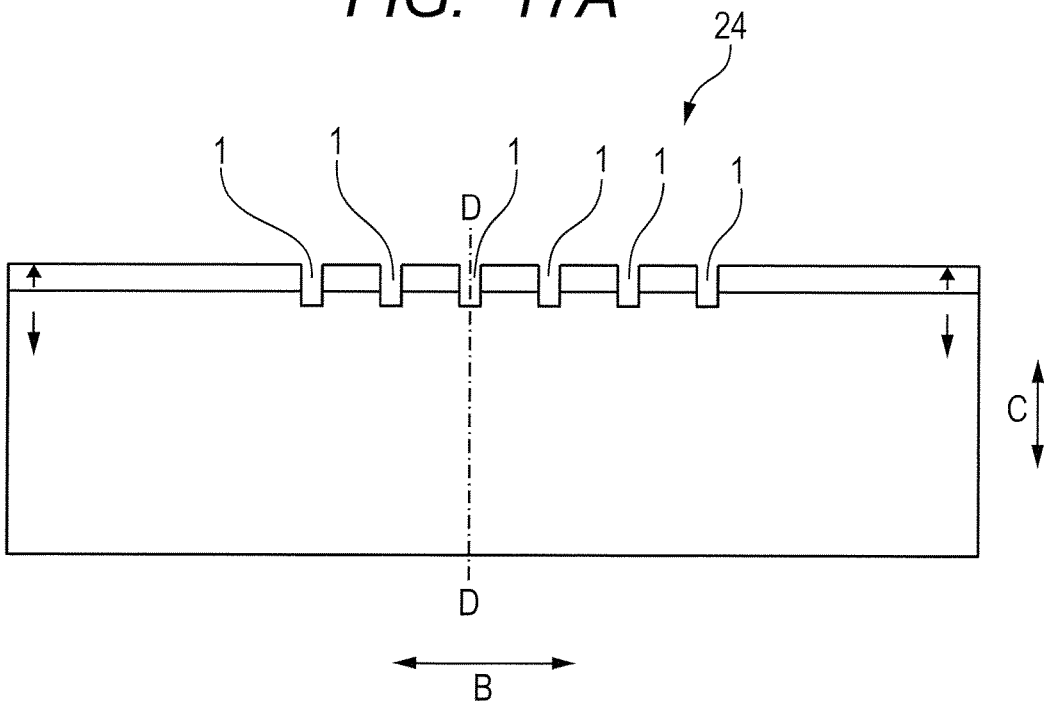
FIGS. 17A and 17B are diagrams for describing the manufacturing method of the inkjet head according to the fifth embodiment of the present invention.
Figure 17B:
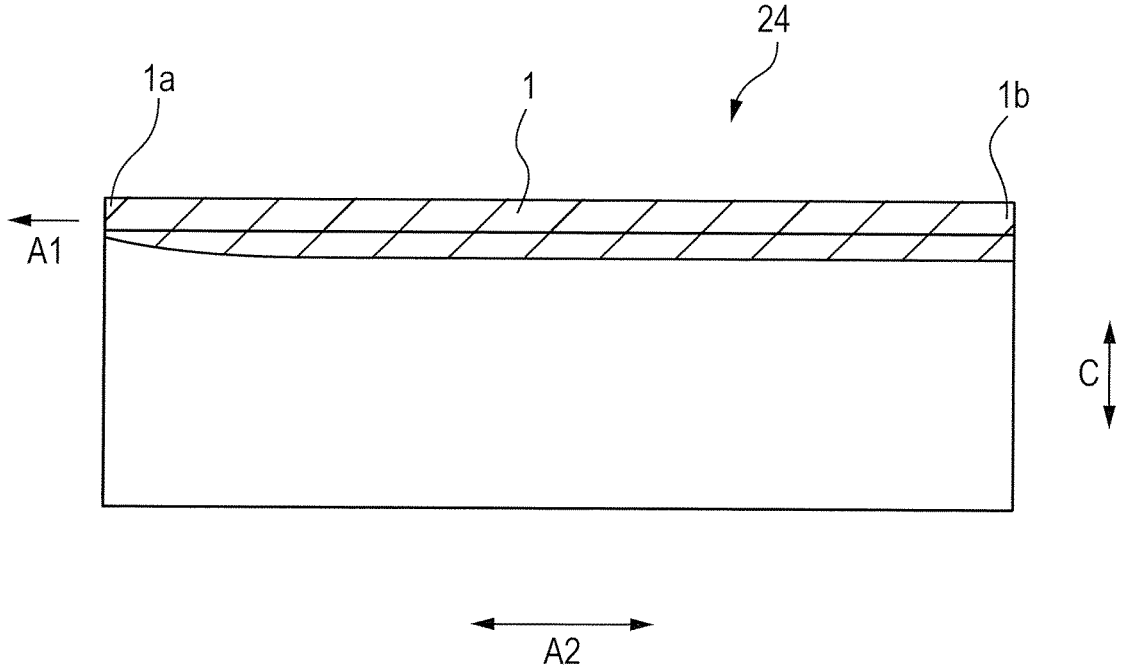

Next, the processing of the individual liquid chamber 1 will be described with reference to FIGS. 17A and 17B. Here, FIG. 17A is the front view of the piezoelectric substrate, and FIG. 17B is the cross-section diagram of the piezoelectric substrate along a D-D line in FIG. 17A. As illustrated in FIG. 17A, the individual liquid chambers 1 are formed on the piezoelectric substrate 24 by using the dicing blade. Here, the thickness of the dicing blade is 40 μm to 80 μm, and the diameter of the dicing blade is about ϕ51 mm to ϕ102 mm in general. To process the piezoelectric material, the diamond abrasive grains of about #1000 to #1600 are used. The resin bond is preferably used as the abrasive grain bond. Further, any problem does not occur if at least the device capable of using the two-axis control is used as the dicing device. Furthermore, the rotation speed of the dicing blade is about 2000 rpm to 30000 rpm. To reduce the stress to the process member at the time when the processing is performed by the dicing blade, the stage transport speed is set to 0.1 mm/s to 0.5 mm/s. The depth of the individual liquid chamber 1 is made shallow at the first end 1*a* on the side of the nozzle as illustrated in FIG. 17B. On the other hand, the depth of the individual liquid chamber on the side of the second end 1*b* being the ink supply side is made constant, that is, about 150 μm to 400 μm. Here, in case of setting the depth of the individual liquid chamber 1, it is necessary to also set the plate thickness of the piezoelectric substrate 24 such that the layer of the adhesive 3C approximately corresponds to the center position in the height direction C. Incidentally, the depth of the individual liquid chamber 1 may be constant from the first end 1*a* toward the second end 1*b*.

Figure 18A:
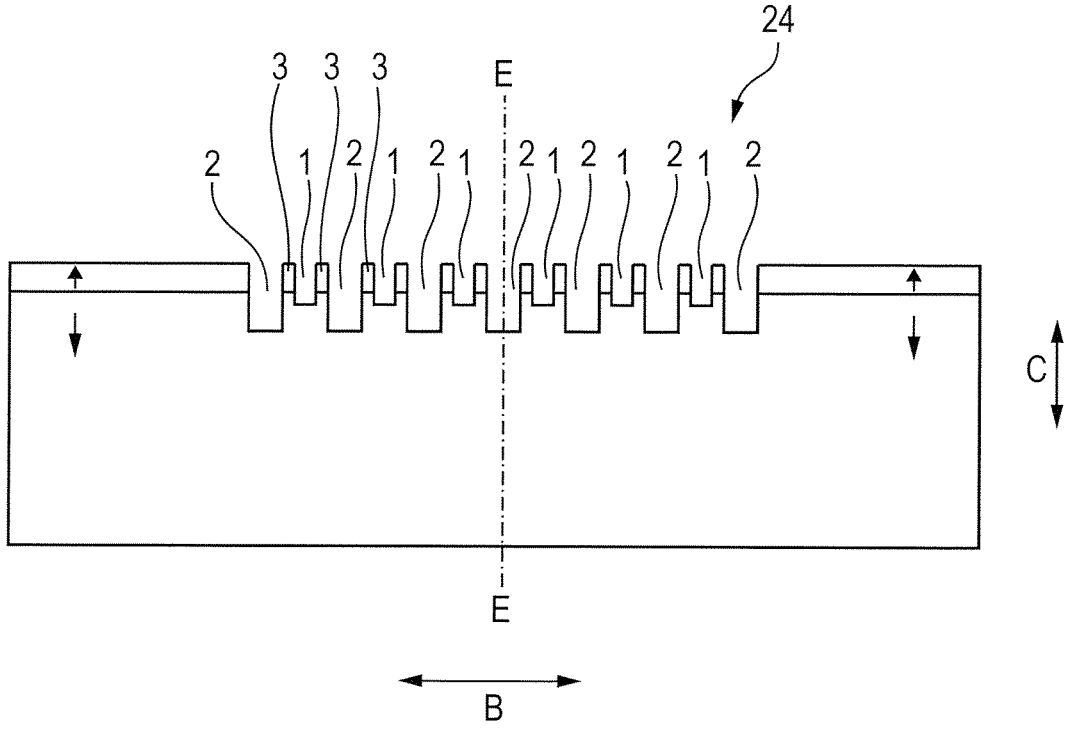
FIGS. 18A and 18B are diagrams for describing the manufacturing method of the inkjet head according to the fifth embodiment of the present invention.
Figure 18B:
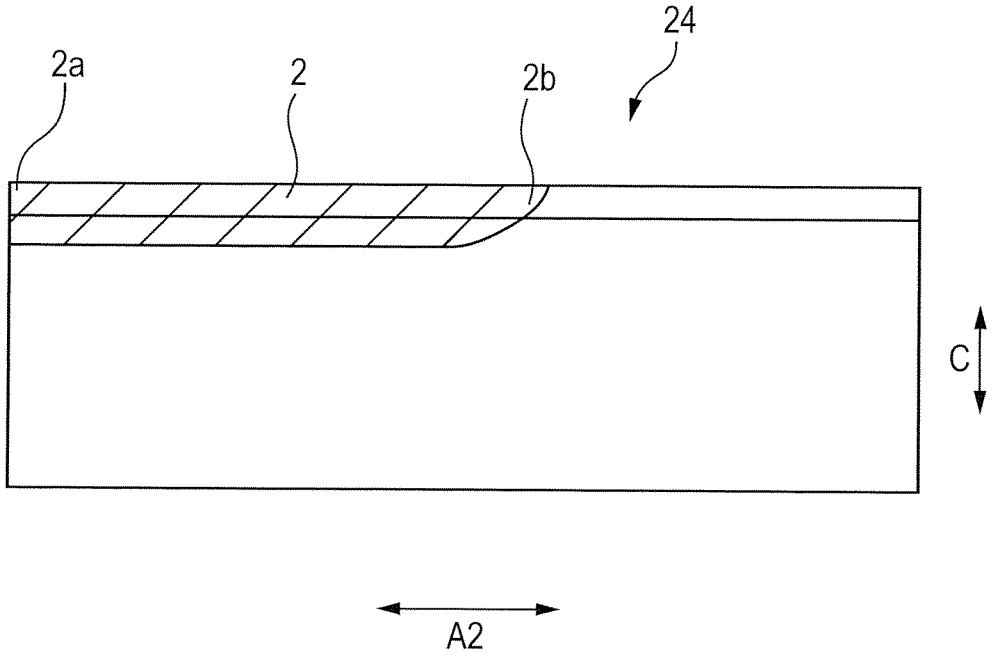

Next, the processing of the dummy chamber 2 will be described with reference to FIGS. 18A and 18B. Here, FIG. 18A is the front view of the piezoelectric substrate, and FIG. 18B is the cross-section diagram of the piezoelectric substrate along an E-E line. As illustrated in FIG. 18A, as well as the individual liquid chambers 1, the dummy chambers 2 are formed on the piezoelectric substrate 24 by using the dicing blade. Here, the dummy chamber 2 is formed so as to be sandwiched by the partitions 3 which respectively form the individual liquid chambers 1.

It should be noted that the constitution having the dummy chamber 2 has an advantage that the individual liquid chamber 1 can be solely controlled. The thickness of the dicing blade is 60 μm to 150 μm, and the diameter of the dicing blade is about ϕ51 mm to ϕ102 mm in general. To process the piezoelectric material, the diamond abrasive grains of about #1000 to #1600 are used. The resin bond is preferably used as the abrasive grain bond. Further, any problem does not occur if at least the device capable of using the two-axis control is used as the dicing device. Furthermore, the rotation speed of the dicing blade is about 2000 rpm to 30000 rpm. To reduce the stress to the process member at the time when the processing is performed by the dicing blade, the stage transport speed is set to 0.1 mm/s to 0.5 mm/s.

The processing position of the dummy chamber 2 is the center between the two individual liquid chambers 1, as illustrated in FIG. 18A. As illustrated in FIG. 18B, the depth of the dummy chamber 2 is made shallow at an end 2*b* on the ink supply side in the height direction C, and the groove thereof is terminated at the midway such that the dummy chamber is not communicated with the common liquid chamber 43 at the end 2*b* on the ink supply side to prevent that the supplied ink flows into the dummy chamber 2. On the other hand, the depth of the dummy chamber on the side of an end 2*a* being the side of the nozzle is made constant, and the processing depth of the dummy chamber 2 is set to be equal to or within +15% of the depth of the individual liquid chamber 1. It is possible, by processing the dummy chamber 2 between the individual liquid chambers 1 and 1, to form the partitions 3 on both the sides of the individual liquid chamber 1. Incidentally, the partition 3 servers as the piezoelectric element which deforms, and the partition 3 is constituted by the oppositely polarized piezoelectric materials.

Figure 19A:
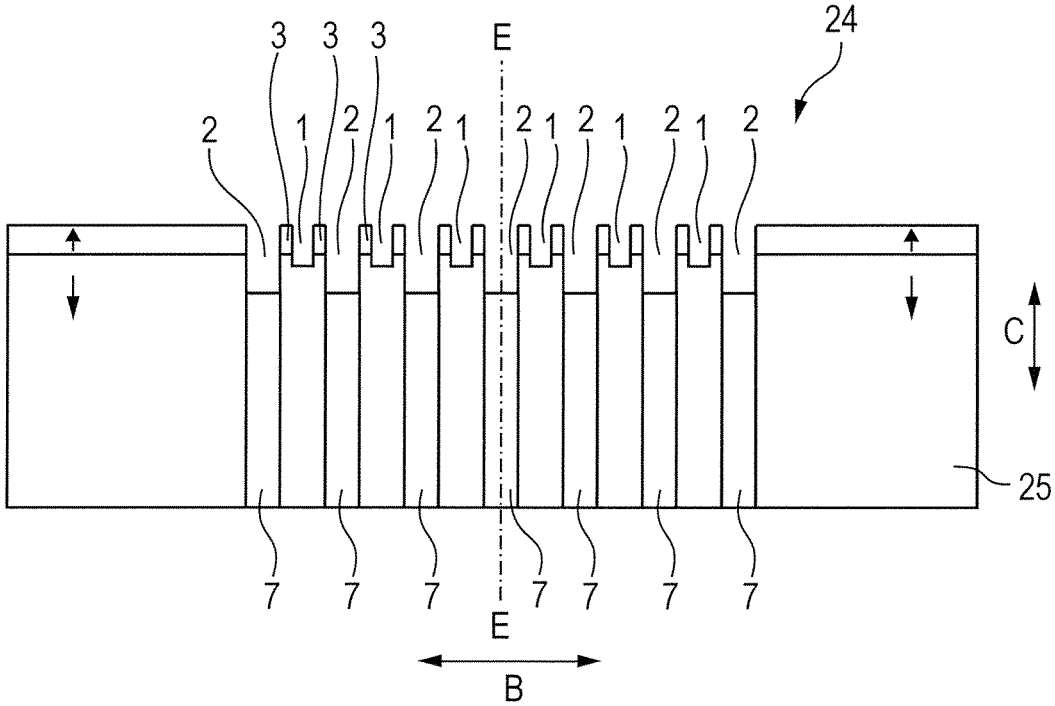
FIGS. 19A and 19B are diagrams for describing the manufacturing method of the inkjet head according to the fifth embodiment of the present invention.
Figure 19B:
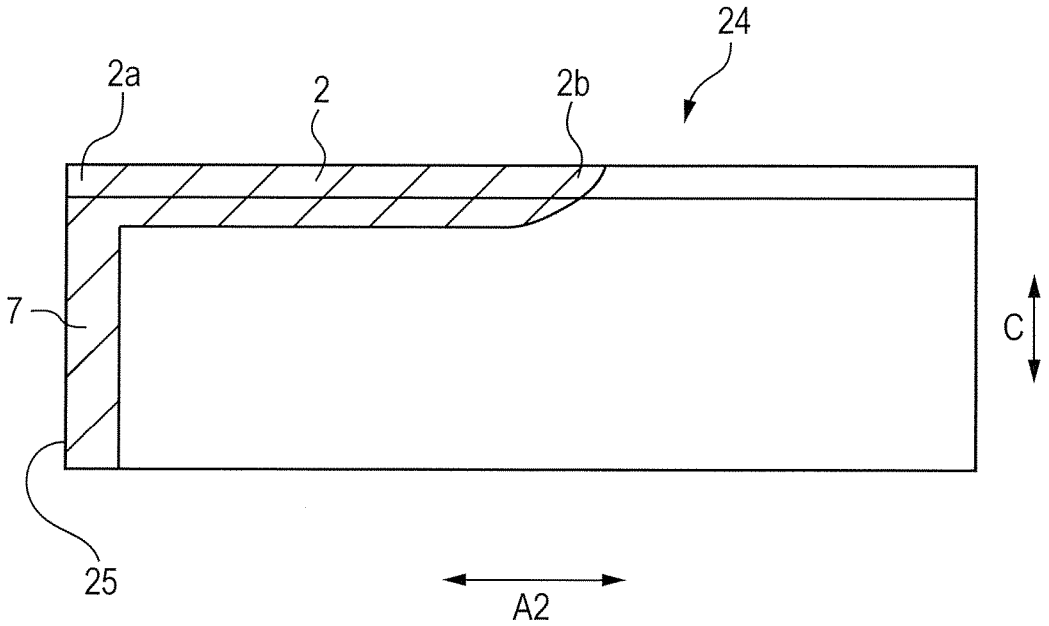

Next, the processing of extraction electrode grooves (i.e., front face grooves) 7 will be described with reference to FIGS. 19A and 19B. Here, FIG. 19A is the front view of the piezoelectric substrate, and FIG. 19B is the cross-section diagram of the piezoelectric substrate along an E-E line. As illustrated in FIGS. 19A and 19B, on the side of the nozzle on the piezoelectric substrate 24, the extraction electrode groove 7 communicated with the end 2*a* of the dummy chamber 2 is likewise formed by using the dicing blade. Here, the processing conditions are the same as those in the case of forming the dummy chamber 2. That is, as illustrated in FIG. 19A, the extraction electrode groove 7 communicated with the dummy chamber 2 is formed on an adhesive face (i.e., a partition groove) 25.

Subsequently, the processing of the electrode pairs 13 will be described with reference to FIG. 20. Incidentally, a signal electrode 15 is arranged on the side of the individual liquid chamber 1, electrically connected to the ground electrode 51 of the flexible substrate 50, and finally grounded. A signal electrode 14 is arranged on the side of the dummy chamber 2, and electrically connected to the signal electrode 52 of the flexible substrate 50, so that voltage is applied thereto.

A conductor 26 serving as the electrode is formed on the surface of the piezoelectric substrate 24 having an electrical insulation property by an electroless plating process. Here, the electroless plating process is the process for forming an Ni plating or the like. In the electroless plating procedure, a minute recess is first formed on the surface of the piezoelectric substrate 24 by an appropriate etching agent. Next, a deleading process for eliminating Pb widely used as a piezoelectric material is performed. Further, a process of adsorbing Sn and Pd on the outermost surface as plating catalyst is performed. First, the substrate is immersed in a stannous chloride solution of 0.1% concentration so that stannous chloride is adsorbed. Subsequently, metallic palladium is adsorbed on the surface by an oxidation-reduction reaction of adsorbed stannous chloride and palladium chloride. In this state, the substrate is immersed in the Ni plating solution, so that the conductor 26 composed of an electroless plating film of Ni is grown. It is possible as a Ni plating layer to use either a Ni—P layer or a Ni—B layer. Here, the film thickness is determined in consideration of surface covering and a resistance value, and thus set to about 0.5 μm to 2.0 μm.

Subsequently, elimination of an unnecessary portion will be described. Here, as the portions to be eliminated, the upper-side portion of the partition 3 and the nozzle plate bonding face are eliminated by grinding. As the elimination amount, the portion corresponding to about 3 to 10 times the thickness of the conductor 26 being the plating film may be eliminated.

Subsequently, the divided signal electrodes 14 are provided by a dividing groove 19 at the bottom of the dummy chamber 2, so as to individually drive the partition 3 for each individual liquid chamber 1. The dividing groove 19 is processed by the dicing blade in the same manner as that for the above groove processing. Here, it is preferable to set the width of the dividing groove 19 to about ½ to ⅓ of the dummy chamber 2, and to set the depth thereof to about 10 μm to 50 μm. The dividing position is equivalent to the entire bottom portion of the dummy chamber 2 in the longitudinal direction and the front face in the extraction electrode groove 7. As just described, since the electrode is divided into the signal electrodes 14 and 14 by the dividing groove 19 in the dummy chamber 2, it is possible to electrically insulate the mutual signal electrodes 14 corresponding to the respective individual liquid chambers 1.

Figure 21A:
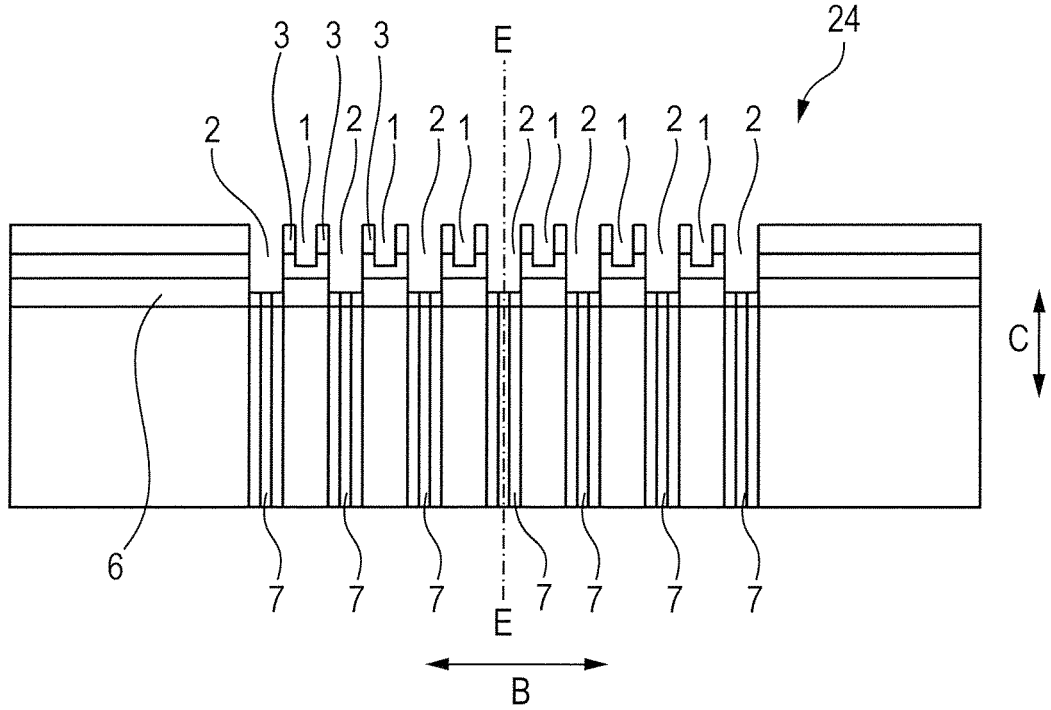
FIGS. 21A and 21B are diagrams for describing the manufacturing method of the inkjet head according to the fifth embodiment of the present invention.
Figure 21B:
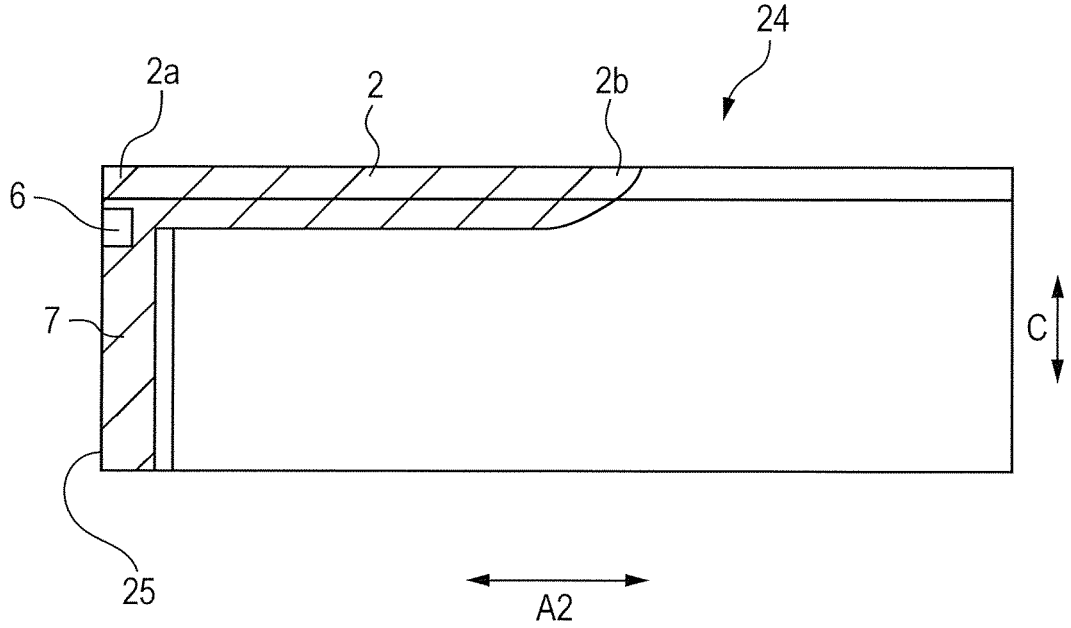

Subsequently, the processing of a clearance groove 6 will be described with reference to FIGS. 21A and 21B. Here, FIG. 21A is the front view of the piezoelectric substrate, and FIG. 21B is the cross-section diagram of the piezoelectric substrate along an E-E line. As illustrated in FIGS. 21A and 21B, in addition to the dividing groove 19, the clearance groove 6 for the adhesive is formed below the individual liquid chambers 1 on the front face of the piezoelectric substrate 24 so as to extend across the respective extraction electrode grooves 7. Here, it is desirable to set the depth of the clearance groove to about 5 μm to 40 μm.

Next, the plurality of nozzles 30*a* for discharging the ink are formed on the nozzle plate 30 (FIG. 14A). Here, any one of polyimide, nickel, SUS (Stainless Used Steel) and the like may be used as the material of the nozzle plate 30. In case of using the polyimide, a solvent including fluorine-containing macromolecule is coated as an ink-repellent film by a spin coating method or the like. Here, although solvent-soluble fluorine-containing polymer such as polydiperfluoroalkyl fumarate, Teflon™ AF, or Cytop™ is used as the fluorine-containing macromolecule, the present embodiment is not limited to this. The nozzles 30*a* are formed by focusing and irradiating an excimer laser beam on the back side face of the ink-repellent film.

Then, the nozzle plate 30, the manifold 40, the second substrate 12 and the flexible substrate 50 are aligned and bonded to the first substrate 11 (i.e., the processed piezoelectric substrate 24) on which the partitions 3 have been provided, thereby completing the inkjet head 100. More specifically, the second substrate 12 on which the counterbore portion (the concave portion) 12*c* (FIG. 14A) has been formed is prepared. Then, the counterbore portion is arranged such that the counterbore portion serves as a part of the common liquid chamber and is communicated with the plurality of individual liquid chambers, and the second substrate is bonded. Thus, the common liquid chamber 43 is constituted by the liquid chamber portion 43A which is the space formed by the manifold 40, and the liquid chamber portion 43B which is communicated with the liquid chamber portion 43A and is the space formed by the counterbore portion (the concave portion) 12*c* in the second substrate 12.

Sixth Embodiment

Figure 22A:
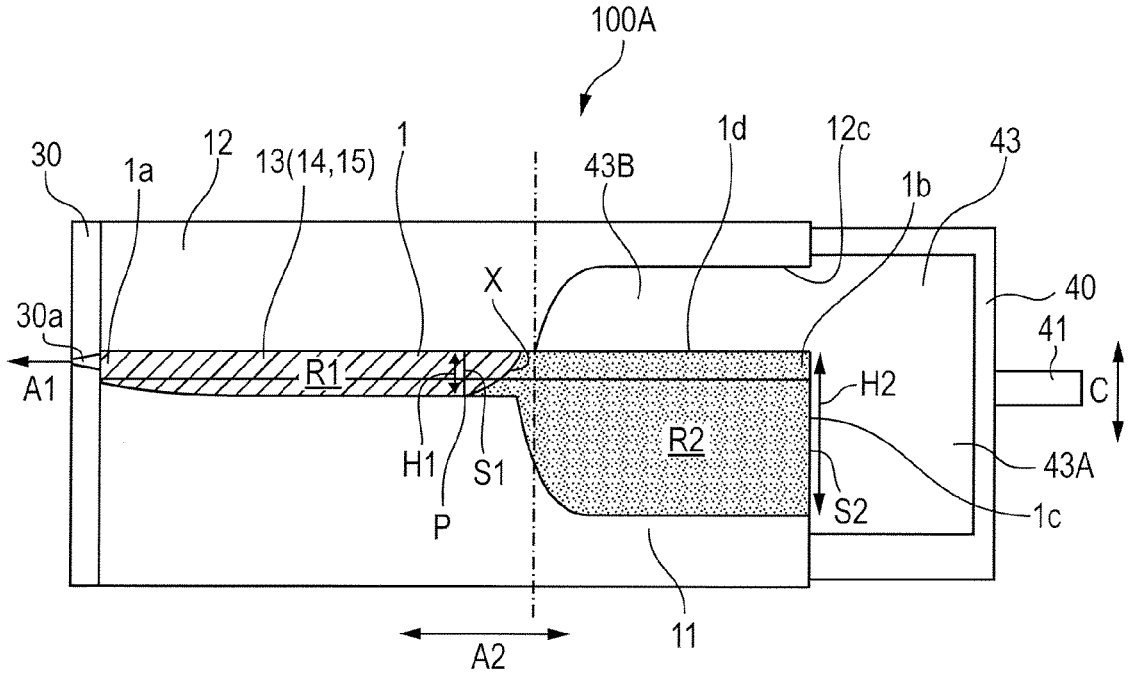
FIGS. 22A and 22B are cross-section diagrams illustrating an inkjet head as an example of a liquid discharge head serving as a liquid discharge apparatus according to a sixth embodiment of the present invention.
Figure 22B:
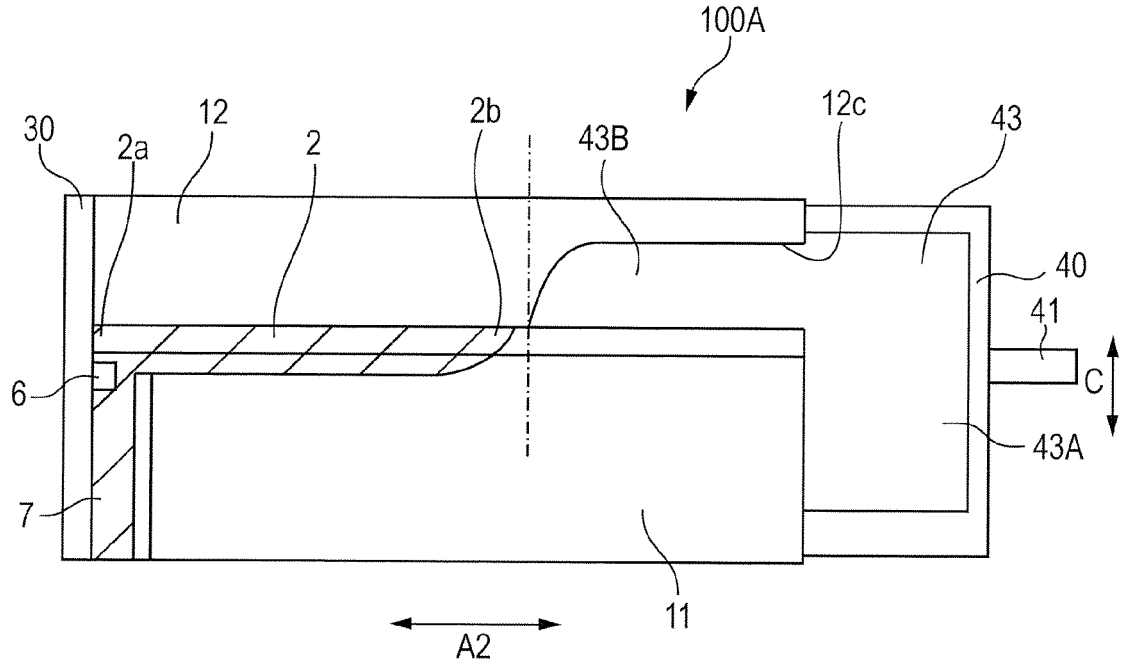

Subsequently, a liquid discharge apparatus according to the sixth embodiment of the present invention will be described. Also, in the present embodiment, the liquid discharge apparatus corresponds to an inkjet head. FIGS. 22A and 22B are cross-section diagrams illustrating the inkjet head as an example of a liquid discharge head serving as the liquid discharge apparatus according to the sixth embodiment of the present invention. More specifically, FIG. 22A is the cross-section diagram along an individual liquid chamber, and FIG. 22B is the cross-section diagram along a dummy chamber. Incidentally, in the present embodiment, the constitutions same as those described in the first embodiment are added with the same corresponding numerals and symbols respectively and descriptions of these constitutions will be omitted.

As well as the first embodiment, an inkjet head 100A comprises substrates 11 and 12, a nozzle plate 30 and a manifold 40. Moreover, as well as the first embodiment, the inkjet head 100A comprises a plurality of partitions, a plurality of individual liquid chambers 1 and a plurality of dummy chambers 2.

On each partition 3, each electrode pair 13 is arranged on both the side faces of each partition 3 so as to divide the partition into a movable region R1 which corresponds to the portion on the side of the nozzle and to which an electric field for shear-deforming the partition is applied and an immovable region R2 which corresponds to the portion on the side of the common liquid chamber and to which the electric field is not applied. Here, the electrodes constituting each electrode pair faces each other with the movable region R1 therebetween.

Incidentally, in the sixth embodiment, on both the side faces of the partition 3, a conductor is formed on the overall side face on the side of the individual liquid chamber 1 and the overall side face on the side of the dummy chamber 2. However, only the portions (the slant portion in FIG. 22A) mutually overlapping each other in the width direction constitute electrodes 14 and 15.

Here, it is assumed that, when viewed from the width direction, the individual liquid chamber has a boundary point P closest to a first end 1*a* on a boundary X between the movable region R1 and the immovable region R2. Moreover, it is assumed that the individual liquid chamber 1 has a cross-section area S1 along the face perpendicular to a longitudinal direction A2 on the boundary point P and a cross-section area S2 along the face perpendicular to the longitudinal direction A2 on a second end 1*b*.

Each individual liquid chamber 1 is formed such that the cross-section area S2 is wider than the cross-section area S1. In the sixth embodiment, the width of the individual liquid chamber 1 is formed to have a certain length from the first end 1*a* to the second end 1*b*. Therefore, in the sixth embodiment, a height H2 of each individual liquid chamber 1 at the second end 1*b* is higher than a height H1 of each individual liquid chamber 1 at the boundary point P.

At this time, in the individual liquid chamber 1, the cross-section area along the face perpendicular to the longitudinal direction A2 becomes large from the boundary point P to a common liquid chamber 43 in the longitudinal direction A2, and the cross-section area S2 of the face being in contact with the common liquid chamber 43 is the maximum area as the cross-section area of the individual liquid chamber 1.

In the sixth embodiment, each individual liquid chamber 1 is formed such that the cross-section area of the cross section along the face perpendicular to the longitudinal direction A2 of each individual liquid chamber 1 becomes continuously wide as the relevant cross section approaches the second end 1*b* from the boundary point P. Incidentally, although the cross-section area S continuously changes in the present embodiment, it is possible to form the individual liquid chamber such that the cross-section area S becomes wide gradually. Therefore, in the individual liquid chamber 1, since the center of pressure is deviated from the central portion to the side of the nozzle in the longitudinal direction A2, it is possible to effectively apply the pressure to the ink which is the liquid in the nozzle.

Moreover, each individual liquid chamber 1 is formed such that the height at the first end 1*a* is lower than the height at the boundary point P closest to the first end 1*a* on the boundary between the movable region R1 and the immovable region R2. Therefore, it is possible to effectively apply the pressure to the ink being the liquid in the vicinity of the nozzle.

In the sixth embodiment, as well as the fifth embodiment, even if the amount of the droplets to be discharged is made small by reducing the diameter of each nozzle, the minute droplets are not separated and generated before the main droplets. Therefore, it is possible to stably discharge the droplets.

Seventh Embodiment

Figure 23A:
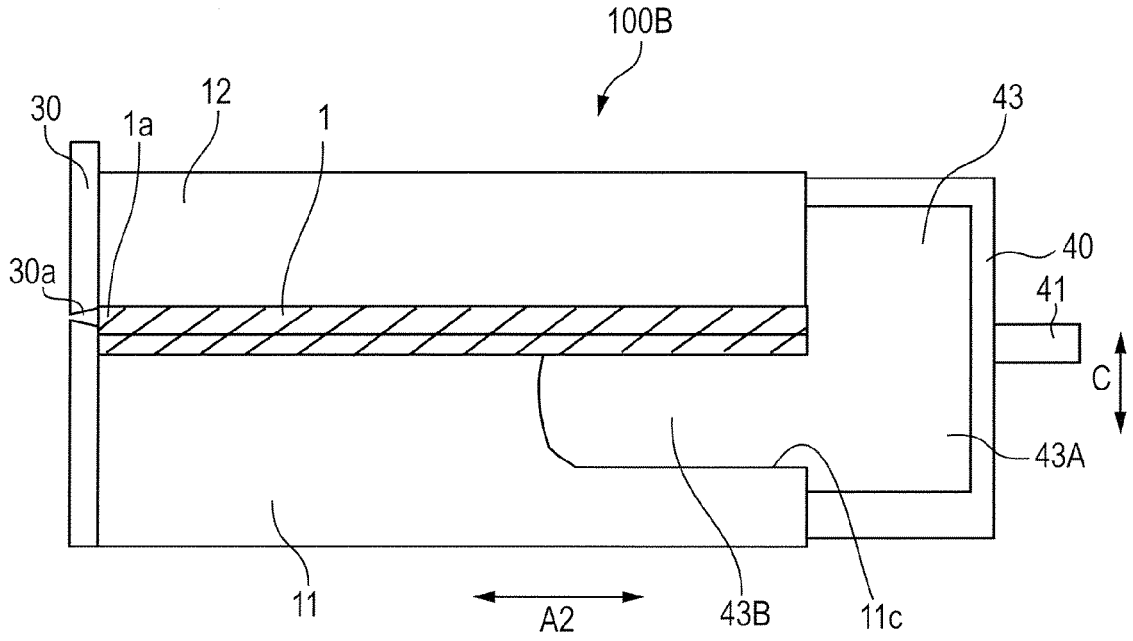
FIGS. 23A and 23B are cross-section diagrams illustrating an inkjet head as an example of a liquid discharge head serving as a liquid discharge apparatus according to a seventh embodiment of the present invention.
Figure 23B:
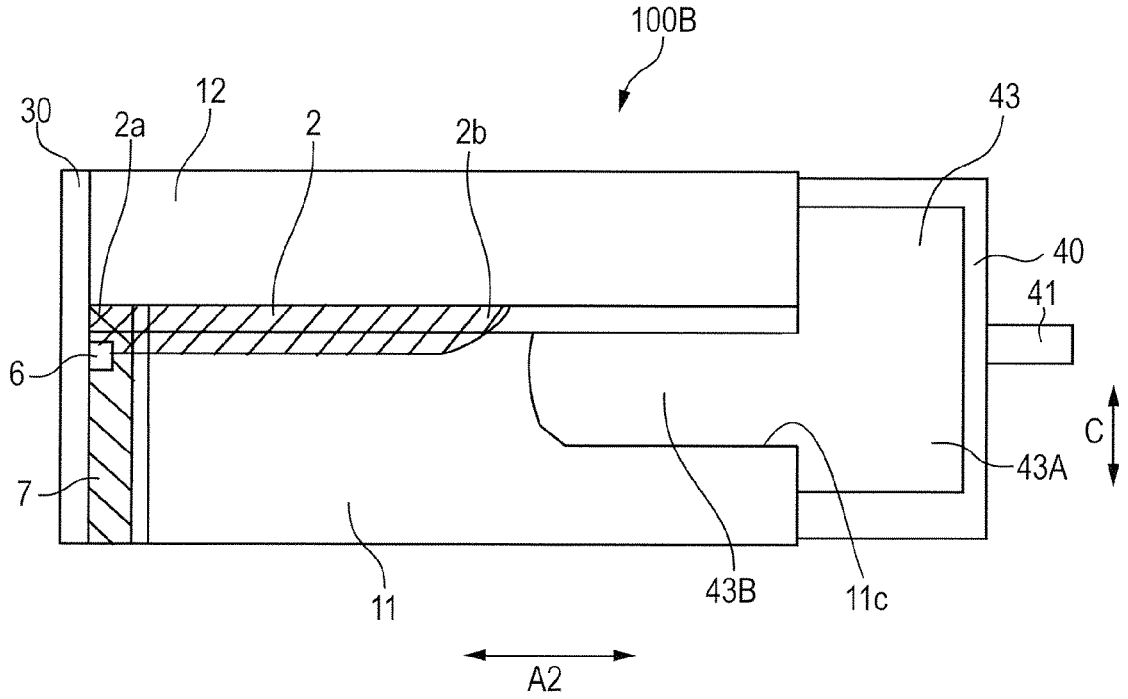

Subsequently, a liquid discharge apparatus according to the seventh embodiment will be described. Also, in the present embodiment, the liquid discharge apparatus corresponds to an inkjet head. FIGS. 23A and 23B are cross-section diagrams illustrating the inkjet head as an example of a liquid discharge head serving as the liquid discharge apparatus according to the seventh embodiment of the present invention. More specifically, FIG. 23A is the cross-section diagram along an individual liquid chamber, and FIG. 23B is the cross-section diagram along a dummy chamber.

As well as the first embodiment, an inkjet head 100B comprises substrates 11 and 12, a nozzle plate 30 and a manifold 40. Moreover, as well as the first embodiment, the inkjet head 100B comprises a plurality of partitions, a plurality of individual liquid chambers 1 and a plurality of dummy chambers 2.

In the above fifth embodiment, the counterbore portion 12*c* is formed in the second substrate 12, and the liquid chamber portion 43B of the common liquid chamber 43 to be connected to the individual liquid chamber 1 through the second opening 1*d* is formed. However, the present invention is not limited to this constitution. Namely, the counterbore portion may be formed in at least one of the first and second substrates. More specifically, as illustrated in FIGS. 23A and 23B, a counterbore portion 11*c* may be formed in the first substrate 11. In the constitution of the present embodiment, as well as the fifth embodiment, minute droplets are not separated and generated before main droplets even if the amount of the droplets to be discharged is made small by reducing the diameter of each nozzle. Therefore, it is possible to stably discharge the droplets.

Incidentally, the present invention is not limited to the above embodiments, that is, various modifications can be achieved by a person skilled in this field of art within the technical concept of the present invention.

In the above embodiments, the inkjet head to be used in a printer or the like has been described as the liquid discharge head. However, the present invention is not limited to this. For example, a head for discharging, as a liquid, a liquid containing metal fine particles to be used when forming metal wirings may be used as the liquid discharge head. Moreover, a head for discharging resist ink to be used for resist patterning may be used.

Besides, in the above embodiments, the case where the partition is the piezoelectric material constituted by bonding the base-side piezoelectric material polarized in the height direction and the tip-side piezoelectric material polarized in the direction opposite to that of the base-side piezoelectric material has been described. However, the partition may be constituted by a piezoelectric material polarized in one direction, i.e., the height direction.

Example 1

Figure 24A:
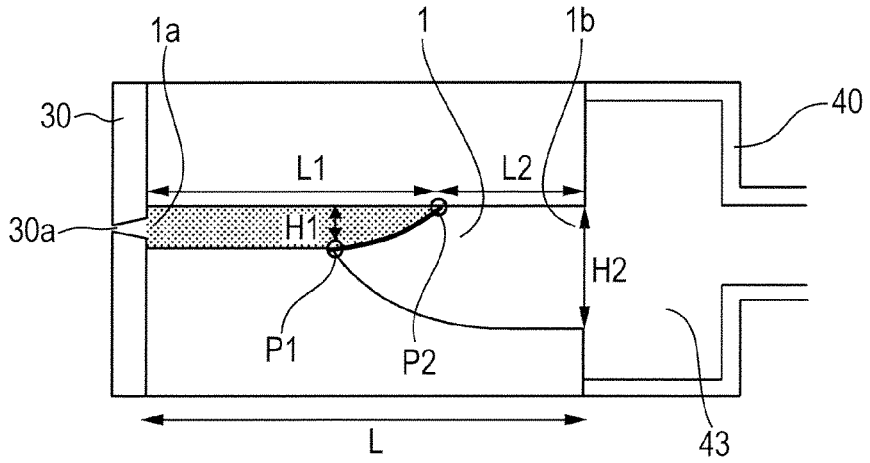
FIGS. 24A, 24B and 24C are schematic diagrams each illustrating the cross section of a discharge unit.
Figure 24B:
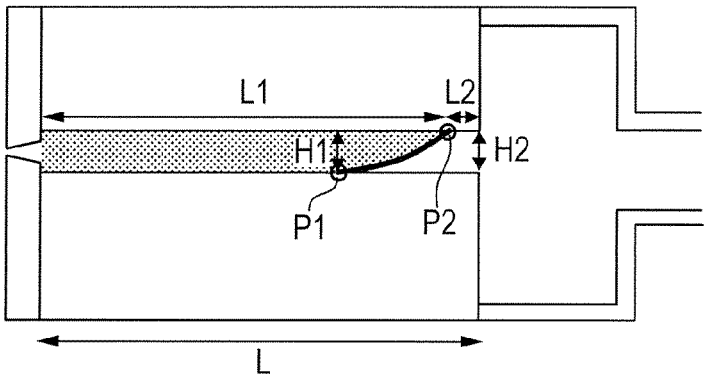
Figure 24C:
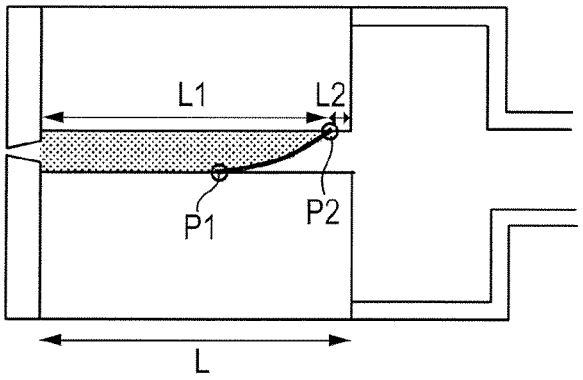

FIGS. 24A, 24B and 24C are schematic diagrams each illustrating the cross section of the discharge unit 10. More specifically, FIG. 24A shows the constitution of the discharge unit 10 in the example 1, and, in this unit, the length L of the individual liquid chamber 1 is 12 mm.

The length L of the individual liquid chamber 1 in the longitudinal direction A2 is 12 mm, and the cross-section area S of the individual liquid chamber 1 becomes large from the first boundary point P1 to the common liquid chamber 43 in the longitudinal direction A2. The cross-section area S2 of the individual liquid chamber 1 being in contact with the common liquid chamber 43 is larger than the cross-section area S1 of the individual liquid chamber 1 at the first boundary point P1, and the cross-section area S2 is the maximum cross-section area in the individual liquid chamber 1. More specifically, the height H1 of the individual liquid chamber 1 at the first boundary point P1 is 240 μm, the height H2 of the individual liquid chamber 1 at the face being in contact with the common liquid chamber 43 is 650 μm, and the width W (FIG. 8B) of the individual liquid chamber 1 is 60 μm.

Moreover, the length L1 between the first end 1*a* (the nozzle 30*a*) and the second boundary point P2 in the longitudinal direction A2 is 7.3 mm, and the length L2 between the second boundary point P2 and the second end 1*b* (the common liquid chamber 43) in the longitudinal direction A2 is 4.7 mm.

The cross-section area S is expressed by the product of the height H of the individual liquid chamber 1 and the width W of the individual liquid chamber 1. If the ratio between the cross-section area S1 and the cross-section area S2 is R11 (=S1/S2), the ratio R11 of these cross-section areas in the individual liquid chamber 1 is 2.7. Moreover, if the ratio between the length L1 and the length L2 is R12 (=L2/L1), the ratio R12 of these lengths is 0.64.

FIG. 24B shows the constitution of the discharge unit in a comparative example 1, in which the cross-section area S has a constant height and a constant width in the longitudinal direction A2. That is, the same cross-section area continues from the cross-section area S1 of the individual liquid chamber crossing the first boundary point P1 to the cross-section area S2 of the individual liquid chamber being in contact with the common liquid chamber.

More specifically, the length L of the individual liquid chamber is 12 mm as well as the example, the length L1 is 11 mm, the length L2 is 1 mm, and the width W of the individual liquid chamber is 60 μm.

Moreover, the height H1 of the individual liquid chamber at the first boundary point P1 is 240 μm, and also the height H2 of the individual liquid chamber at the face being in contact with the common liquid chamber is 240 μm. The ratio R11 of the cross-section areas S1 and S2 is 1.0, and the ratio R12 of the lengths L1 and L2 is 0.09.

FIG. 24C shows the constitution of the discharge unit in a comparative example 2, in which the length L of the individual liquid chamber is shortened to 8 mm in comparison with the comparative example 1 (FIG. 24B). The height H1 of the individual liquid chamber at the first boundary point P1 is 240 μm, the height H2 of the individual liquid chamber at the face being in contact with the common liquid chamber is 240 μm, and the width W of the of the individual liquid chamber is 60 μm.

Moreover, the length L1 is 7.3 mm as well as the example, the length L2 is 0.7 mm, the ratio R11 of the cross-section areas S1 and S2 is 1.0, and the ratio R12 of the lengths L1 and L2 is 0.09.

Besides, in the example 1 (FIG. 24A), the comparative example 1 (FIG. 24B) and the comparative example 2 (FIG. 24C), the width T of the partition is 70 μm, and the diameter of the nozzle is 10 μm.

Figure 25:
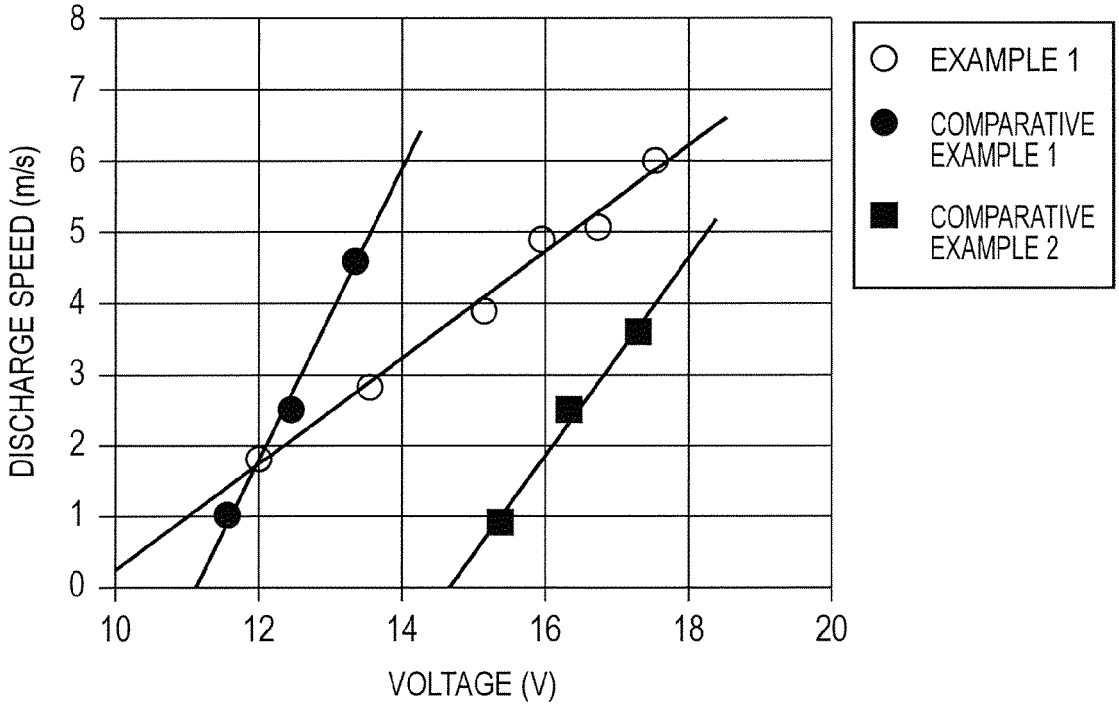
FIG. 25 is a graph indicating a relation between applied voltage and droplet discharge speed in an inkjet head of each of an example 1, a comparative example 1 and a comparative example 2.

FIG. 25 is a graph indicating a relation between applied voltage and droplet discharge speed in the inkjet head of each of the example 1, the comparative example 1 and the comparative example 2. A result obtained by comparing such characteristics is indicated by Table 1.

TABLE 1

| | Voltage Sensitivity (m/s/V) | Voltage Threshold (V) |
|---|---|---|
| Example 1 | 0.7 | 9.6 |
| Comparative Example 1 | 2.0 | 11.0 |
| Comparative Example 2 | 1.4 | 14.7 |

In the comparative example 1, the voltage sensitivity is high, i.e., 2.0 m/s/V. On the other hand, the voltage sensitivity in the comparative example 2 in which the total length L of the individual liquid chamber is shorter than that in the comparative example 1 is 1.4 m/s/V, and thus the voltage sensitivity can be reduced in comparison with the comparative example 1. However, the voltage threshold for discharging the droplet in the comparative example 2 is higher than that in the comparative example 1. Besides, in the example 1, it is possible to reduce the voltage sensitivity to the value lower than those in the comparative examples 1 and 2 without increasing the voltage threshold for discharging the droplet in comparison with the comparative example 1.

Figure 26:
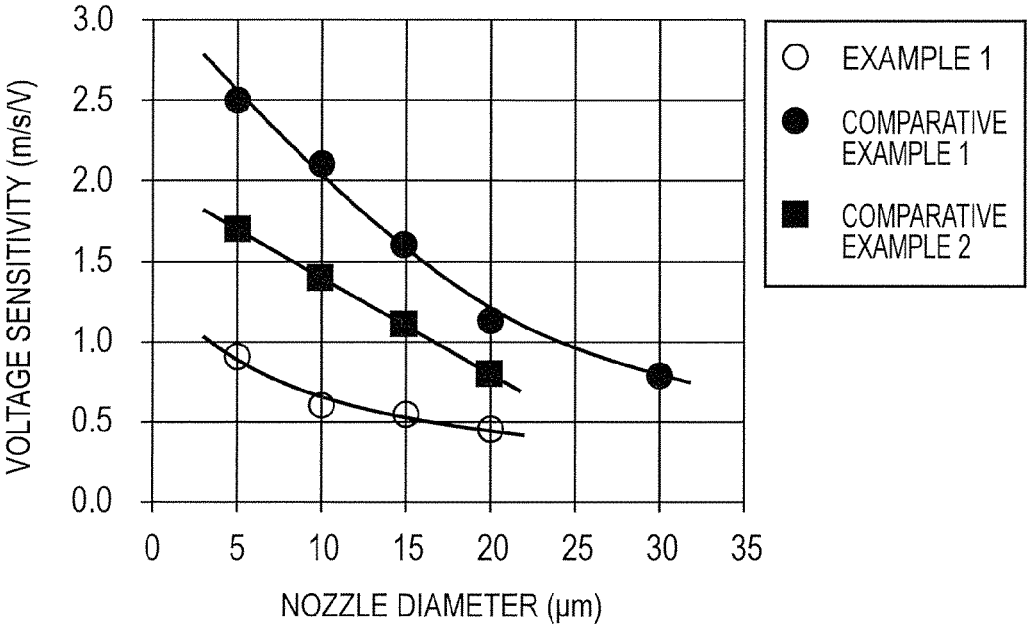
FIG. 26 is a graph indicating a relation between a nozzle diameter and voltage sensitivity in the inkjet head of each of the example 1, the comparative example 1 and the comparative example 2.

FIG. 26 is a graph indicating a relation between a nozzle diameter and a voltage sensitivity in the inkjet head of each of the example 1, the comparative example 1 and the comparative example 2.

It can be understood from the graph that the voltage sensitivity becomes larger as the nozzle diameter is made smaller. Namely, to obtain the desirable voltage sensitivity of 0.5 m/s/V to 1.0 m/s/V, it can be understood that at least 30 μm is necessary as the nozzle diameter in the comparative example 1, and at least 20 μm is necessary as the nozzle diameter in the comparative example 2. On the other hand, in the example 1, it is possible to obtain the effective result when the nozzle diameter is within the range of 5 μm to 15 μm.

Example 2

Figure 27A:
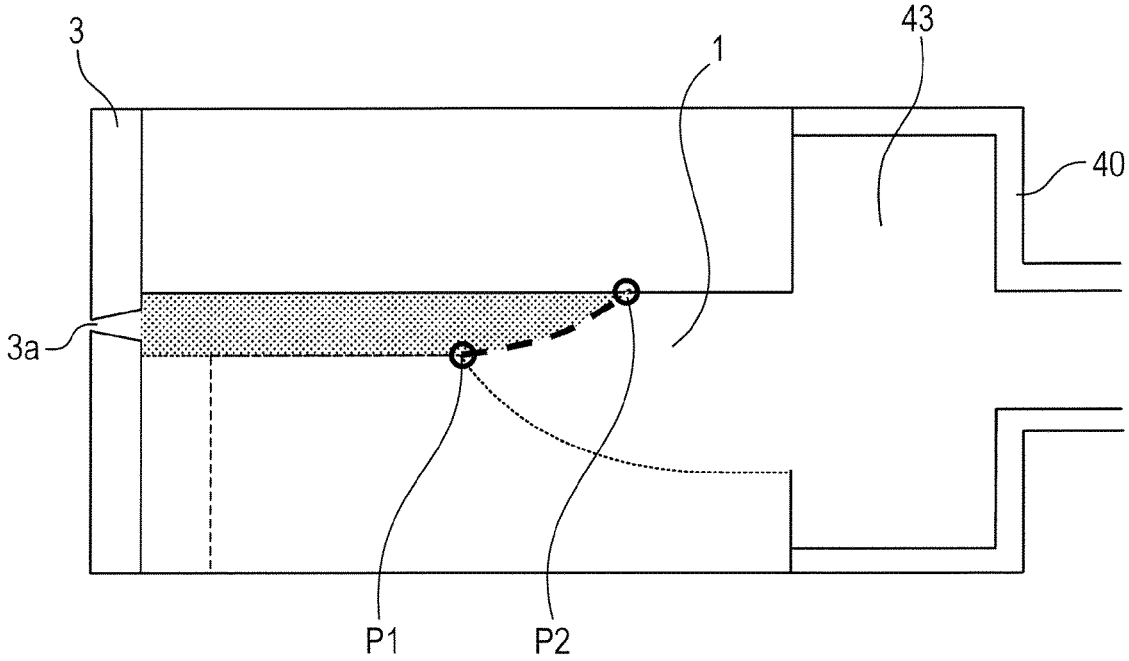
FIGS. 27A and 27B are schematic diagrams illustrating an individual liquid chamber of an inkjet head according to an example 2.
Figure 27B:
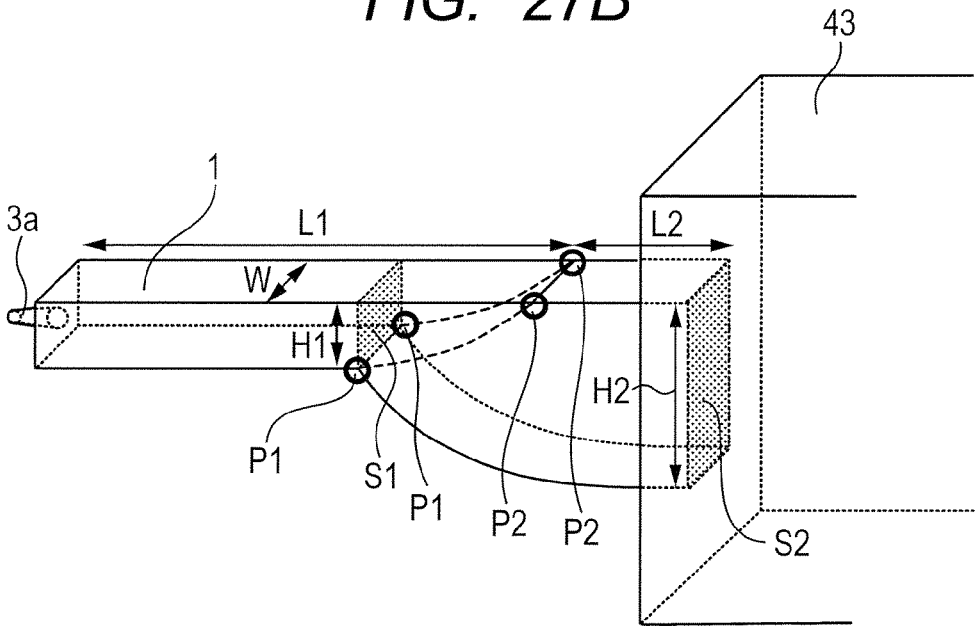

FIGS. 27A and 27B are schematic diagrams illustrating the individual liquid chamber of the inkjet head in the example 2. More specifically, FIG. 27 is the cross-section diagram of the individual liquid chamber of the inkjet head, and FIG. 27B is the perspective diagram of the individual liquid chamber of the inkjet head. In the constitution illustrated in FIGS. 27A and 27B, the ratio R11=S2/S1 of the cross-section area S1 of the individual liquid chamber 1 and the cross-section area S2 of the individual liquid chamber 1 is changed and evaluated by changing the height H2 of the individual liquid chamber 1 at the face being in contact with the common liquid chamber 43 up to the range of 250 μm to 650 μm.

In addition, the length L of the individual liquid chamber 1 is 12 mm, the length L1 from the nozzle 30*a* to the second boundary point P2 in the longitudinal direction A2 is 7.3 mm, and the length L2 from the second boundary point P2 to the common liquid chamber 43 is 4.7 mm. The height H1 of the individual liquid chamber 1 is 240 μm, the width W of the individual liquid chamber 1 is 60 μm, and the width T of the partition is 70 μm.

Figure 28:
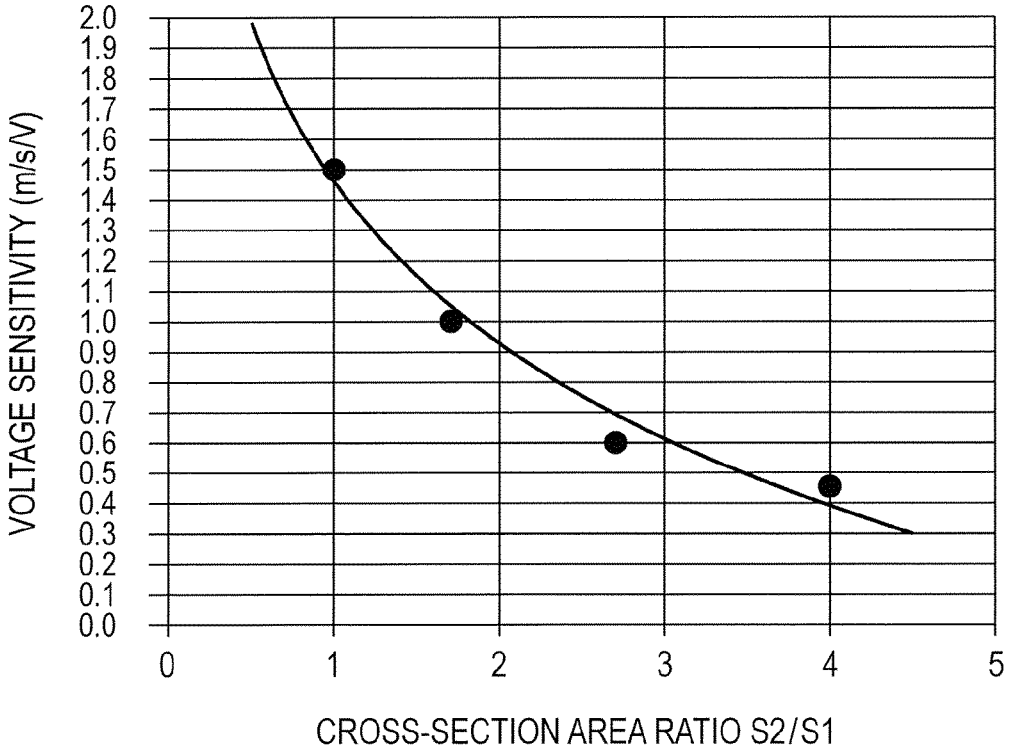
FIG. 28 is a graph indicating a relation between a cross-section area ratio and voltage sensitivity of an individual liquid chamber.

FIG. 28 is a graph indicating a relation between the cross-section area ratio R11 and the voltage sensitivity of the individual liquid chamber 1. It can be understood from the graph that the voltage sensitivity can be lowered by enlarging the cross-section area ratio R11 of the individual liquid chamber 1.

It can be understood that, to obtain the desirable voltage sensitivity of 0.5 m/s/V to 1.0 m/s/V, it is preferable to set the cross-section area ratio R11 of the individual liquid chamber 1 within the range of 1.8 to 3.5.

Figure 29:
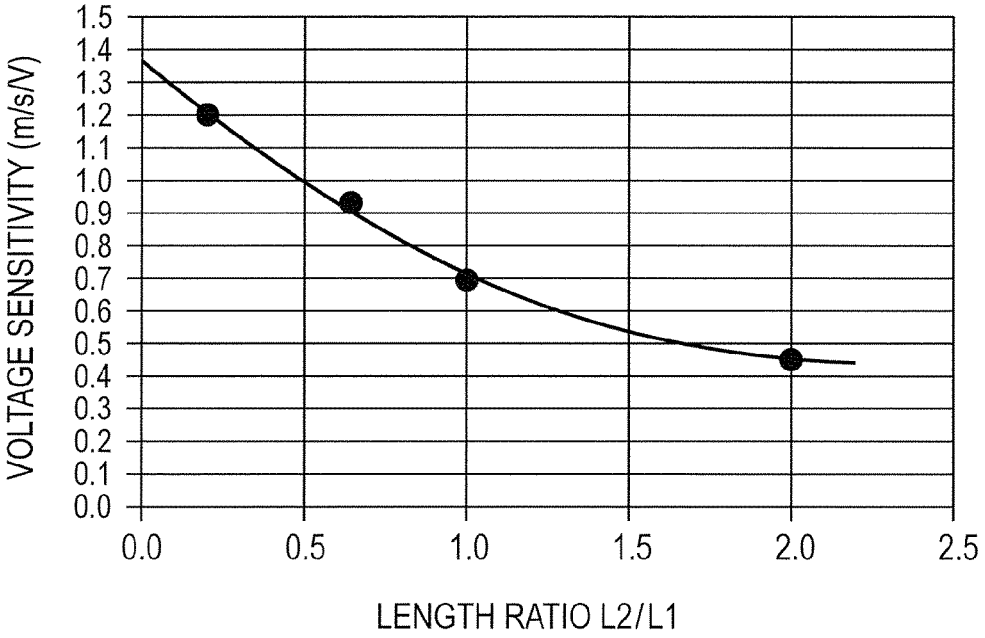
FIG. 29 is a graph indicating a relation between a length ratio and voltage sensitivity.

FIG. 29 is a graph indicating a relation between the length ratio R12 and the voltage sensitivity. Here, the length L of the individual liquid chamber 1 is constant at 12 mm, and the L1 from the nozzle 30*a* to the second boundary point P2 is set to be within the range of 4 mm to 10 mm. Then, the length ratio R12 in the individual liquid chamber 1 is set to be within the range of 0.6 to 1.7, and the relation between the length ratio and the voltage sensitivity is evaluated. Besides, the height H1 of the individual liquid chamber 1 at the first boundary point P1 is 250 μm, the height H2 of the individual liquid chamber 1 at the face being in contact with the common liquid chamber 43 is 400 μm, the width W of the individual liquid chamber 1 is 60 μm, and the width T of the partition is 70 μm.

It is understood from FIG. 29 to be able to lower the voltage sensitivity by increasing the length ratio R12 of the movable region and the immovable region in the individual liquid chamber 1. That is, to obtain the desirable voltage sensitivity of 0.5 m/s/V to 1.0 m/s/V, it is preferable to set the length ratio R12 within the range of 0.6 to 1.7.

If the partition 3 forming the individual liquid chamber 1 is entirely set as the movable region, the voltage sensitivity is excessively lowered. However, it is possible to obtain the appropriate value as the voltage sensitivity by dividing the partition 3 into the movable region to which the electric field for shear-deforming the partition at the portion on the side of the nozzle is applied and the immovable region to which the electric field is not applied at the portion on the side of the common liquid chamber. Moreover, it is possible to obtain the desirable voltage sensitivity by setting the ratio R12 within the range of 0.6 to 1.7.

Example 3

Subsequently, the inkjet head according to the example 3 will be described. More specifically, the PZT (lead zirconate titanate: $PbTiZrO_3$) was used as the material of the piezoelectric plates 23A and 23B illustrated in FIGS. 16A to 16D. After the sintering was performed to form the piezoelectric plates 23A and 23B illustrated in FIGS. 16A to 16D, the sintered plates were further heated and hardened with the 1000° C./1000 atm gas as the HIP process. At this time, the gas was set to the Ar 100% atmosphere. By the HIP process, the void could be reduced from 8% to 3%. After the HIP process, the Ag paste of 3 μm was formed as the polarization electrodes on the upper and lower faces of the respective piezoelectric plates 23A and 23B. Then, the voltage of 2 kV/mm was applied to the upper and lower electrodes for the polarization process. The electrodes used in the polarization process were grounded, and the piezoelectric plates 23A and 23B were formed. At this time, the piezoelectric substrate 24 was grounded to have the plate thickness of 150 μm.

Next, the piezoelectric plate 23A and the piezoelectric plate 23B were bonded to each other by the epoxy adhesive as the adhesive 3C. At this time, the two-liquid mixing and thermosetting adhesive (2022 (base compound), 2131D (hardener)) manufactured by ThreeBond Co., Ltd. was used. The epoxy adhesive of 10 μm was applied to the upper face by the screen printing method such that the polarization direction of the piezoelectric substrate 23A faces downward. Then, the piezoelectric plate 23B was bonded to the face on which the adhesive 3C had been applied, such that the polarization direction faces upward. Then, the piezoelectric plates 23A and 23B were heated at 100° C., pressed to be bonded to each other, held for one hour, and hardened, so that the piezoelectric substrate 24 was formed.

As illustrated in FIGS. 17A and 17B, the individual liquid chamber 1 was formed on the piezoelectric substrate 24. At this time, the thickness of the dicing blade was 50 μm, the diameter of the dicing blade was ϕ64 mm, and the diamond abrasive grains of #1600 were used. Further, the dicing saw "DAD 6240 Fully Automatic Dicing Saw" (1.2 kW spindle) manufactured by DISCO Corporation was used as the dicing device. The rotation speed of the dicing blade was set to 20000 rpm, and the stage transport speed was set to 0.2 mm/s. The depth of the individual liquid chamber 1 was 300 μm, and the pitch of the plurality of individual liquid chambers 1 was 254 μm. In the example 3, the 100 individual liquid chambers 1 were aligned.

Next, as illustrated in FIGS. 18A and 18B, the dummy chambers 2 were formed on the piezoelectric substrate 24. The thickness of the dicing blade was 100 μm, and the diameter of the dicing blade was ϕ64 mm same as that used in the processing of the individual liquid chambers 1. Likewise, the diamond abrasive grains of #1600 were used. Also, the rotation speed of the dicing blade and the stage transport speed were respectively the same as those in the processing of the individual liquid chambers 1. The processing depth of the dummy chamber 2 was 330 μm, and the thickness of the partition 3 was 52 μm.

Next, as illustrated in FIGS. 19A and 19B, the extraction electrode grooves (the front face grooves) 7 were likewise formed in the dummy chambers 2 respectively by the dicing blade. Here, the processing condition was the same as that in the case where the dummy chambers 2 were formed. The depth of the groove was 400 μm.

Figure 20:
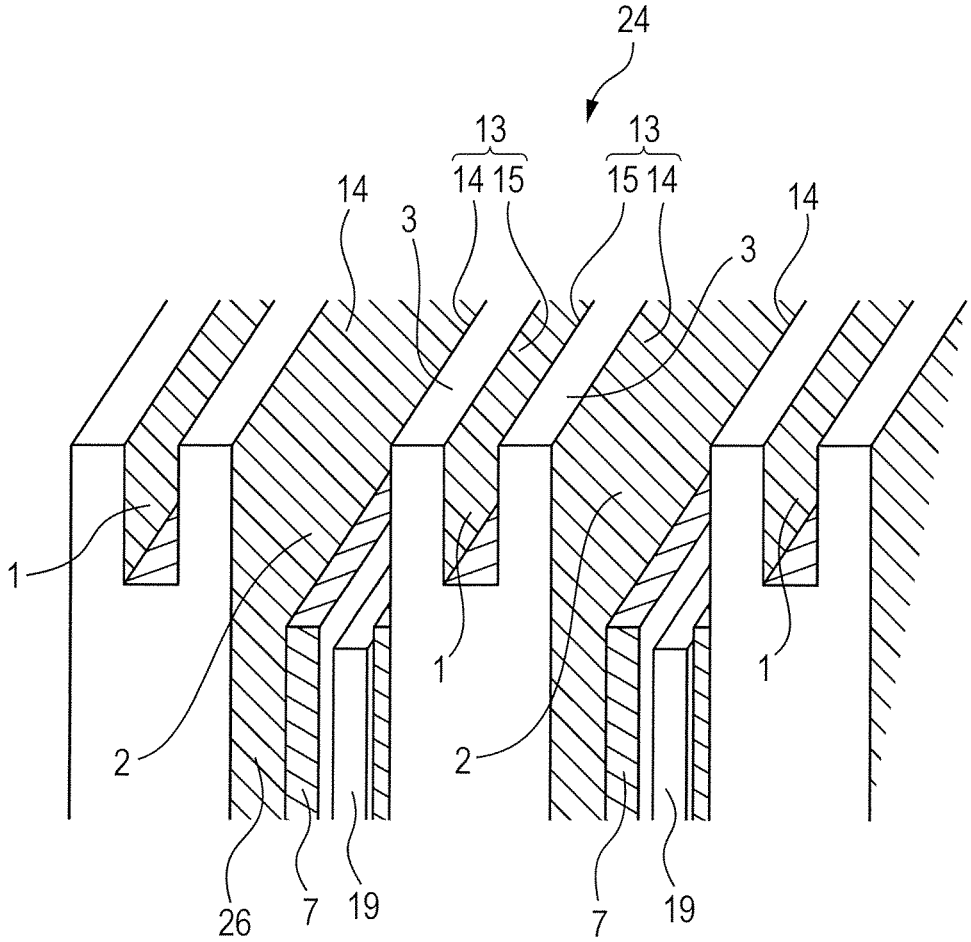
FIG. 20 is a diagram for describing the manufacturing method of the inkjet head according to the fifth embodiment of the present invention.

Next, as illustrated in FIG. 20, the minute recess was formed on the surface of the piezoelectric substrate 24 by the hydrofluoric acid dilution solution as the electroless plating process, to form the signal electrodes 14 and 15. Next, the deleading process of eliminating Pb from the surface was performed by immersing the substrate in the 50% nitric acid solution for five minutes at room temperature. As the catalyst imparting process, in the first stage, the substrate was immersed in the 0.1% stannous chloride solution for two minutes at room temperature so that the stannous chloride was adsorbed. Then, the adsorbed stannous chloride was immersed in the 0.1% palladium chloride solution for two minutes at room temperature, and thus the metallic palladium was adsorbed on the surface by the oxidation-reduction reaction. In this state, for the virgin make-up solution, nickel sulfate serving as metallic salt and DMAB $\{(CH_3)_2NH.BH_3\}$ serving as the reducing agent were used as the Ni plating solution. The plating temperature was set to 60° C., and NaOH and $H_2SO_4$ were used to adjust and obtain pH 6.0. Namely, the Ni—B plating conductor (the conductive layer) 26 of 0.8 μm was formed on the surface of the piezoelectric substrate 24. Further, gold was formed on the nickel surface by the substitution gold plating. Here, the non-cyanide-type plating bath using gold sodium sulfite salt was used as the substitution gold plating bath, and the gold having the film thickness of 0.05 μm was formed in the bath of the temperature 68° C. and pH 7.3.

Next, the upper portion of the nozzle plate bonding face of the partition 3 was eliminated by 5 μm through the grinding. Then, the dividing groove 19 for dividing the signal electrode into the signal electrodes 14 at the bottom of the dummy chamber 2 was formed to individually drive the partition 3 for each individual liquid chamber 1. Here, the electrode was divided and processed by the dicing blade. The blade width was 40 μm, and the processing depth of the dividing groove 19 was 20 μm.

Moreover, as illustrated in FIGS. 21A and 21B, the clearance groove 6 for the adhesive was formed, by using the dicing blade same as that used to form the dividing groove 19, below the openings of the individual liquid chambers on the front face of the piezoelectric substrate so as to extend across the respective extraction electrode grooves 7. The depth of the clearance groove was 20 μm.

As illustrated in FIG. 14A, the nozzles 30*a* for discharging the ink were formed on the nozzle plate 30. Here, the polyimide was used as the material of the nozzle plate 30. Subsequently, the Cytop™ film was formed as the ink-repellent film on the discharge-side surface. Then, the nozzles 30*a* were formed by focusing and irradiating the excimer laser beam on the back side face of the ink-repellent film. The nozzle plate 30 on which the nozzles 30*a* having the respective output sides of ϕ4, 5, 7, 10, 12, 15 and 18 μm were provided was formed. Here, the small diameters of the laser-processed output side correspond to the output portions of the nozzles 30*a* to be used for forming the droplets.

The manifold 40 comprises the ink supply port 41 for supplying the ink to the individual liquid chambers 1. In the example 3, the ink output was provided at the position symmetrical with respect to the ink supply port 41 so as to circulate the ink.

The material of the second substrate 12 serving as the top panel was the PZT same as the material of the first substrate 11. The counterbore portion 12*c* was formed by the drilling in the second substrate 12. The depth thereof was 600 μm, the length of the second opening 1*d* of the individual liquid chamber 1 in the longitudinal direction A2 was 0.4 times of the total length of the individual liquid chamber 1 in the longitudinal direction A2.

The flexible substrate 50 comprises thereon the electrodes 51 for connecting the respective individual liquid chambers 1 to the ground and the electrodes 52 for individually applying electrical signals to the signal electrodes 14 provided on the dummy-chamber sides of the respective partitions 3. Moreover, on the face of the first substrate 11 opposite to the face on which the partitions 3 were provided, the plating was formed entirely at the same time when the electrodes were formed. Consequently, on the face of the first substrate 11 opposite to the face on which the partitions 3 were provided, the dividing groove for dividing the individual signal line corresponding to the signal electrode 14 on the side of the dummy chamber 2 was formed by using the excimer laser. Further, the dividing groove for electrically dividing the individual signal line from the GND electrode signal line of the individual liquid chamber 1 was formed by using the excimer later. The flexible substrate 50 and the first substrate 11 were aligned and bonded to each other by the thermal compression process, thereby electrically connecting these substrates to each other.

Finally, as illustrated in FIG. 14A, the nozzle plate 30, the manifold 40, the second substrate 12 and the flexible substrate 50 were aligned and bonded to the first substrate 11 (i.e., the processed piezoelectric plate 24) on which the partitions 3 had been provided, thereby completing the inkjet head 100.

As a comparative example 3, the inkjet head in which the material and external dimensions of the second substrate were respectively the same as those in the example 3 and which did not have the processed counterbore portion was formed.

In the example 3, the mixture composed of ethylene glycol 85% and water 15% was used as the ink for the inkjet head 100. The ink was introduced from the ink supply port 41 of the manifold 40 through the Tygon™ tube.

The rectangular pulses having the pulse width 8 μs were applied as the driving condition for discharging the droplets. The discharge frequency was 5000 Hz, and the microscope observation of the discharge state was performed. Then, the driving voltage was swept, and the flying state (the discharge state) of the droplet was evaluated.

Figure 30A:
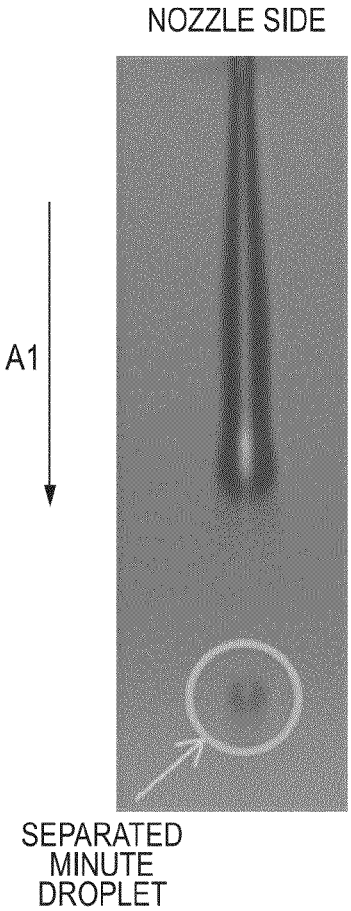
FIGS. 30A and 30B are diagrams illustrating droplet discharge states in respective inkjet heads of an example 3 and a comparative example 3.
Figure 30B:
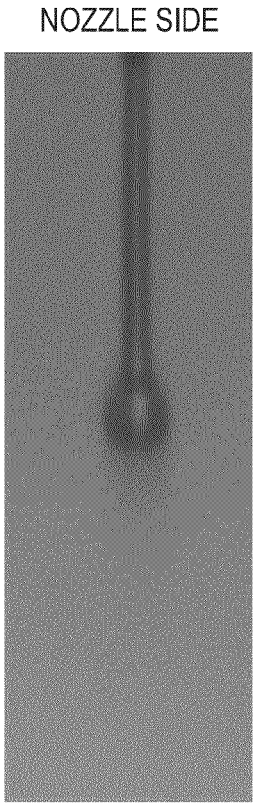

An example of the evaluation is shown in FIGS. 30A and 30B. Namely, FIGS. 30A and 30B are the diagrams illustrating the flying states of the droplets which were observed by the microscope using the nano-pulse light source. More specifically, FIG. 30A illustrates the state that the minute droplet is separated and flown before the main droplet, and this state is no good. FIG. 30B illustrates the normal discharge state that any minute droplet is not separated before the main droplet.

The discharge speed of the main droplet increases if the driving voltage is increased. If the driving voltage is further increased, the minute droplet tends to be separated and generated before the main droplet according to the nozzle diameter in the case where the discharge speed exceeds the certain speed. The maximum main droplet speeds at this time are shown by Table 2. In particular, as the industrial inkjet head, the speed of the main droplet of 5 m/s or more is necessary in consideration of impact accuracy.

TABLE 2

| | ϕ 4 μm | ϕ 5 μm | ϕ 7 μm | ϕ 10 μm | ϕ 12 μm | ϕ 15 μm | ϕ 17 μm |
|---|---|---|---|---|---|---|---|
| Example 3 | No Discharge | 5 m/s | 7 m/s | 10 m/s | 12.5 m/s | 16 m/s | 19 m/s |
| Comparative Example 3 | No Discharge | 0.5 m/s | 1.5 m/s | 3.0 m/s | 4.0 m/s | 4.5 m/s | 6.0 m/s |
| Effect | no good | better | better | better | better | better | good |

In the example 3, it can be understood from Table 2 that, when the diameter of the nozzle 30*a* was ϕ5 μm or more, the normal discharge in which the minute droplet was not separated at the head could be achieved even if the discharge speed of the main droplet was 5 m/s or more (better). On the other hand, when the diameter of the nozzle 30*a* was ϕ4 μm or less, the stable discharge could not be achieved and thus the nozzle was in the no discharge state (no good). Further, when the diameter of the nozzle exceeded ϕ15 μm, the discharge speed of the main droplet could be 5 m/s or more even in the comparative example 3 (good).

That is, in the individual liquid chamber 1 having the shear-mode constitution, with respect to the diameters ϕ5 μm to ϕ15 μm of the nozzle 30*a*, the effect of the example 3 in which the two contact faces with the common liquid chamber 43 positioned on the rear side of the nozzle 30*a* were provided could be confirmed.

The flow of the ink was stable in regard to the nozzle on the ink supply face at only the rear portion in the comparative example 3. Therefore, any problem does not occur if the nozzle has the normal diameter. However, if it intends to reduce the droplet by reducing the nozzle diameter, the phenomenon that the flow speed of the ink in the individual liquid chamber abruptly increases at the central portion in the minute area of the nozzle occurs.

In the example 3, since the flow of the ink is introduced in the two directions from the rear side, the flow of the ink is disturbed. Thus, in addition to the flow toward the liquid discharge direction, the flow is locally generated toward the direction orthogonal to the liquid discharge direction. By the effect of this example, the flow speed distribution in which the flow near the liquid inlet of the nozzle 30*a* is concentrated on the central portion of the nozzle 30*a* is relieved. As a result, the phenomenon that the minute droplet is separated from the main droplet at the head can be restrained. Thus, a high effect can be given if the contact face between the individual liquid chamber 1 and the rear-side common liquid chamber 43 is wider as much as possible. That is, in the example 3, the choked portion is not provided in the first opening 1*c* such that the contact area between the individual liquid chamber 1 and the common liquid chamber 43 becomes maximum.

Incidentally, when the choked portion was provided, the threshold of the main droplet speed by which the separated minute droplet was generated at the head was lowered. In particular, when the nozzle diameter was ϕ10 μm or less, the threshold of the main droplet speed by which the separated minute droplet was generated at the head was lowered to be lower than 5 m/s, and the ink discharge enabling the stable impact could not be performed.

Example 4

Subsequently, the inkjet head according to the example 4 will be described. In the example 4, the inkjet head illustrated in FIGS. 22A and 22B was formed.

Here, the method illustrated in FIGS. 16A to 16D of forming the piezoelectric substrate 24 by bonding the piezoelectric plates 23A and 23B of which the polarization directions are opposite to each other is the same as that in the example 1.

Next, the individual liquid chamber 1 was formed on the piezoelectric substrate 24. At this time, the thickness of the dicing blade was 50 μm, the diameter of the dicing blade was ϕ64 mm, and the diamond abrasive grains of #1600 were used. Further, the dicing saw "DAD 6240 Fully Automatic Dicing Saw" (1.2 kW spindle) manufactured by DISCO Corporation was used as the dicing device. The rotation speed of the dicing blade was set to 20000 rpm, and the stage transport speed was set to 0.2 mm/s. The depth of the individual liquid chamber 1 was 300 μm, and the pitch of the plurality of individual liquid chambers 1 was 254 μm. In the example 4, the 100 individual liquid chambers 1 were aligned.

Subsequently, as illustrated in FIG. 22A, the individual liquid chamber 1 was additionally processed by the same processing method so as to deepen the side of the second end 1*b*. The depth of the individual liquid chamber 1 on the side of the common liquid chamber was 800 μm as the result of the additional processing. The length of the additionally processed portion in the individual liquid chamber 1 from the side of the common liquid chamber in the longitudinal direction A2 was 0.6 times of the total length of the individual liquid chamber 1. In the example 4, the widths of the individual liquid chambers 1 are the same, and the height of the individual liquid chamber on the side of the common liquid chamber has the further higher undisplaced portion.

The dummy chamber 2 was formed in the same manner as that in the example 3. Besides, the processing of the extraction electrode groove 7, the processing of the signal electrodes 14 and 15, the plating elimination of the unnecessary portions, the processing of the dividing groove 19, the processing of the clearance groove 6, and the processing of the nozzle plate 30 were the same as those in the example 3.

In FIGS. 22A and 22B, the length of the counterbore portion 12*c* of the second substrate 12 in the longitudinal direction A2 was 0.5 times of the total length of the individual liquid chamber 1 in the longitudinal direction A2. The bonding of the flexible substrate was the same as that in the example 1. Finally, as illustrated in FIGS. 22A and 22B, the nozzle plate 30, the manifold 40, the second substrate 12 and the flexible substrate were aligned and bonded to the first substrate 11 (i.e., the processed piezoelectric plate 24) on which the partitions 3 had been provided, thereby completing the inkjet head 100A.

In the example 4, the same ink as that in the example 3 was used as the ink for the inkjet head 100A. The ink was introduced from the ink supply port 41 of the manifold 40 through the Tygon™ tube. Then, the state that the minute droplet was generated from the main droplet at the head was evaluated based on the discharge observation result according to the manner same as that in the example 3.

As well as the example 3, the maximum main droplet speeds at this time are shown by Table 3. In particular, as the industrial inkjet head, the speed of the main droplet of 5 m/s or more is necessary in consideration of impact accuracy.

TABLE 3

| | ϕ 4 μm | ϕ 5 μm | ϕ 7 μm | ϕ 10 μm | ϕ 12 μm | ϕ 15 μm |
|---|---|---|---|---|---|---|
| Example 4 | No Discharge | 6 m/s | 8 m/s | 12 m/s | 14 m/s | 18 m/s |
| Effect | no good | good | good | good | good | good |

Also, in the example 4, it can be understood from Table 3 that, when the diameter of the nozzle was ϕ5 μm or more, the normal discharge in which the minute droplet was not separated at the head could be achieved even if the discharge speed of the main droplet was 5 m/s or more (good). On the other hand, when the diameter of the nozzle was ϕ4 μm or less, the stable discharge could not be achieved and thus the nozzle was in the no discharge state (no good).

That is, in the individual liquid chamber having the shear-mode constitution, with respect to the diameters ϕ5 μm to ϕ15 μm of the nozzle, the effect of the example 4 in which the two contact faces with the common liquid chamber positioned on the rear side of the nozzle were provided could be confirmed.

Example 5

In the above example 3, the effect was confirmed in regard to the ratio L1/L2 of the length L1 of the counterbore portion 12*c* (the second opening 1*d*) in the longitudinal direction A2 to the length L2 of the individual liquid chamber 1 in the longitudinal direction A2. That is, this example was performed in the same manner as that in the example 3 except for the ratio of the length of the counterbore portion 12*c* in the longitudinal direction.

Figure 31:
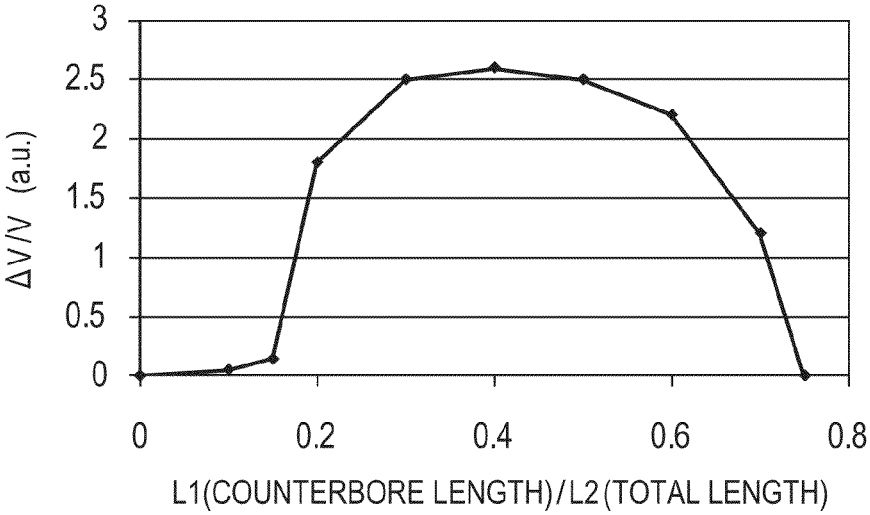
FIG. 31 is a graph indicating a relation of ΔV/V to L1/L2.

Also, the matters same as those in the example 3 were evaluated. The evaluation result obtained on condition that the maximum speed at which the minute droplet was generated at the head in the state that the counterbore portion was not provided was V and the increase (effect) in the maximum speed was ΔV is shown in FIG. 31. In this graph, the vertical axis is standardized by the maximum speed V in the comparative example. According to this example, the remarkable effect could be obtained when (the length L1 of the counterbore portion (the counterbore length))/(the total length L2 of the individual liquid chamber 1) was 0.2 or more, and the effect could not be obtained when the above ratio exceeded 0.7. When the above ratio exceeded 0.7, since the length of the displacement region of the individual liquid chamber was short, the discharge force was lowered, and thus the ink was not discharged.

That is, if it is assumed that the length of the second opening 1*d* in the longitudinal direction A2 is L1 and the length of the individual liquid chamber 1 in the longitudinal direction A2 is L2, the effect of restraining the minute droplets becomes remarkable when L1/L2 is within the range of 0.2 to 0.7.

Example 6

Subsequently, the inkjet head according to the example 6 will be described. In the example 6, the inkjet head illustrated in FIGS. 23A and 23B was formed.

First, the method illustrated in FIGS. 16A to 16D of forming the piezoelectric substrate 24 by bonding the piezoelectric plates 23A and 23B of which the polarization directions are opposite to each other is the same as that in the example 1.

Next, as illustrated in FIGS. 17A and 17B, the individual liquid chamber 1 was formed on the piezoelectric substrate 24. At this time, the thickness of the dicing blade was 60 μm, the diameter of the dicing blade was ϕ51 mm, and the diamond abrasive grains of #1600 were used. Further, the dicing saw "DAD 6240 Fully Automatic Dicing Saw" (1.2 kW spindle) manufactured by DISCO Corporation was used as the dicing device. The rotation speed of the dicing blade was set to 20000 rpm, and the stage transport speed was set to 0.2 mm/s. The depth of the individual liquid chamber 1 was 250 μm, and the pitch of the plurality of individual liquid chambers 1 was 254 μm. In the example 4, the 100 individual liquid chambers 1 were aligned.

The dummy chamber 2 was manufactured in the same manner as that in the example 3. Besides, the processing of the extraction electrode groove 7, the processing of the signal electrodes 14 and 15, the plating elimination of the unnecessary portions, the processing of the dividing groove 19, the processing of the clearance groove 6, and the processing of the nozzle plate 30 were the same as those in the example 3.

As illustrated in FIGS. 23A and 23B, only the outer shape was processed for the second substrate 12.

Then, the partitions provided on the first substrate 11 and the second substrate 12 were aligned and bonded together. After then, as the liquid chamber portion 43B of the common liquid chamber 43, the counterbore portion 11*c* was formed below the individual liquid chambers 1 of the first substrate 11 by the dicing blade processing. At this time, after the processing region was filled with the wax for reinforcement to prevent damage of the partitions caused by contact with the common liquid chamber, the dicing blade processing was performed. The contact length with the individual liquid chamber was set to 0.5 times of the total length of the individual liquid chamber. Incidentally, the bonding processing for the flexible substrate 50 was the same as that in the example 1. Finally, as illustrated in FIGS. 23A and 23B, the nozzle plate 30, the manifold 40, the second substrate 12 and the flexible substrate are aligned and bonded to the first substrate 11 (i.e., the processed piezoelectric substrate 24) on which the partitions had been provided, thereby completing the inkjet head.

In the example 6, the same ink as that in the example 3 was used as the ink for the inkjet head. The ink was introduced from the ink supply port 41 of the manifold 40 through the Tygon™ tube.

Then, the state that the minute droplet was generated from the main droplet at the head was evaluated based on the discharge observation result according to the manner same as that in the example 3. As well as the example 3, the maximum main droplet speeds at this time are shown by Table 4. In particular, as the industrial inkjet head, the speed of the main droplet of 5 m/s or more is necessary in consideration of impact accuracy.

TABLE 4

| | ϕ 4 μm | ϕ 5 μm | ϕ 7 μm | ϕ 10 μm | ϕ 12 μm | ϕ 15 μm |
|---|---|---|---|---|---|---|
| Example 6 | No Discharge | 5 m/s | 7 m/s | 10.5 m/s | 12 m/s | 16 m/s |
| Effect | no good | good | good | good | good | good |

Also, in the example 6, it can be understood from Table 4 that, when the diameter of the nozzle was ϕ5 μm or more, the normal discharge in which the minute droplet was not separated at the head could be achieved even if the discharge speed of the main droplet was 5 m/s or more (good). On the other hand, when the diameter of the nozzle was ϕ4 μm or less, the stable discharge could not be achieved and thus the nozzle was in the no discharge state (no good).

That is, in the individual liquid chamber having the shear-mode constitution, with respect to the diameters ϕ5 μm to ϕ15 μm of the nozzle, the effect of the example 6 in which the two contact faces with the common liquid chamber positioned on the rear side of the nozzle were provided could be confirmed.

According to the present invention, since the flow of the liquid from the individual liquid chamber toward the common liquid chamber is large at the time of liquid discharge, the flow of the liquid toward the nozzle is restrained. Consequently, it is possible to reduce the percentage of the change of the discharge speed of the liquid to the pressure applied to the liquid, and it is thus possible to improve the controllability of the discharge speed of the liquid.

Moreover, even if the amount of the droplets to be discharged is made small by reducing the diameter of the nozzle, the minute droplets are not separated and generated before the main droplets, it is thus possible to stably discharge the droplets.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-018079, filed Feb. 1, 2013, and Japanese Patent Application No. 2013-018080, filed Feb. 1, 2013, which are hereby incorporated by reference herein in their entirety.

What is claimed is:

1. A liquid discharge apparatus comprising:

a first substrate and a second substrate;

a plurality of partitions, constituted by a piezoelectric material, which form a plurality of individual liquid chambers extending in a longitudinal direction;

a nozzle member which is arranged on a side of a first end of the individual liquid chambers, and on which nozzles connected to corresponding ones of the individual liquid chambers are formed;

a common liquid chamber forming member which is arranged on a side of a second end opposite to the first end of the individual liquid chambers, and forms a common liquid chamber connected to the plurality of individual liquid chambers; and a plurality of pairs of electrodes, each of which is arranged on both side faces of corresponding ones of the partitions, such that the each partition is divided into a movable region to which an electric field for shear-deforming the partition at a portion on the side of the nozzle is applied and an immovable region to which the electric field is not applied at a portion on the side of the common liquid chamber, wherein each individual liquid chamber is formed such that a cross-sectional area of a cross-section along a face perpendicular to the longitudinal direction at the second end is wider than a cross-sectional area of a cross-section along the face perpendicular to the longitudinal direction at a first boundary point closest to the first end on a boundary between the movable region and the immovable region.

2. The liquid discharge apparatus according to claim 1, wherein a height of each individual liquid chamber at the second end is higher than a height of the each individual liquid chamber at the first boundary point.

3. The liquid discharge apparatus according to claim 1, wherein each individual liquid chamber is formed such that the cross-sectional area of the cross-section along the face perpendicular to the longitudinal direction of the individual liquid chamber becomes continuously or gradually wide as it approaches the second end from the first boundary point.

4. The liquid discharge apparatus according to claim 1, wherein an air chamber which is not connected to the common liquid chamber and partitioned by each partition is formed between two adjacent individual liquid chambers among the plurality of individual liquid chambers.

5. The liquid discharge apparatus according to claim 1, wherein a diameter of each of the nozzles is within a range of 5 μm to 15 μm.

6. The liquid discharge apparatus according to claim 1, wherein, if it is assumed that the cross-sectional area at the first boundary point is S1 and the cross-sectional area at the second end is S2, S2/S1 is within a range of 1.8 to 3.5.

7. The liquid discharge apparatus according to claim 1, wherein, if it is assumed that a length in the longitudinal direction from a second boundary point closest to the second end on the boundary between the movable region and the immovable region to the first end is L1 and a length in the longitudinal direction from the second boundary point to the second end is L2, L2/L1 is within a range of 0.6 to 1.7.

8. A liquid discharge apparatus comprising:

a first substrate and a second substrate;

a plurality of partitions, constituted by a piezoelectric material, which form a plurality of individual liquid chambers extending in a longitudinal direction;

a plurality of pairs of electrodes, each of which is arranged on both side faces of a corresponding one of the partitions so as to shear-deform the partition;

a nozzle member which is arranged on a side of a first end of the individual liquid chambers, and on which nozzles connected to corresponding ones of the individual liquid chambers are formed; and a common liquid chamber forming member which is arranged on a side of a second end opposite to the first end of the individual liquid chambers, and forms a common liquid chamber together with the first substrate and the second substrate, wherein each individual liquid chamber is connected to the common liquid chamber through a first opening opened in the longitudinal direction at the second end and a second opening opened in a height direction.

9. The liquid discharge apparatus according to claim 8, wherein the first opening and the second opening are formed so as to be in contact with each other.

10. The liquid discharge apparatus according to claim 8, wherein the first opening coincides with a cross-section along a face perpendicular to the longitudinal direction at the second end of each individual liquid chamber.

11. The liquid discharge apparatus according to claim 8, wherein each pair of electrodes is arranged so as to face each other with a movable region therebetween, such that each partition is divided into the movable region to which an electric field for shear-deforming the partition at a portion on the side of the nozzle is applied and an immovable region to which the electric field is not applied at a portion on the side of the common liquid chamber.

12. The liquid discharge apparatus according to claim 11, wherein each individual liquid chamber is formed such that a height thereof at the second end is higher than a height thereof at a boundary point closest to the first end on a boundary between the movable region and the immovable region.

13. The liquid discharge apparatus according to claim 11, wherein each individual liquid chamber is formed such that a height thereof at the first end is lower than a height thereof at a boundary point closest to the first end on a boundary between the movable region and the immovable region.

14. The liquid discharge apparatus according to claim 8, wherein an air chamber which is not connected to the common liquid chamber and partitioned by the partitions is formed so as not to overlap the second opening in a width direction, between two adjacent individual liquid chambers among the plurality of individual liquid chambers.

15. The liquid discharge apparatus according to claim 8, wherein a diameter of each of the nozzles is within a range of 5 μm to 15 μm.

16. The liquid discharge apparatus according to claim 8, wherein, if it is assumed that a length of the second opening in the longitudinal direction is L1 and a length of each individual liquid chamber in the longitudinal direction is L2, L1/L2 is within a range of 0.2 to 0.7.

* * * * *